US006626251B1

(12) United States Patent
Sullivan et al.

(10) Patent No.: US 6,626,251 B1
(45) **Date of Patent: *Sep. 30, 2003**

(54) METHOD AND APPARATUS FOR MONITORING AND RECORDING OF THE OPERATING CONDITION OF A DOWNHOLE DRILL BIT DURING DRILLING OPERATIONS

(75) Inventors: Eric Charles Sullivan, Houston, TX (US); Theodore Edward Zaleski, Jr., Houston, TX (US); Scott Ray Schmidt, The Woodlands, TX (US); Don Quy Nguyen, Houston, TX (US); Glenn R. Zadrapa, Highlands, TX (US); Chih Lin, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/777,569

(22) Filed: Feb. 6, 2001

Related U.S. Application Data

(62) Division of application No. 09/012,803, filed on Jan. 23, 1998, now Pat. No. 6,230,822, which is a continuation-in-part of application No. 08/760,122, filed on Dec. 3, 1996, now Pat. No. 5,813,480, which is a continuation of application No. 08/643,909, filed on May 7, 1996, now abandoned, which is a continuation of application No. 08/390,322, filed on Feb. 16, 1995, now abandoned.

(51) Int. Cl.[7] ..... E21B 10/00; E21B 47/12

(52) U.S. Cl. ..... 175/40

(58) Field of Search ..... 175/27, 24, 40, 175/45, 50, 46, 327; 340/853.1, 853.3

(56) References Cited

U.S. PATENT DOCUMENTS

| | | | | |
|---|---|---|---|---|
| 5,160,925 A | * | 11/1992 | Dailey et al. | 340/853.3 |
| 5,813,480 A | * | 9/1998 | Zaleski, Jr. et al. | 175/40 |
| 6,176,323 B1 | * | 1/2001 | Weirich et al. | 175/40 |
| 6,206,108 B1 | * | 3/2001 | MacDonald et al. | 175/24 |

* cited by examiner

*Primary Examiner*—William Neuder
(74) *Attorney, Agent, or Firm*—Melvin A. Hunn

(57) ABSTRACT

An improved drill bit is provided with a sensor for monitoring an operating condition during drilling. A fastener system is provided for securing an erodible ball in a fixed position relative to a flow pathway until a predetermined operating condition is detected by the sensor, and for releasing the erodible ball into the flow pathway to obstruct the flow through at least one bit nozzle.

40 Claims, 32 Drawing Sheets

METHOD AND APPARATUS FOR MONITORING AND RECORDING OF THE OPERATING CONDITION OF A DOWNHOLE DRILL BIT DURING DRILLING OPERATIONS

CROSS REFERENCE TO RELATED APPLICATION

This is a Division of application Ser. No. 09/012,803 filed on Jan. 23, 1998, for METHOD AND APPARATUS FOR MONITORING AND RECORDING OF THE OPERATING CONDITION OF A DOWNHOLE DRILL BIT DURING DRILLING OPERATIONS U.S. Pat. No. 6,230,822 which is a continuation-in-part of prior application Ser. No. 08/760,122, filed Dec. 3, 1996, now U.S. Pat. No. 5,813,480, issued Sep. 29, 1998, which is a continuation under 37 CFR 1.62 of U.S. patent application Ser. No. 08/643,909, filed May 7, 1996, abandoned entitled Method and Apparatus for Monitoring and Recording of Operating for Monitoring and Recording of Operating Conditions of a Downhole Drill Bit During Drilling Operations, with the following inventors: Theodore E. Zaleski, Jr., and Scott R. Schmidt; which is a continuation of U.S. patent application Ser. No. 08/390,322, filed Feb. 16, 1995, abandoned entitled Method and Apparatus for Monitoring and Recording of Operating Conditions of a Downhole Drill Bit During Drilling Operations, with the following inventors: Theodore E. Zaleski, Jr., and Scott R. Schmidt. These prior applications are incorporated herein by reference as if fully set forth.

BACKGROUND OF THE INVENTION

1. Field of the Invention

The present application relates in general to oil and gas drilling operations, and in particular to an improved method and apparatus for monitoring the operating conditions of a downhole drill bit during drilling operations.

2. Description of the Prior Art

The oil and gas industry expends sizable sums to design cutting tools, such as downhole drill bits including rolling cone rock bits and fixed cutter bits, which have relatively long service lives, with relatively infrequent failure. In particular, considerable sums are expended to design and manufacture rolling cone rock bits and fixed cutter bits in a manner which minimizes the opportunity for catastrophic drill bit failure during drilling operations. The loss of a cone or cutter compacts during drilling operations can impede the drilling operations and necessitate rather expensive fishing operations. If the fishing operations fail, side track drilling operations must be performed in order to drill around the portion of the wellbore which includes the lost cones or compacts. Typically, during drilling operations, bits are pulled and replaced with new bits even though significant service could be obtained from the replaced bit. These premature replacements of downhole drill bits are expensive, since each trip out of the wellbore prolongs the overall drilling activity, and consumes considerable manpower, but are nevertheless done in order to avoid the far more disruptive and expensive fishing and side track drilling operations necessary if one or more cones or compacts are lost due to bit failure.

SUMMARY OF THE INVENTION

IN GENERAL: The present invention is directed to an improved method and apparatus for monitoring and recording of operating conditions of a downhole drill bit during drilling operations. The invention may be alternatively characterized as either (1) an improved downhole drill bit, or (2) a method of performing drilling operations in a borehole and monitoring at least one operating condition of a downhole drill bit during drilling operations in a wellbore, or (3) a method of manufacturing an improved downhole drill bit.

When characterized as an improved downhole drill bit, the present invention includes (1) an assembly including at least one bit body, (2) a coupling member formed at an upper portion of the assembly, (3) at least one operating condition sensor carried by the improved downhole drill bit for monitoring at least one operating condition during drilling operations, and (4) at least one electronic or semiconductor memory located in and carried by the assembly, for recording in memory data pertaining to the at least one operating condition.

The present invention may be characterized as in improved drill bit for use in drilling operations in a wellbore. The improved drill bit includes an number of components which cooperate. A bit body is provided which includes a plurality of bit heads, each supporting a rolling cone cutter. A coupling member is formed at an upper portion of the bit body. Preferably, but not necessarily, the coupling member comprises a threaded coupling for connecting the improved drill bit to a drillstring in a conventional pin-and-box threaded coupling. The improved drill bit may include either or both of a temperature sensor and a lubrication system sensor.

TEMPERATURE SENSING: For example, the improved drill bit includes at least one temperature sensor for monitoring at least one temperature condition of the improved drill bit during drilling operations. In accordance with this particular embodiment of the present invention, at least one temperature sensor cavity is formed in the bit body and adapted for receiving, carrying and locating at least one temperature sensor in a particular position relative to the bit body which is empirically determined to optimize temperature sensor discrimination. At least one electronic or semiconductor memory member is provided, and located in, and carried by the drill bit body, for recording in memory data obtained by the at least one temperature sensor.

In accordance with this embodiment of the present invention, the temperature sensor cavity is located in the bit body in a position which is empirically determined to optimize temperature sensor discrimination. More particularly, the temperature sensor cavity is located in the head bearing in a substantially medial position which is proximate to the centerline of the head bearing. More particularly, the temperature sensor cavity is provided in a medial position within the head bearing about its centerline between its base and the thrust face.

CONDUCTOR ROUTING: Conductors are provided to communicatively couple the electrical components carried by the improved rock bit. A plurality of wire pathways are formed in the plurality of bit legs in order to allow the conductors to be routed to the electrical components. In order to allow electrical connection between the components carried in the legs of the improved rock bit, a novel tri-tube assembly is provided. The tri-tube assembly includes a plurality of fluid-impermeable tube segments. Each of the fluid-impermeable tube segments is placed into communication with a wire pathway in one of the plurality of bit legs. The opposite ends of the fluid-impermeable tube segments are brought together at a connector. Conductors are routed through the fluid-impermeable tube segments to provide power to power-consuming electrical components and to pass data between the electrical components.

LUBRICATION MONITORING: The present invention can also be utilized to monitor the operating condition of the lubrication systems in an improved rock bit. In accordance with the present invention, a bit body is formed from a plurality of bit legs. Each of the plurality of bit legs include a head bearing, a rolling cone cutter coupled to the head bearing, a bearing assembly facilitating rotary movement of the rolling cone cutter relative to the bearing head, a lubrication system for providing lubricant to the bearing assembly, and an electrical sensor in communication with the lubrication of the lubrication system for monitoring at least one electrical property of the lubricant.

Additionally, a semiconductor member is carried by the bit body, and a sampling circuit is provided for developing digital samples from the sensor from the plurality of bit legs and for recording the digital samples in the semiconductor memory. In accordance with one embodiment of the present invention, the electrical sensor comprises a dielectric sensor which is preferably, but not necessarily, a capacitive electrical component. In accordance with the present invention, the capacitive electrical component is placed within the lubrication system to allow lubricant to lodge between the capacitor plates. As the lubricant degrades during use due to working shear, or if ingress of drilling fluid into the lubricating system occurs, the lubricant is altered in a manner which changes the dielectric constant of the lubricant. An increase in working shear will result in an increase in the dialectric constant of the lubricant. This change in the dielectric constant of the lubricant is detected utilizing the capacitive circuit component. The ingress of drilling fluid will also impact the dielectric permitivity of the lubricant and can also be detected utilizing the capacitive circuit element.

TRANSIENT-PRESSURE CHANGE COMMUNICATION SYSTEM: The embodiment of the improved drill bit which is described herein further includes a relatively simple downhole-to-surface communication system which is utilized to provide a warning signal to a surface location by generating transient or persistent pressure change within the wellbore. A transient pressure change may be generated utilizing an erodible ball. The erodible ball is secured in position within the improved drill bit utilizing a fastener system. The erodible ball is maintained in a predetermined position relative to a flow path which supplies drilling fluid to at least one bit nozzle carried by the improved drill bit. Once a predetermined operating condition is detected by a monitoring system carried by the improved drill bit (such as the temperature and lubrication monitoring systems described above), the fastener system is actuated to release the erodible ball into the flow path. The erodible ball passes down the flow path toward the bit nozzle, where it is caught by the bit nozzle and serves to at least partially and temporarily obstruct the flow of drilling fluid through the bit nozzle. In accordance with the present invention, the erodible ball preferably includes at least one flow port extending through at a least a portion of the erodible ball to allow drilling fluid to pass therethrough, and at least one circumferential groove formed over at least one portion of the erodible ball to allow drilling fluid to pass around the ball.

PERSISTENT PRESSURE CHANGE COMMUNICATION SYSTEM: A persistent pressure change, as opposed to a transient or temporary pressure change, may be generated utilizing an electrically-actuable valve which utilizes the pressure differential between the central bore of the drillstring and the annular region between the drillstring and the borehole. For example, allowing fluid communication between the annulus and the central bore will decrease the pressure of the drilling fluid within the central bore. In this particular embodiment, a port is provided between the exterior of the bit body and the flow paths within the bit body. An electrically-actuable "valve" is provided to block flow until signalling is required. Preferably, the "valve" includes a structural body which is secured into a flow blocking condition by a propellent material that is thermally actuable. An electrical element is carried in the structural element. When an open flow path is desired, a current is passed through the electrical element causing it to change from a solid state to a gaseous state. This allows the structural element to change shape, allowing fluid flow between the central bore and the annulus. This causes a slight pressure decrease in the drilling fluid which is carried in the central bore.

At least one pressure sensor can be located in an uphole location (such as a surface location) in order to detect the pressure change. In accordance with the embodiment of the present invention which utilizes transient pressure changes, the erodible ball is constructed to erode or dissolve under exposure to drilling fluid in a manner which provides a pressure change of a minimum time duration, in order to distinguish the pressure change from pressure changes which occur for other reasons during drilling operations.

DOWNHOLE ADAPTIVE CONTROL: The present invention may also be utilized to provide adaptive control of a drilling tool during drilling operations. The purpose of the adaptive control is to select one or more operating set points for the tool, to monitor sensor data including at least one sensor which determines the current condition of at least one controllable actuator member carried in the drilling tool or in the bottomhole assembly near the drilling tool which can be adjusted in response to command signals from a controller.

The above as well as additional objectives, features, and advantages will become apparent in the following description.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1:
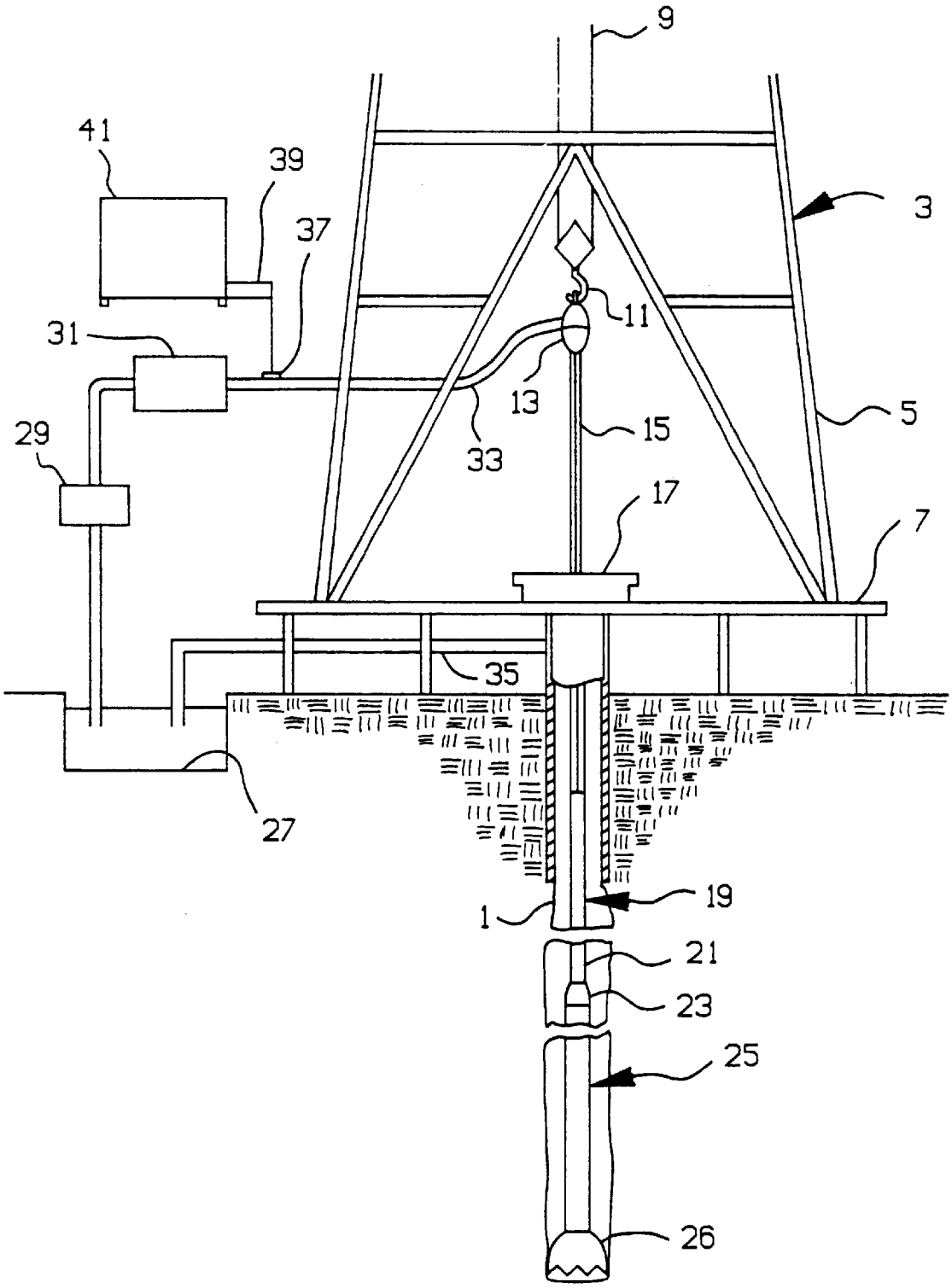
FIG. 1 depicts drilling operations conducted utilizing an improved downhole drill bit in accordance with the present invention, which includes a monitoring system for monitoring at least one operating condition of the downhole drill bit during the drilling operations.

1. OVERVIEW OF DRILLING OPERATIONS: FIG. 1 depicts one example of drilling operations conducted in accordance with the present invention with an improved downhole drill bit which includes within it a memory device which records sensor data during drilling operations. As is shown, a conventional rig 3 includes a derrick 5, derrick floor 7, draw works 9, hook 11, swivel 13, kelly joint 15, and rotary table 17. A drillstring 19 which includes drill pipe section 21 and drill collar section 23 extends downward from rig 3 into borehole 1. Drill collar section 23 preferably includes a number of tubular drill collar members which connect together, including a measurement-while-drilling logging subassembly and cooperating mud pulse telemetry data transmission subassembly, which are collectively referred to hereinafter as "measurement and communication system 25".

During drilling operations, drilling fluid is circulated from mud pit 27 through mud pump 29, through a desurger 31, and through mud supply line 33 into swivel 13. The drilling mud flows through the kelly joint and into an axial central bore in the drillstring. Eventually, it exits through jets or nozzles which are located in downhole drill bit 26 which is connected to the lowermost portion of measurement and communication system 25. The drilling mud flows back up through the annular space between the outer surface of the drillstring and the inner surface of wellbore 1, to be circulated to the surface where it is returned to mud pit 27 through mud return line 35. A shaker screen (which is not shown) separates formation cuttings from the drilling mud before it returns to mud pit 27.

Preferably, measurement and communication system 25 utilizes a mud pulse telemetry technique to communicate data from a downhole location to the surface while drilling operations take place. To receive data at the surface, transducer 37 is provided in communication with mud supply line 33. This transducer generates electrical signals in response to drilling mud pressure variations. These electrical signals are transmitted by a surface conductor 39 to a surface electronic processing system 41, which is preferably a data processing system with a central processing unit for executing program instructions, and for responding to user commands entered through either a keyboard or a graphical pointing device.

The mud pulse telemetry system is provided for communicating data to the surface concerning numerous downhole conditions sensed by well logging transducers or measurement systems that are ordinarily located within measurement and communication system 25. Mud pulses that define the data propagated to the surface are produced by equipment which is located within measurement and communication system 25. Such equipment typically comprises a pressure pulse generator operating under control of electronics contained in an instrument housing to allow drilling mud to vent through an orifice extending through the drill collar wall. Each time the pressure pulse generator causes such venting, a negative pressure pulse is transmitted to be received by surface transducer 37. An alternative conventional arrangement generates and transmits positive pressure pulses. As is conventional, the circulating mud provides a source of energy for a turbine-driven generator subassembly which is located within measurement and communication system 25. The turbine-driven generator generates electrical power for the pressure pulse generator and for various circuits including those circuits which form the operational components of the measurement-while-drilling tools. As an alternative or supplemental source of electrical power, batteries may be provided, particularly as a back-up for the turbine-driven generator.

Figure 2:
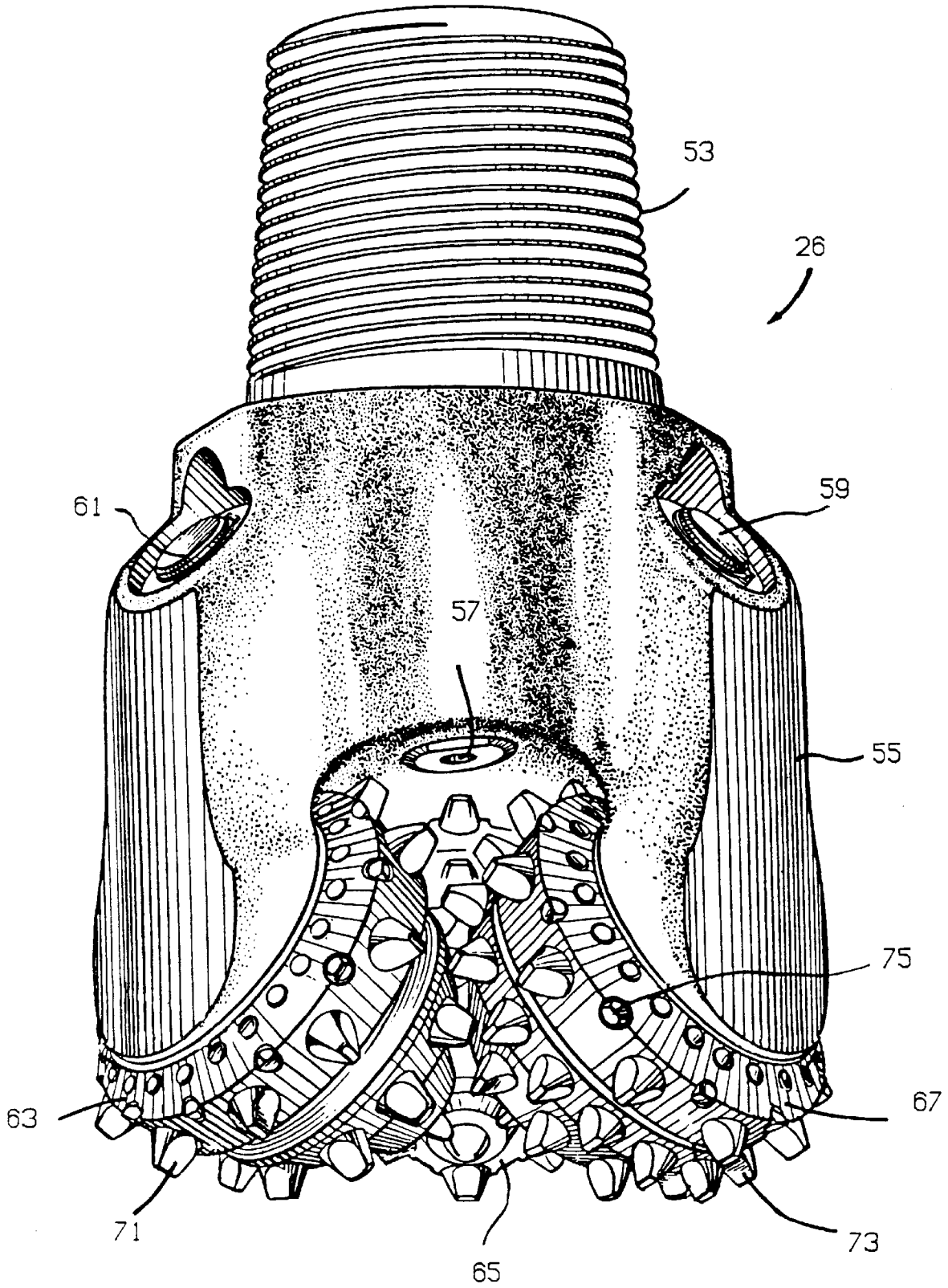
FIG. 2 is a perspective view of an improved downhole drill bit.

2. UTILIZATION OF THE INVENTION IN ROLLING CONE ROCK BITS: FIG. 2 is a perspective view of an improved downhole drill bit 26 in accordance with the present invention. The downhole drill bit includes an externally-threaded upper end 53 which is adapted for coupling with an internally-threaded box end of the lowermost portion of the drillstring. Additionally, it includes bit body 55. Nozzle 57 and the other obscured nozzles jet fluid that is pumped downward through the drillstring to cool downhole drill bit 26, clean the cutting teeth of downhole drill bit 26, and transport the cuttings up the annulus. Improved downhole drill bit 26 includes three bit heads (but may alternatively include a lesser or greater number of heads) which extend downward from bit body 55 and terminate at journal bearings (not depicted in FIG. 2 but depicted in FIG. 3, but which may alternatively include any other conventional bearing, such as a roller bearing) which receive rolling cone cutters 63, 65, 67. Each of rolling cone cutters 63, 65, 67 is lubricated by a lubrication system which is accessed through compensator caps 59, 60 (obscured in the view of FIG. 2), and 61. Each of rolling cone cutters 63, 65, 67 includes cutting elements, such as cutting elements 71, 73, and optionally include gage trimmer inserts, such as gage trimmer insert 75. As is conventional, cutting elements may comprise tungsten carbide inserts which are press fit into holes provided in the rolling cone cutters. Alternatively, the cutting elements may be machined from the steel which forms the body of rolling cone cutters 63, 65, 67. The gage trimmer inserts, such as gage trimmer insert 75, are press fit into holes provided in the rolling cone cutters 63, 65, 67. No particular type, construction, or placement of the cutting elements is required for the present invention, and the drill bit depicted in FIGS. 2 and 3 is merely illustrative of one widely available downhole drill bit.

Figure 3:
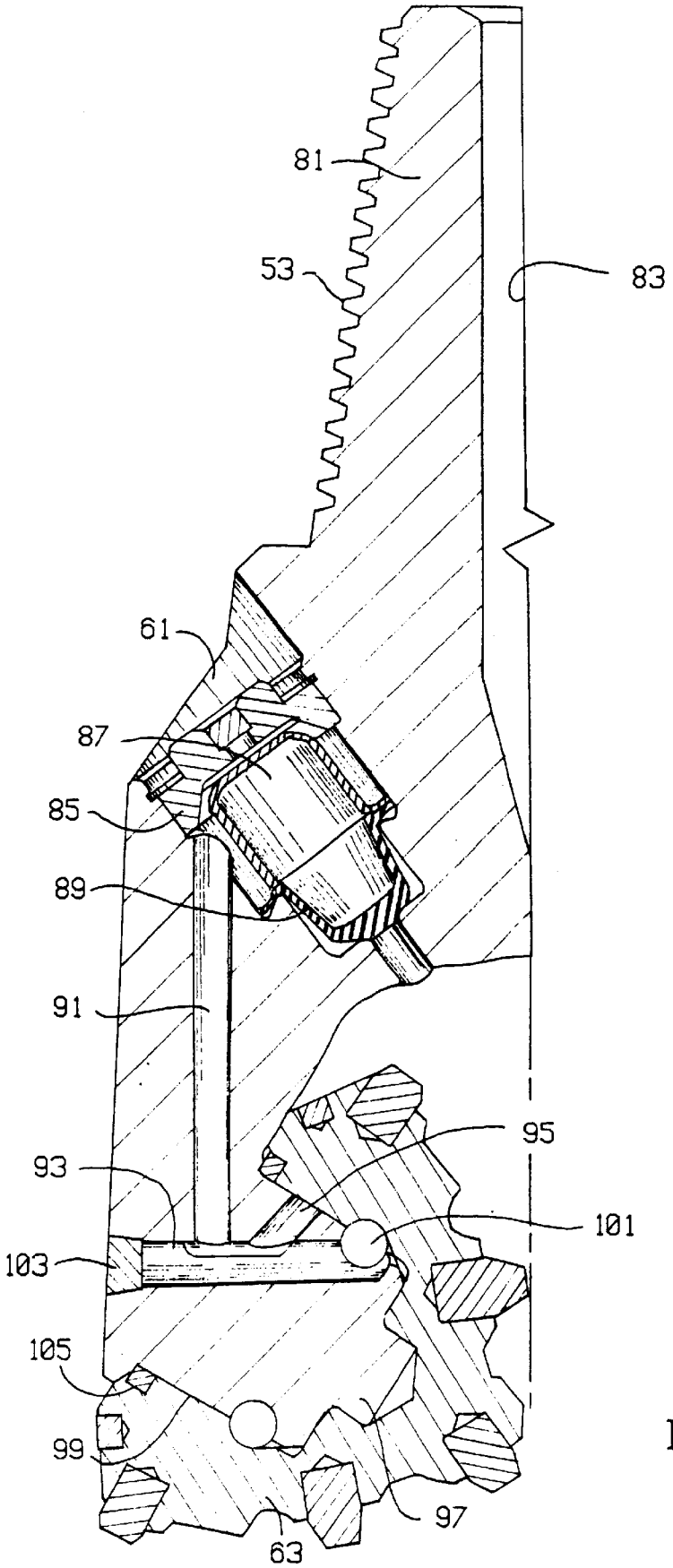
FIG. 3 is a longitudinal section view of a portion of the downhole drill bit depicted in FIG. 2.

FIG. 3 is a longitudinal section view of the improved downhole drill bit 26 of FIG. 2. One bit head 81 is depicted in this view. Central bore 83 is defined interiorly of bit head 81. Externally threaded pin 53 is utilized to secure downhole drill bit 26 to an adjoining drill collar member. In alternative embodiments, any conventional or novel coupling may be utilized. A lubrication system 85 is depicted in the view of FIG. 3 and includes compensator 87 which includes compensator diaphragm 89, lubrication passage 91, lubrication passage 93, and lubrication passage 95. Lubrication passages 91, 93, and 95 are utilized to direct lubricant from compensator 97 to an interface between rolling cone cutter 63 and cantilevered journal bearing 97, to lubricate the mechanical interface 99 thereof. Rolling cone cutter 63 is secured in position relative to cantilevered journal bearing 97 by ball lock 101 which is moved into position through lubrication passage 93 through an opening which is filled by plug weld 103. The interface 99 between cantilevered journal bearing 97 and rolling cone cutter 63 is sealed by o-ring seal 105; alternatively, a rigid or mechanical face seal may be provided in lieu of an o-ring seal. Lubricant which is routed from compensator 87 through lubrication passages 91, 93, and 95 lubricates interface 99 to facilitate the rotation of rolling cone cutter 63 relative to cantilevered journal bearing 97. Compensator 87 may be accessed from the exterior of downhole drill bit 26 through removable compensator cap 61. In order to simplify this exposition, the plurality of operating condition sensors which are placed within downhole drill bit 26 are not depicted in the view of FIG. 3. The operating condition sensors are however shown in their positions in the views of FIGS. 8A through 8H.

Figure 4:
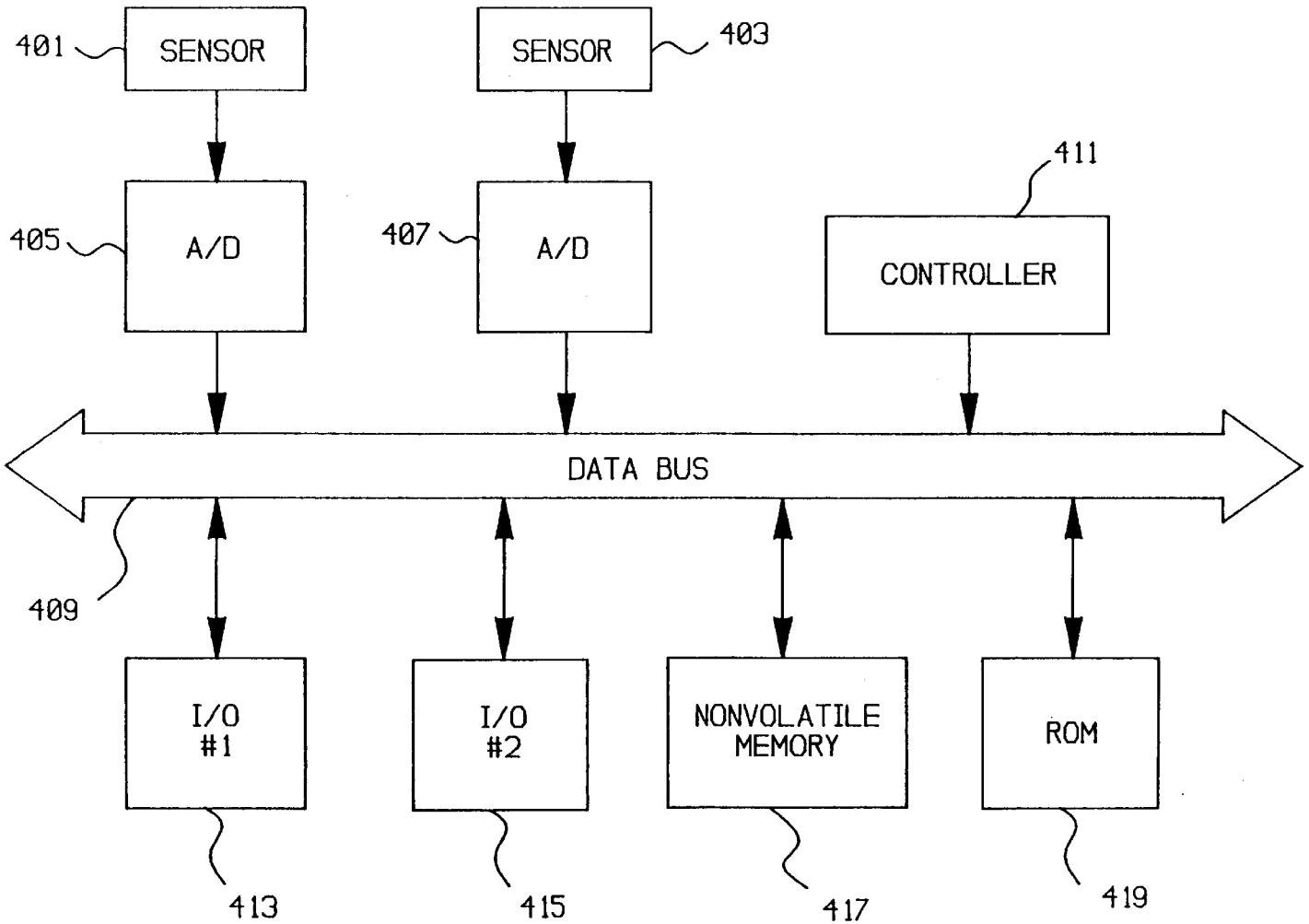
FIG. 4 is a block diagram view of the components which are utilized to perform signal processing, data analysis, and communication operations.

3. OVERVIEW OF DATA RECORDATION AND PROCESSING: FIG. 4 is a block diagram representation of the components which are utilized to perform signal processing, data analysis, and communication operations, in accordance with the present invention. As is shown therein, sensors, such as sensors 401, 403, provide analog signals to analog-to-digital converters 405, 407, respectively. The digitized sensor data is passed to data bus 409 for manipulation by controller 411. The data may be stored by controller 411 in nonvolatile memory 417. Program instructions which are executed by controller 411 may be maintained in ROM 419, and called for execution by controller 411 as needed. Controller 411 may comprise a conventional microprocessor which operates on eight or sixteen-bit binary words. Controller 411 may be programmed to merely administer the recordation of sensor data in memory, in the most basic embodiment of the present invention; however, in more elaborate embodiments of the present invention, controller 411 may be utilized to perform analyses of the sensor data in order to detect impending failure of the downhole drill bit and/or to supervise communication of either the processed or unprocessed sensor data to another location within the drillstring or wellbore. The preprogrammed analyses may be maintained in memory in ROM 419, and loaded onto controller 411 in a conventional manner, for execution during drilling operations. In still more elaborate embodiments of the present invention, controller 411 may pass digital data and/or warning signals indicative of impending downhole drill bit failure to input/output devices 413, 415 for communication to either another location within the wellbore or drillstring, or to a surface location. The input/output devices 413, 415 may be also utilized for reading recorded sensor data from nonvolatile memory 417 at the termination of drilling operations for the particular downhole drill bit, in order to facilitate the analysis of the bits performance during drilling operation. Alternatively, a wireline reception device may be lowered within the drillstring during drilling operations to receive data which is transmitted by input/output device 413, 415 in the form of electromagnetic transmissions.

4. EXEMPLARY USES OF RECORDED AND/OR PROCESSED DATA: One possible use of this data is to determine whether the purchaser of the downhole drill bit has operated the downhole drill bit in a responsible manner; that is, in a manner which is consistent with the manufacturer's instruction. This may help resolve conflicts and disputes relating to the performance or failure in performance of the downhole drill bit. It is beneficial for the manufacturer of the downhole drill bit to have evidence of product misuse as a factor which may indicate that the purchaser is responsible for financial loss instead of the manufacturer. Still other uses of the data include the utilization of the data to determine the efficiency and reliability of particular downhole drill bit designs. The manufacturer may utilize the data gathered at the completion of drilling operations of a particular downhole drill bit in order to determine the suitability of the downhole drill bit for that particular drilling operation. Utilizing this data, the downhole drill bit manufacturer may develop more sophisticated, durable, and reliable designs for downhole drill bits. The data may alternatively be utilized to provide a record of the operation of the bit, in order to supplement resistivity and other logs which are developed during drilling operations, in a conventional manner. Often, the service companies which provide measurement-while-drilling operations are hard pressed to explain irregularities in the logging data. Having a complete record of the operating conditions of the downhole drill bit during the drilling operations in question may allow the provider of measurement-while-drilling services to explain irregularities in the log data. Many other conventional or novel uses may be made of the recorded data which either improve or enhance drilling operations, the control over drilling operations, or the manufacture, design and use of drilling tools.

Figure 5:
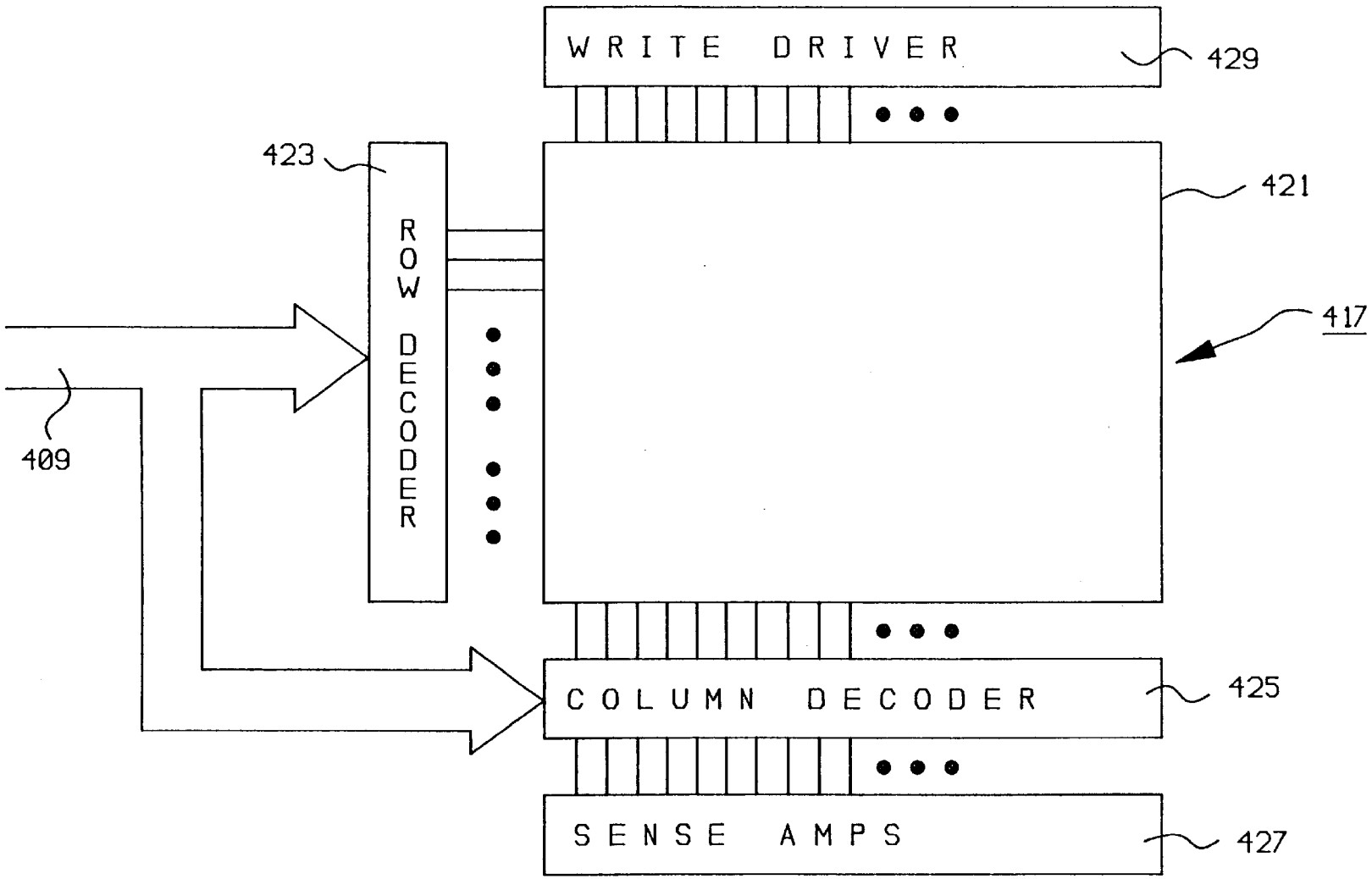
FIG. 5 is a block diagram depiction of electronic memory utilized in the improved downhole drill bit to record data.

5. EXEMPLARY ELECTRONIC MEMORY: FIG. 5 is a block diagram depiction of electronic memory utilized in the improved downhole drill bit of the present invention to record data. Nonvolatile memory 417 includes a memory array 421. As is known in the art, memory array 421 is addressed by row decoder 423 and column decoder 425. Row decoder 423 selects a row of memory array 417 in response to a portion of an address received from the address bus 409. The remaining lines of the address bus 409 are connected to column decoder 425, and used to select a subset of columns from the memory array 417. Sense amplifiers 427 are connected to column decoder 425, and sense the data provided by the cells in memory array 421. The sense amps provide data read from the array 421 to an output (not shown), which can include latches as is well known in the art. Write driver 429 is provided to store data into selected locations within the memory array 421 in response to a write control signal.

The cells in the array 421 of nonvolatile memory 417 can be any of a number of different types of cells known in the art to provide nonvolatile memory. For example, EEPROM memories are well known in the art, and provide a reliable, erasable nonvolatile memory suitable for use in applications such as recording of data in wellbore environments. Alternatively, the cells of memory array 421 can be other designs known in the art, such as SRAM memory arrays utilized with battery back-up power sources.

6. SELECTION OF SENSORS: In accordance with the present invention, one or more operating condition sensors are carried by the production downhole drill bit, and are utilized to detect a particular operating condition. The preferred technique for determining which particular sensors are included in the production downhole drill bits will now be described in detail with reference to FIG. 7 wherein the process begins at step 171.

In accordance with the present invention, as shown in step 173, a plurality of operating condition sensors are placed on at least one test downhole drill bit. Preferably, a large number of test downhole drill bits are examined. The test downhole drill bits are then subjected to at least one simulated drilling operation, and data is recorded with respect to time with the plurality of operating condition sensors, in accordance with step 175. The data is then examined to identify impending downhole drill bit failure indicators, in accordance with step 177. Then, selected ones of the plurality of operating condition sensors are selected for placement in production downhole drill bits, in accordance with step 179. Optionally, in each production downhole drill bit a monitoring system may be provided for comparing data obtained during drilling operations with particular ones of the impending downhole drill bit failure indicators, in accordance with step 181. In one particular embodiment, in accordance with step 185, drilling operations are then conducted with the production downhole drill bit, and the monitoring system is utilized to identify impending downhole drill bit failure. Finally, and optionally, in accordance with steps 187 and 189 the data is telemetered uphole during drilling operations to provide an indication of impending downhole drill bit failure utilizing any one of a number of known, prior art or novel data communications systems. Of course, in accordance with step 191, drilling operations may be adjusted from the surface location (including, but not limited to, the weight on bit, the rate of rotation of the drillstring, and the mud weight and pump velocity) in order to optimize drilling operations.

The types of sensors utilized during simulated drilling operations are set forth in block diagram form in FIG. 6, and will now be discussed in detail. Bit leg 80 may be equipped with strains sensors 125 in order to measure axial strain, shear strain, and bending strain. Bit leg 81 may likewise be equipped with strain sensors 127 in order to measure axial strain, shear strain, and bending strain. Bit leg 82 is also equipped with strain sensors 129 for measuring axial strain, shear strain, and bending strain.

Journal bearing 96 may be equipped with temperature sensors 131 in order to measure the temperature at the counterface of the cone mouth, center, thrust face, and shirttail of the cantilevered journal bearing 96; likewise, journal bearing 97 may be equipped with temperature sensors 133 for measuring the temperature at the counterface of the cone mouth, thrust face, and shirttail of the cantilevered journal bearing 97; journal bearing 98 may be equipped with temperature sensors 135 at the counterface of the cone mouth, thrust face, and shirttail of cantilevered journal bearing 98 in order to measure temperature at those locations. In alternative embodiments, different types of bearings may be utilized, such as roller bearings. Temperature sensors would be appropriately located therein.

Lubrication system may be equipped with reservoir pressure sensor 137 and pressure at seal sensor 139 which together are utilized to develop a measurement of the differential pressure across the seal of journal bearing 96. Likewise, lubrication system 85 may be equipped with reservoir pressure sensor 141 and pressure at seal sensor 143 which develop a measurement of the pressure differential across the seal at journal bearing 97. The same is likewise true for lubrication system 86 which may be equipped with reservoir pressure sensor 145 and pressure at seal sensor 147 which develop a measurement of the pressure differential across the seal of journal bearing 98.

Additionally, acceleration sensors 149 may be provided on bit body 55 in order to measure the x-axis, y-axis, and z-axis components of acceleration experienced by bit body 55.

Finally, ambient pressure sensor 151 and ambient temperature sensor 153 may be provided to monitor the ambient pressure and temperature of wellbore 1. Additional sensors may be provided in order to obtain and record data pertaining to the wellbore and surrounding formation, such as, for example and without limitation, sensors which provide an indication about one or more electrical or mechanical properties of the wellbore or surrounding formation.

The overall technique for establishing an improved downhole drill bit with a monitoring system was described above in connection with FIG. 7. When the test bits are subjected to simulated drilling operations, in accordance with step 175 of FIG. 7, and data from the operating condition sensors is recorded. Utilizing the particular sensors depicted in block diagram in FIG. 6, information relating to the strain detected at bit legs 80, 81, and 82 will be recorded. Additionally, information relating to the temperature detected at journal bearings 96, 97, and 98 will also be recorded. Furthermore, information pertaining to the pressure within lubrication systems 84, 85, 86 will be recorded. Information pertaining to the acceleration of bit body 55 will be recorded. Finally, ambient temperature and pressure within the simulated wellbore will be recorded.

7. EXEMPLARY FAILURE INDICATORS: The collected data may be examined to identify indicators for impending downhole drill bit failure. Such indicators include, but are not limited to, some of the following:

(1) a seal failure in lubrication systems 84, 85, or 86 will result in a loss of pressure of the lubricant contained within the reservoir; a loss of pressure at the interface between the cantilevered journal bearing and the rolling cone cutter likewise indicates a seal failure;

(2) an elevation of the temperature as sensed at the counterface of the cone mouth, center, thrust face, and shirttail of journal bearings 96, 97, or 98 likewise indicates a failure of the lubrication system, but may also indicate the occurrence of drilling inefficiencies such as bit balling or drilling motor inefficiencies or malfunctions;

(3) excessive axial, shear, or bending strain as detected at bit legs 80, 81, or 82 will indicate impending bit failure, and in particular will indicate physical damage to the rolling cone cutters;

(4) irregular acceleration of the bit body indicates a cutter malfunction.

The simulated drilling operations are preferably conducted using a test rig, which allows the operator to strictly control all of the pertinent factors relating to the drilling operation, such as weight on bit, torque, rotation rate, bending loads applied to the string, mud weights, temperature, pressure, and rate of penetration. The test bits are actuated under a variety of drilling and wellbore conditions and are operated until failure occurs. The recorded data can be utilized to establish thresholds which indicate impending bit failure during actual drilling operations. For a particular downhole drill bit type, the data is assessed to determine which particular sensor or sensors will provide the earliest and clearest indication of impending bit failure. Those sensors which do not provide an early and clear indication of failure will be discarded from further consideration. Only those sensors which provide such a clear and early indication of impending failure will be utilized in production downhole drill bits. Step 177 of FIG. 7 corresponds to the step of identifying impending downhole drill bit failure indicators from the data amassed during simulated drilling operations.

Field testing may be conducted to supplement the data obtained during simulated drilling operations, and the particular operating condition sensors which are eventually placed in production downhole drill bits may be selected based upon a combination of the data obtained during simulated drilling operations and the data obtained during field testing. In either event, in accordance with step 179 of FIG. 7, particular ones of the operating condition sensors are included in a particular type of production downhole drill bit. Then, a monitoring system is included in the production downhole drill bit, and is defined or programmed to continuously compare sensor data with a pre-established threshold for each sensor.

For example, and without limitation, the following types of thresholds can be established:

(1) maximum and minimum axial, shear, and/or bending strain may be set for bit legs 80, 81, or 82;

(2) maximum temperature thresholds may be established from the simulated drilling operations for journal bearings 96, 97, or 98;

(3) minimum pressure levels for the reservoir and/or seal interface may be established for lubrication systems 84, 85, or 86;

(4) maximum (x-axis, y-axis, and/or z-axis) acceleration may be established for bit body 55.

Figure 6:
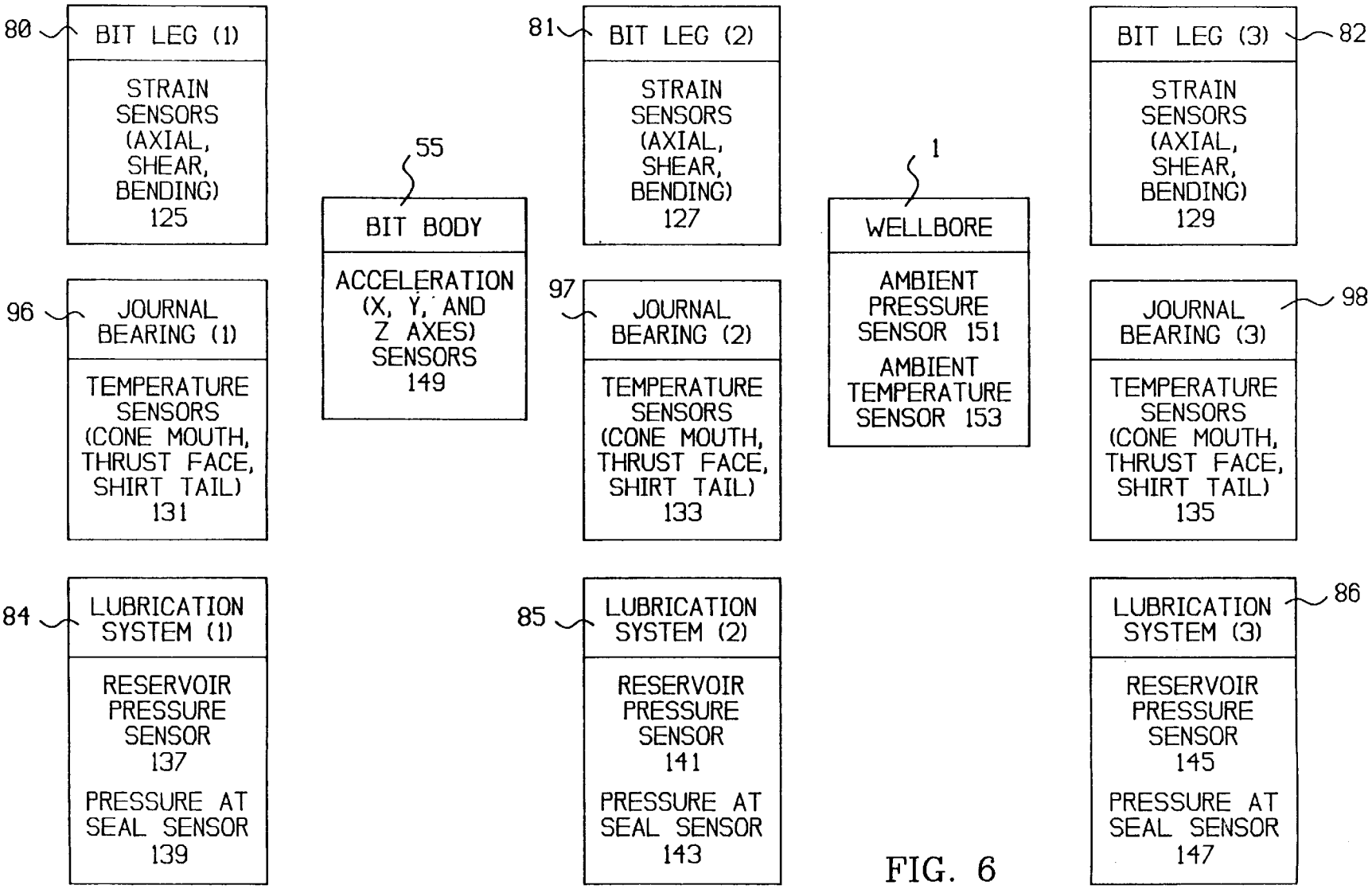
FIG. 6 is a block diagram depiction of particular types of operating condition sensors which may be utilized in the improved downhole drill bit of the present invention.

In particular embodiments, the temperature thresholds set for journal bearings 96, 97, or 98, and the pressure thresholds established for lubrication systems 84, 85, 86 may be relative figures which are established with respect to ambient pressure and ambient temperature in the wellbore during drilling operations as detected by ambient pressure sensor 151 and temperature sensor 153 (both of FIG. 6). Such thresholds may be established by providing program instructions to a controller which is resident within improved downhole drill bit 26, or by providing voltage and current thresholds for electronic circuits provided to continuously or intermittently compare data sensed in real time during drilling operations with pre-established thresholds for particular sensors which have been included in the production downhole drill bits. The step of programming the monitoring system is identified in the flowchart of FIG. 7 as steps 181, 183.

Figure 7A:
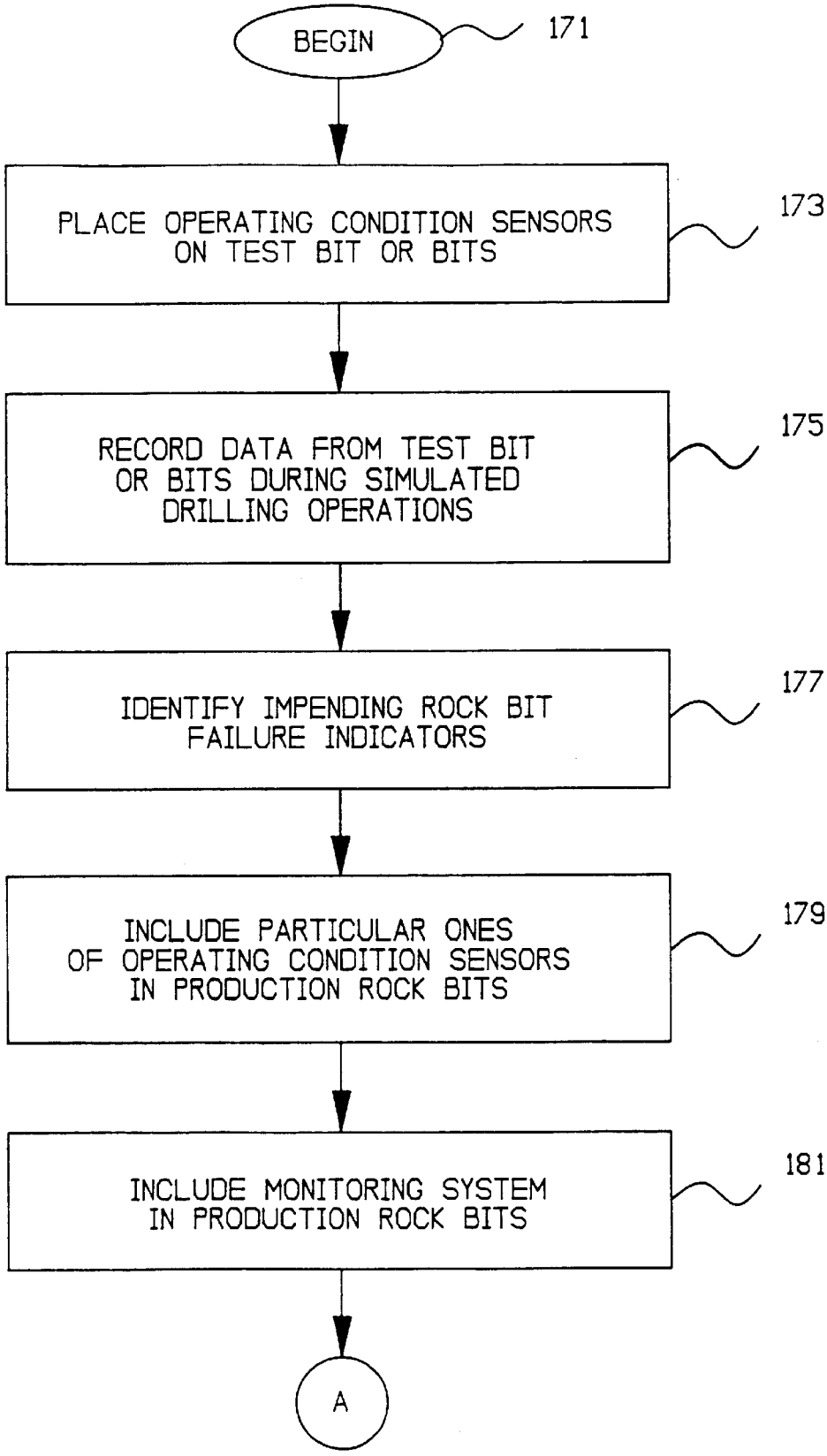
FIG. 7 is a flowchart representation of the method steps utilized in constructing an improved downhole drill bit in accordance with the present invention.
Figure 7B:
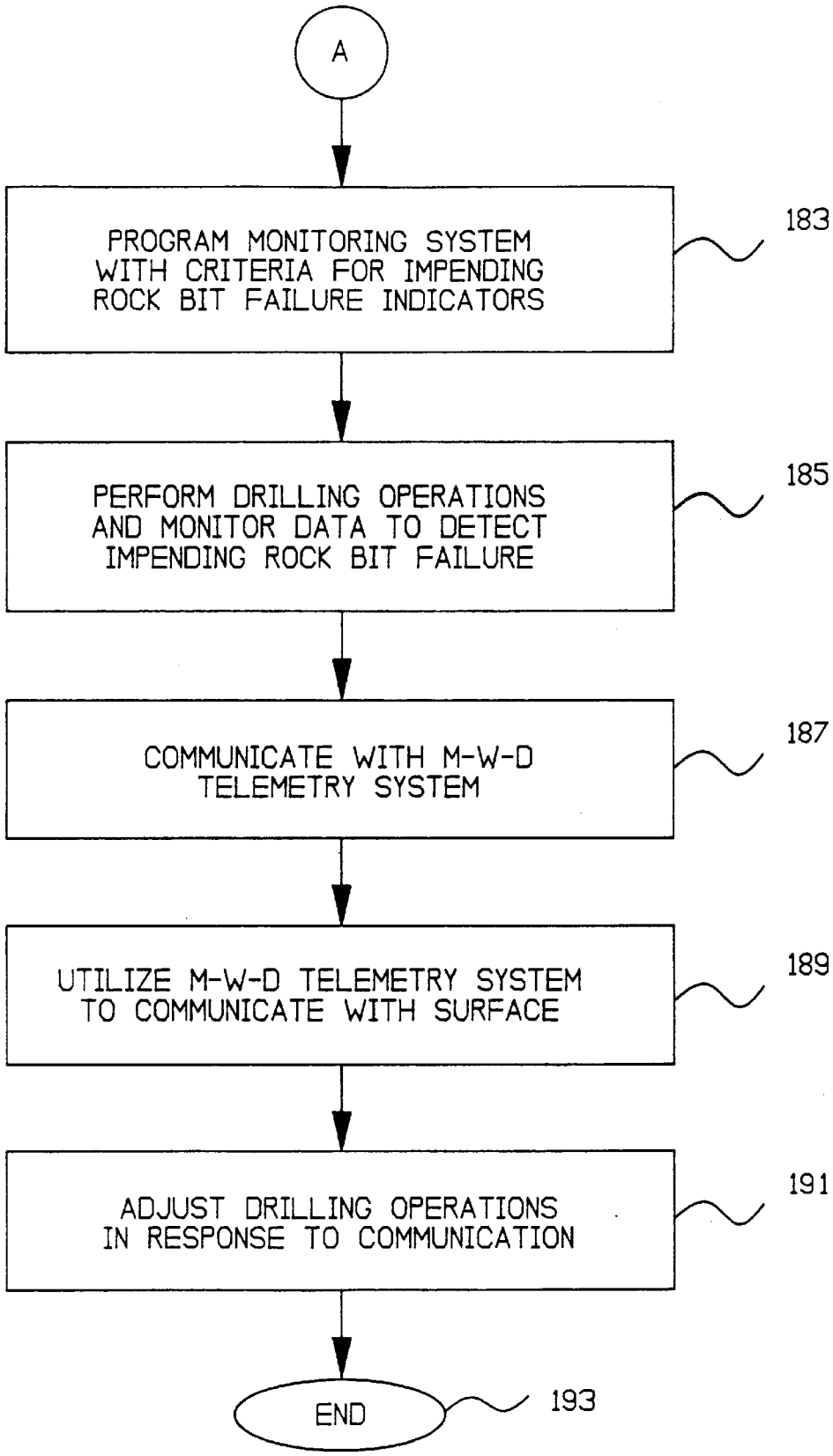

Then, in accordance with step 185 of FIG. 7, drilling operations are performed and data is monitored to detect impending downhole drill bit failure by continuously comparing data measurements with pre-established and predefined thresholds (either minimum, maximum, or minimum and maximum thresholds or patterns in the measurements). Then, in accordance with step 187 of FIG. 7, information is communicated to a data communication system such as a measurement-while-drilling telemetry system. Next, in accordance with step 189 of FIG. 7, the measurement-while-drilling telemetry system is utilized to communicate data to the surface. The drilling operator monitors this data and then adjusts drilling operations in response to such communication, in accordance with step 191 of FIG. 7.

The potential alarm conditions may be hierarchically arranged in order of seriousness, in order to allow the drilling operator to intelligently respond to potential alarm conditions. For example, loss of pressure within lubrication systems 84, 85, or 86 may define the most severe alarm condition. A secondary condition may be an elevation in temperature at journal bearings 96, 97, 98. Finally, an elevation in strain in bit legs 80, 81, 82 may define the next most severe alarm condition. Bit body acceleration may define an alarm condition which is relatively unimportant in comparison to the others. In one embodiment of the present invention, different identifiable alarm conditions may be communicated to the surface to allow the operator to exercise independent judgement in determining how to adjust drilling operations. In alternative embodiments, the alarm conditions may be combined to provide a composite alarm condition which is composed of the various available alarm conditions. For example, an arabic number between 1 and 10 may be communicated to the surface with 1 identifying a relatively low level of alarm, and 10 identifying a relatively high level of alarm. The various alarm components which are summed to provide this single numerical indication of alarm conditions may be weighted in accordance with relative importance. Under this particular embodiment, a loss of pressure within lubrication systems 84, 85, or 86 may carry a weight two or three times that of other alarm conditions in order to weight the composite indicator in a manner which emphasizes those alarm conditions which are deemed to be more important than other alarm conditions.

The types of responses available to the operator include an adjustment in the weight on bit, the torque, the rotation rate applied to the drillstring, and the weight of the drilling fluid and the rate at which it is pumped into the drillstring. The operator may alter the weight of the drilling fluid by including or excluding particular drilling additives to the drilling mud. Finally, the operator may respond by pulling the string and replacing the bit. A variety of other conventional operator options are available. After the operator performs the particular adjustments, the process ends in accordance with step 193.

8. EXEMPLARY SENSOR PLACEMENT AND FAILURE THRESHOLD DETERMINATION: FIGS. 8A through 8H depict sensor placement in the improved downhole drill bit 26 of the present invention with corresponding graphical presentations of exemplary thresholds which may be established with respect to each particular operating condition being monitored by the particular sensor.

Figure 8B:
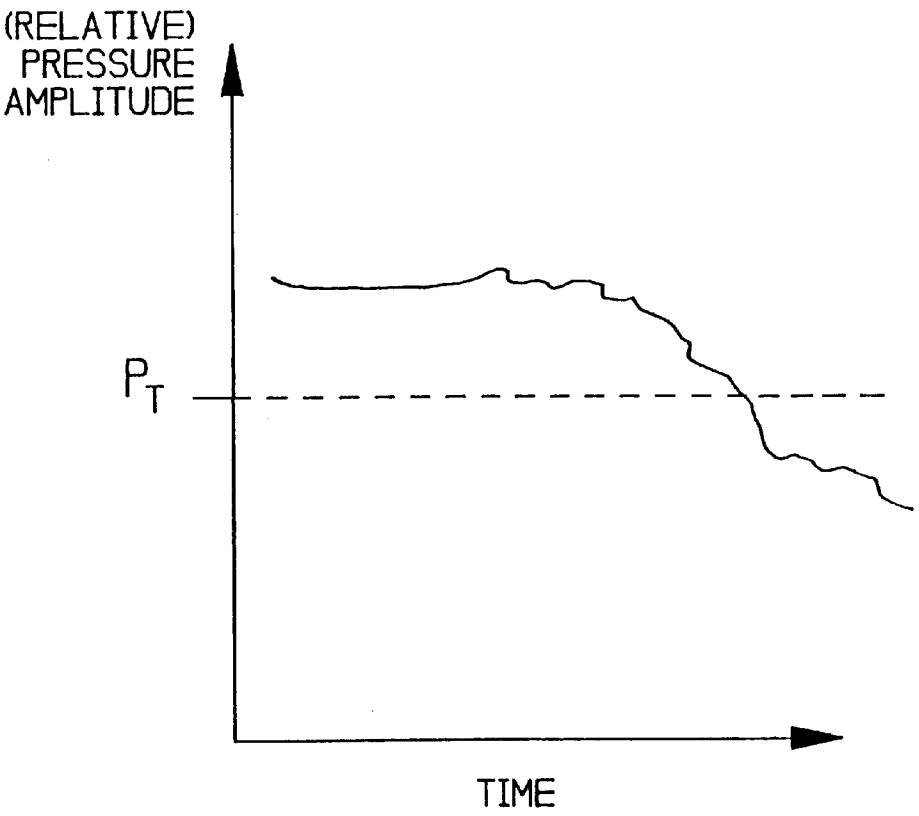
FIGS. 8A through 8H depict details of sensor placement on the improved downhole drill bit of the present invention, along with graphical representations of the types of data indicative of impending downhole drill bit failure.
Figure 8A:
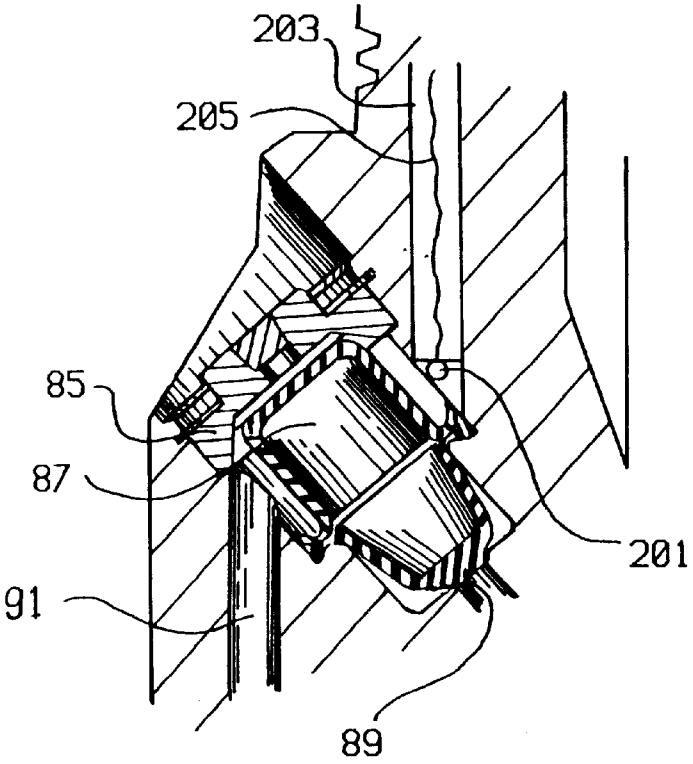

FIGS. 8A and 8B relate to the monitoring of pressure in lubrication systems of the improved downhole drill bit 26. As is shown, pressure sensor 201 communicates with compensator 85 and provides an electrical signal through conductors 205 which provides an indication of the amplitude of the pressure within compensator 85. Conductor path 203 is provided through downhole drill bit 26 to allow the conductor to pass to the monitoring system carried by downhole drill bit 26. This measurement may be compared to ambient pressure to develop a measurement of the pressure differential across the seal. FIG. 8B is a graphical representation of the diminishment of pressure amplitude with respect to time as the seal integrity of compensator 85 is impaired. The pressure threshold $P_T$ is established. Once the monitoring system determines that the pressure within compensator 85 falls below this pressure threshold, an alarm condition is determined to exist.

Figure 8D:
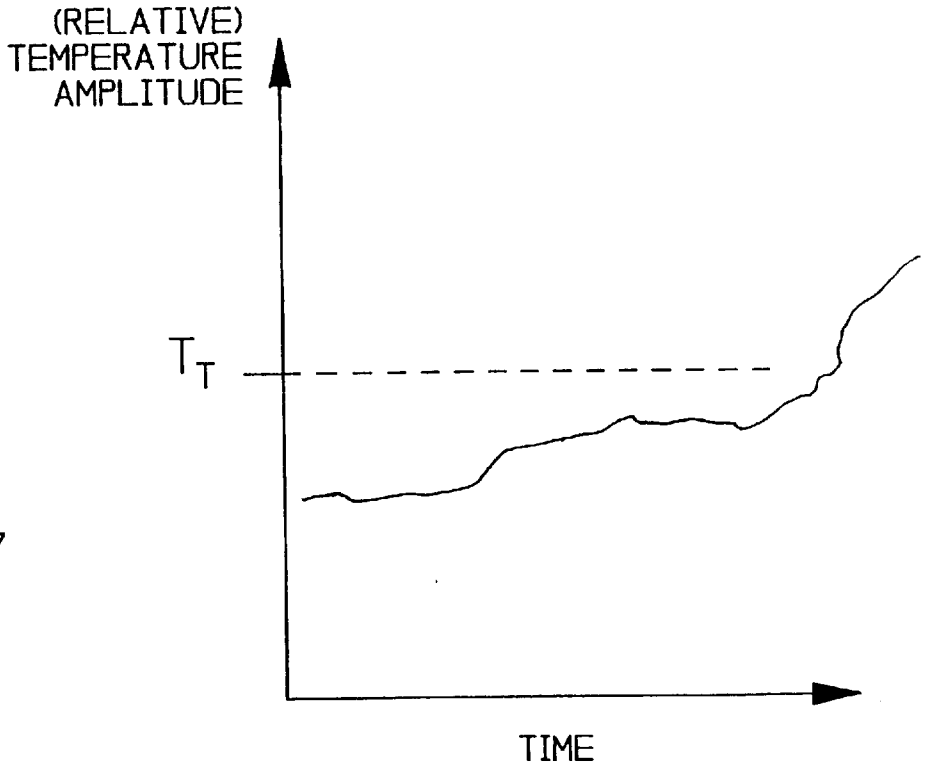
Figure 8C:
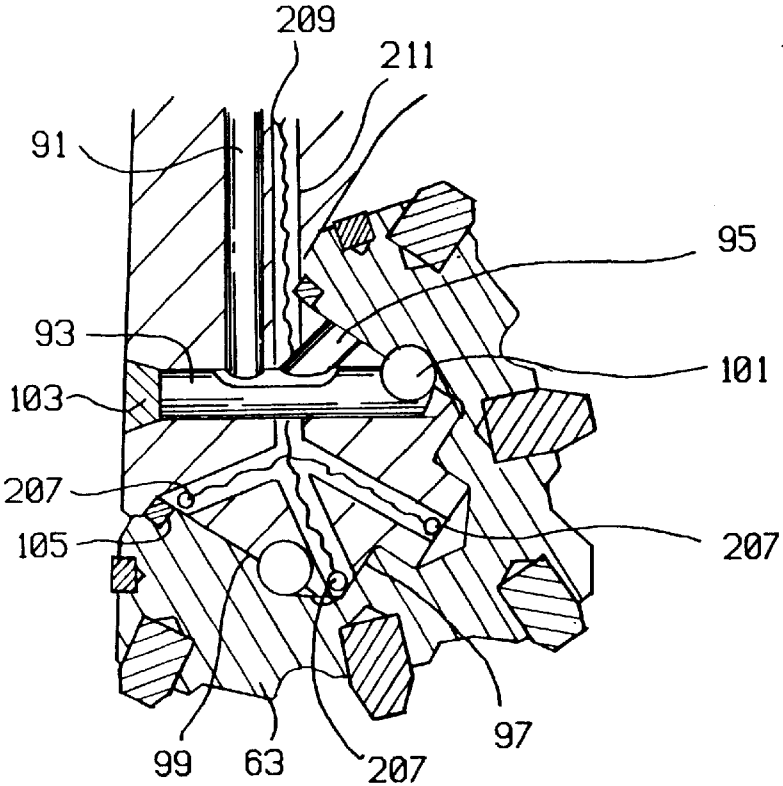

FIG. 8C depicts the placement of temperature sensors 207 relative to cantilevered journal bearing 97. Temperature sensors 207 are located at the counterface of the cone mouth, shirttail, center, and thrust face of journal bearing 97, and communicate electrical signals via conductor 209 to the monitoring system to provide a measure of either the absolute or relative temperature amplitude. When relative temperature amplitude is provided, this temperature is computed with respect to the ambient temperature of the wellbore. Conductor path 211 is machined within downhole drill bit 26 to allow conductor 209 to pass to the monitoring system. FIG. 8D graphically depicts the elevation of temperature amplitude with respect to time as the lubrication system for journal bearing 97 fails. A relative temperature threshold $T_T$ is established to define the alarm condition. Temperatures which rise above the sum of the temperature threshold $T_T$ and the bottom hole temperature trigger an alarm condition.

Figure 8F:
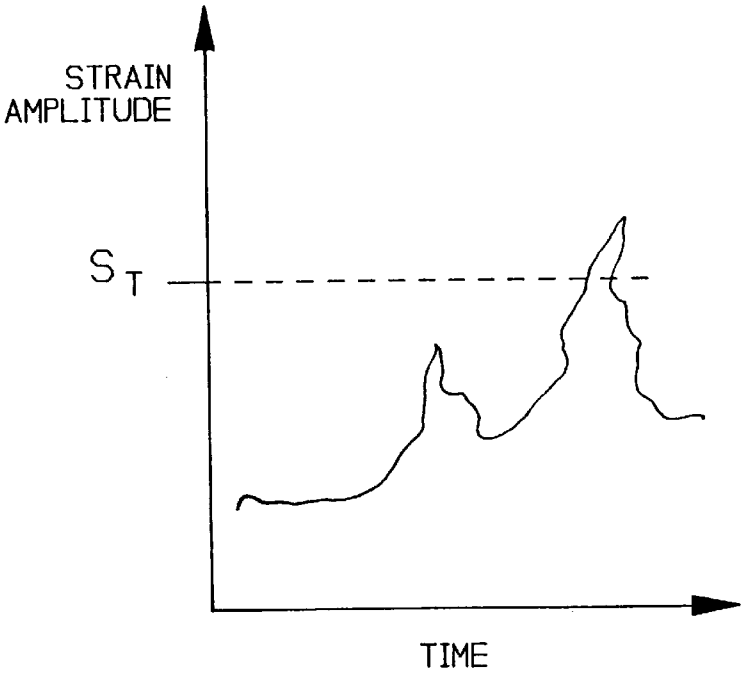
Figure 8E:
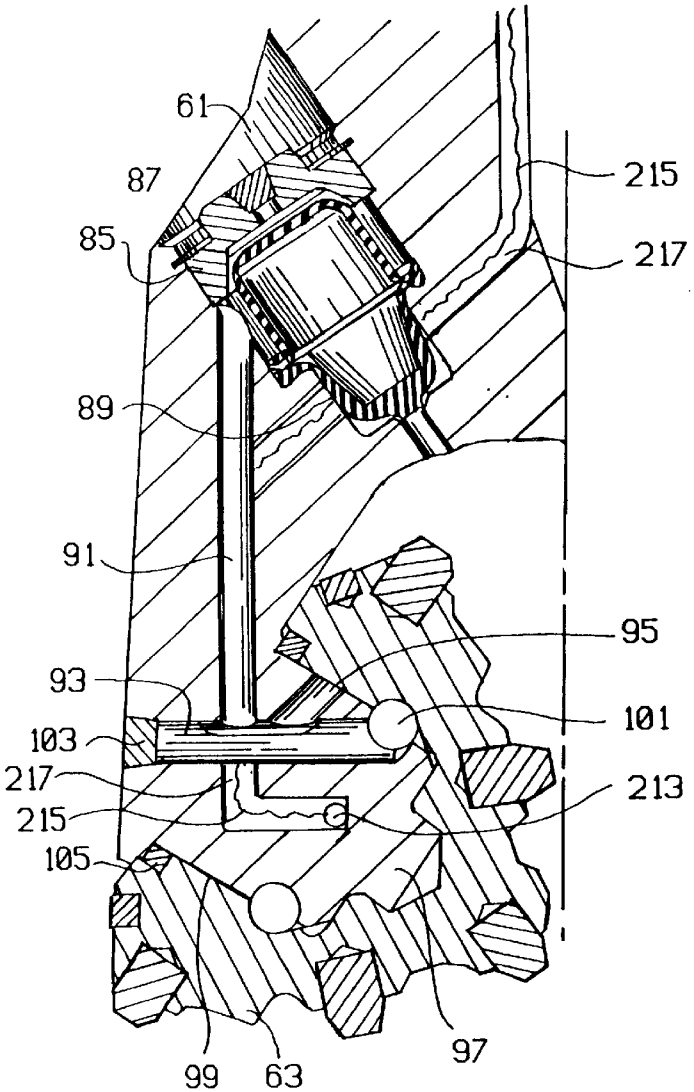

FIG. 8E depicts the location of strain sensors 213 relative to downhole drill bit 26. Strain sensors 213 communicate at least one signal which is indicative of at least one of axial strain, shear strain, and/or bending strain via conductors 215. These signals are provided to a monitoring system. Pathway 217 (which is shown in simplified form to facilitate discussion, but which is shown in the preferred location elsewhere in this application) is defined within downhole drill bit 26 to allow for conductors 215 to pass to the monitoring system. The most likely location of the strain sensors 213 to optimize sensor discrimination is region 88 of FIG. 8E, but this can be determined experimentally in accordance with the present invention. FIG. 8F is graphical representation of strain amplitude with respect to time for a particular one of axial strain, shear strain, and/or bending strain. As is shown, a strain threshold $S_T$ may be established. Strain which exceeds the strain threshold triggers an alarm condition.

Figure 8H:
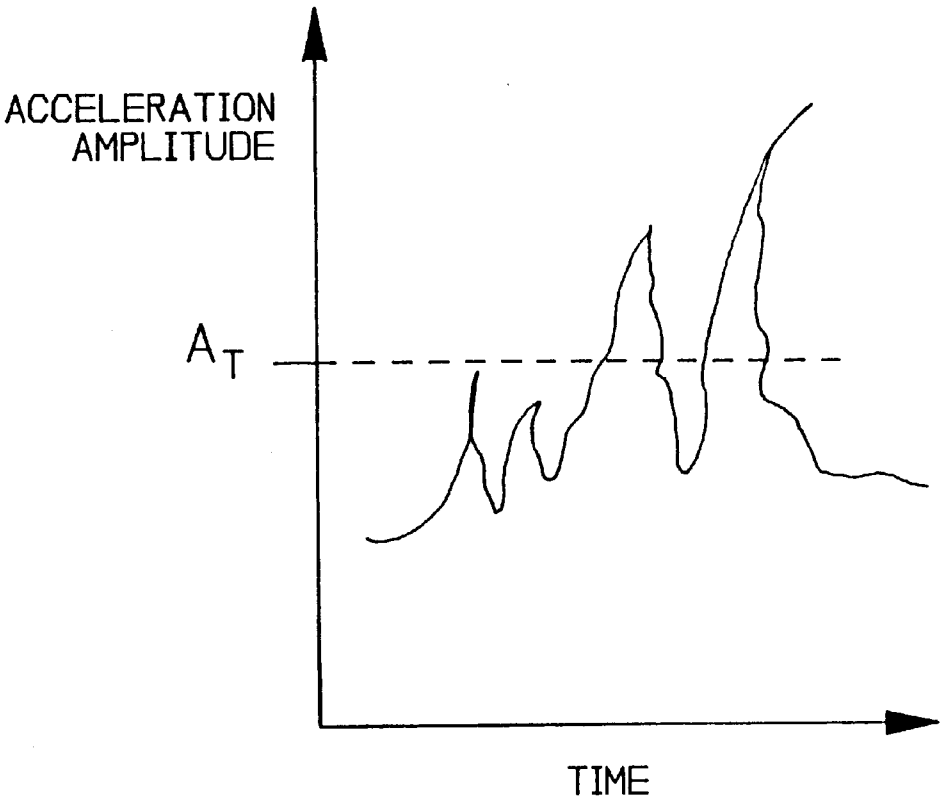
Figure 8G:
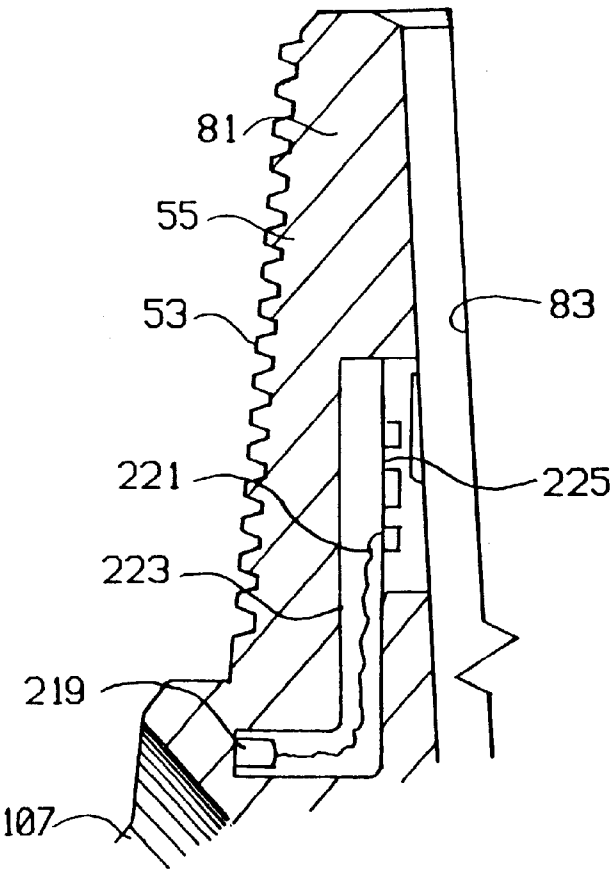

FIG. 8G provides a representation of acceleration sensors 219 which provide an indication of the x-axis, y-axis, and/or z-axis acceleration of bit body 55. Conductors 221 pass through passage 223 to monitoring system 225. FIG. 8H provides a graphical representation of the acceleration amplitude with respect to time. An acceleration threshold $A_T$ may be established to define an alarm condition. When a particular acceleration exceeds the amplitude threshold, an alarm condition is determined to exist.

While not depicted, the improved downhole drill bit 26 of the present invention may further include a pressure sensor for detecting ambient wellbore pressure, and a temperature sensor for detecting ambient wellbore temperatures. Data from such sensors allows for the calculation of a relative pressure threshold or a relative temperature threshold.

Figure 9:
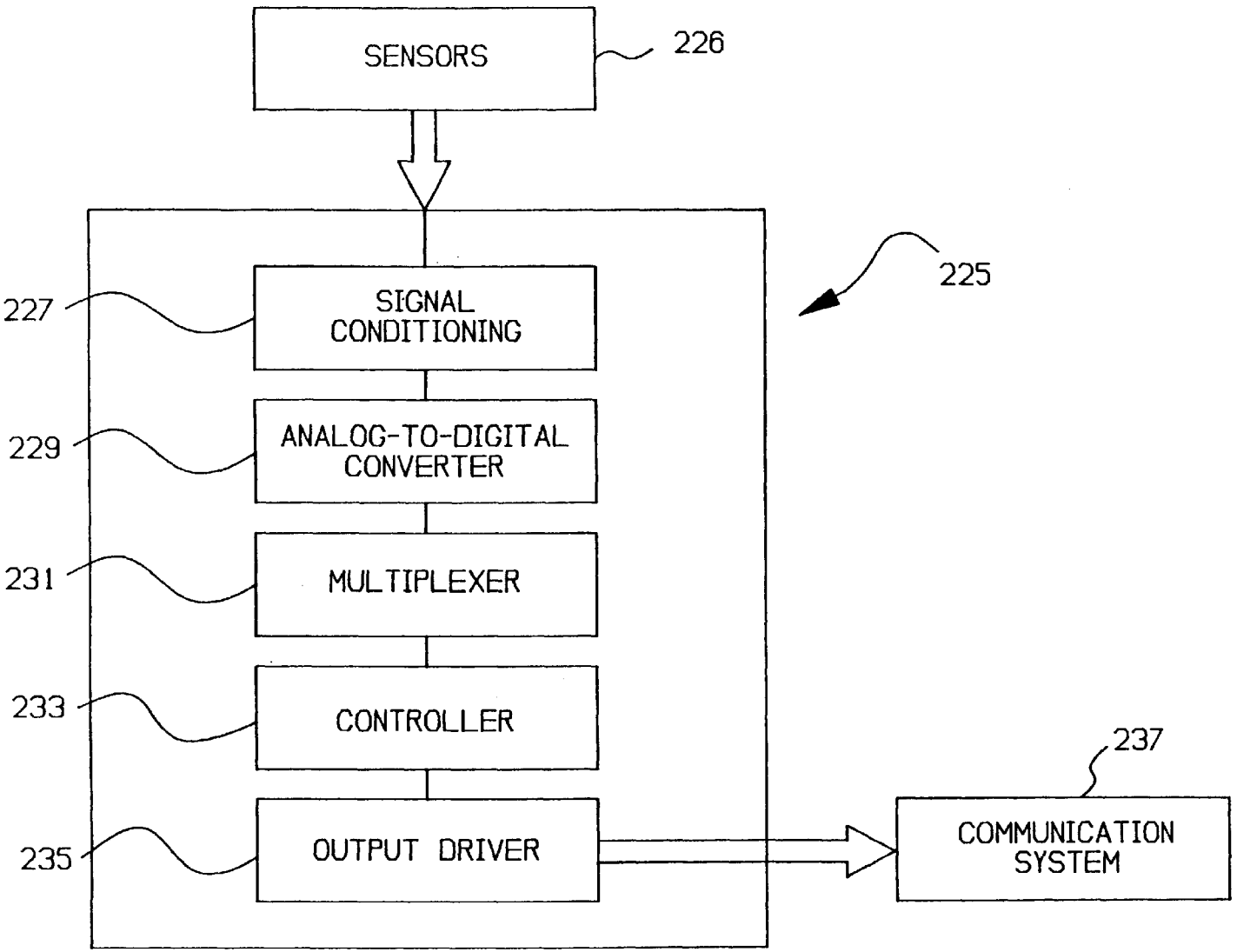
FIG. 9 is a block diagram representation of the monitoring system utilized in the improved downhole drill bit of the present invention.

9. OVERVIEW OF OPTIONAL MONITORING SYSTEM: FIG. 9 is a block diagram depiction of monitoring system 225 which is optionally carried by improved downhole drill bit 26. Monitoring system 225 receives real-time data from sensors 226, and subjects the analog signals to signal conditioning such as filtering and amplification at signal conditioning block 227. Then, monitoring system 225 subjects the analog signal to an analog-to-digital conversion at analog-to-digital converter 229. The digital signal is then multiplexed at multiplexer 231 and routed as input to controller 233. The controller continuously compares the amplitudes of the data signals (and, alternatively, the rates of change) to pre-established thresholds which are recorded in memory. Controller 233 provides an output through output driver 235 which provides a signal to communication system 237. In one preferred embodiment of the present invention, downhole drill bit 26 includes a communication system which is suited for communicating of either one or both of the raw data or one or more warning signals to a nearby subassembly in the drill collar. Communication system 237 would then be utilized to transmit either the raw data or warning signals a short distance through either electrical signals, electromagnetic signals, or acoustic signals. One available technique for communicating data signals to an adjoining subassembly in the drill collar is depicted, described, and claimed in U.S. Pat. No. 5,129,471 which issued on Jul. 14, 1992 to Howard, which is entitled "Wellbore Tool With Hall Effect Coupling", which is incorporated herein by reference as if fully set forth.

In accordance with the present invention, the monitoring system includes a predefined amount of memory which can be utilized for recording continuously or intermittently the operating condition sensor data. This data may be communicated directly to an adjoining tubular subassembly, or a composite failure indication signal may be communicated to an adjoining subassembly. In either event, substantially more data may be sampled and recorded than is communicated to the adjoining subassemblies for eventual communication to the surface through conventional mud pulse telemetry technology. It is useful to maintain this data in memory to allow review of the more detailed readings after the bit is retrieved from the wellbore. This information can be used by the operator to explain abnormal logs obtained during drilling operations. Additionally, it can be used to help the well operator select particular bits for future runs in the particular well.

Figure 10:
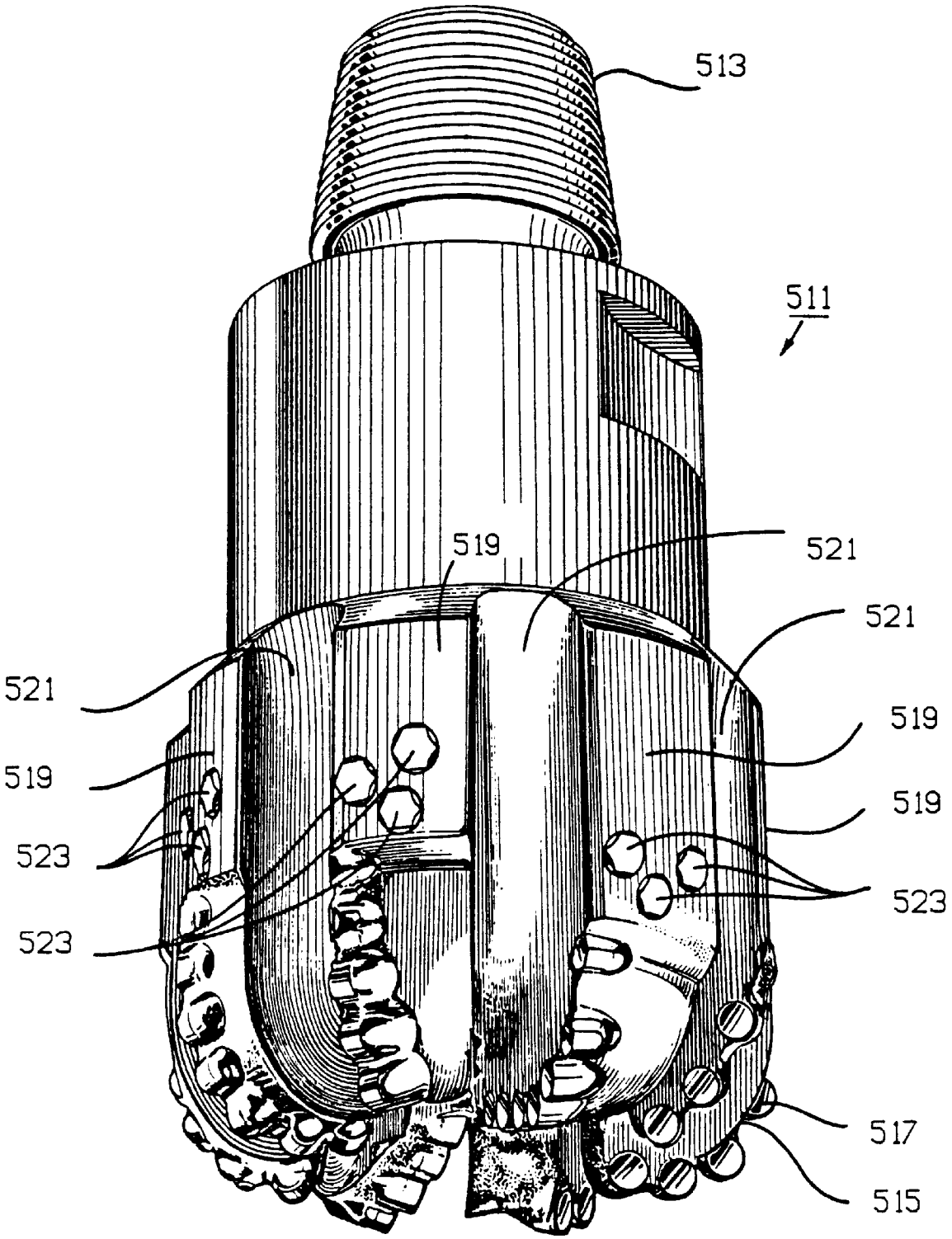
FIG. 10 is a perspective view of a fixed-cutter downhole drill bit.

10. UTILIZATION OF THE PRESENT INVENTION IN FIXED CUTTER DRILL BITS: The present invention may also be employed with fixed-cutter downhole drill bits. FIG. 10 is a perspective view of an earth-boring bit 511 of the fixed-cutter variety embodying the present invention. Bit 511 is threaded 513 at its upper extent for connection into a drillstring. A cutting end 515 at a generally opposite end of bit 511 is provided with a plurality of natural or synthetic diamond or hard metal cutters 517, arranged about cutting end 515 to effect efficient disintegration of formation material as bit 511 is rotated in a borehole. A gage surface 519 extends upwardly from cutting end 515 and is proximal to and contacts the sidewall of the borehole during drilling operation of bit 511. A plurality of channels or grooves 521 extend from cutting end 515 through gage surface 519 to provide a clearance area for formation and removal of chips formed by cutters 517.

A plurality of gage inserts 523 are provided on gage surface 519 of bit 511. Active, shear cutting gage inserts 523 on gage surface 519 of bit 511 provide the ability to actively shear formation material at the sidewall of the borehole to provide improved gage-holding ability in earth-boring bits of the fixed cutter variety. Bit 511 is illustrated as a PDC ("polycrystalline diamond compact") bit, but inserts 523 are equally useful in other fixed cutter or drag bits that include a gage surface for engagement with the sidewall of the borehole.

Figure 11:
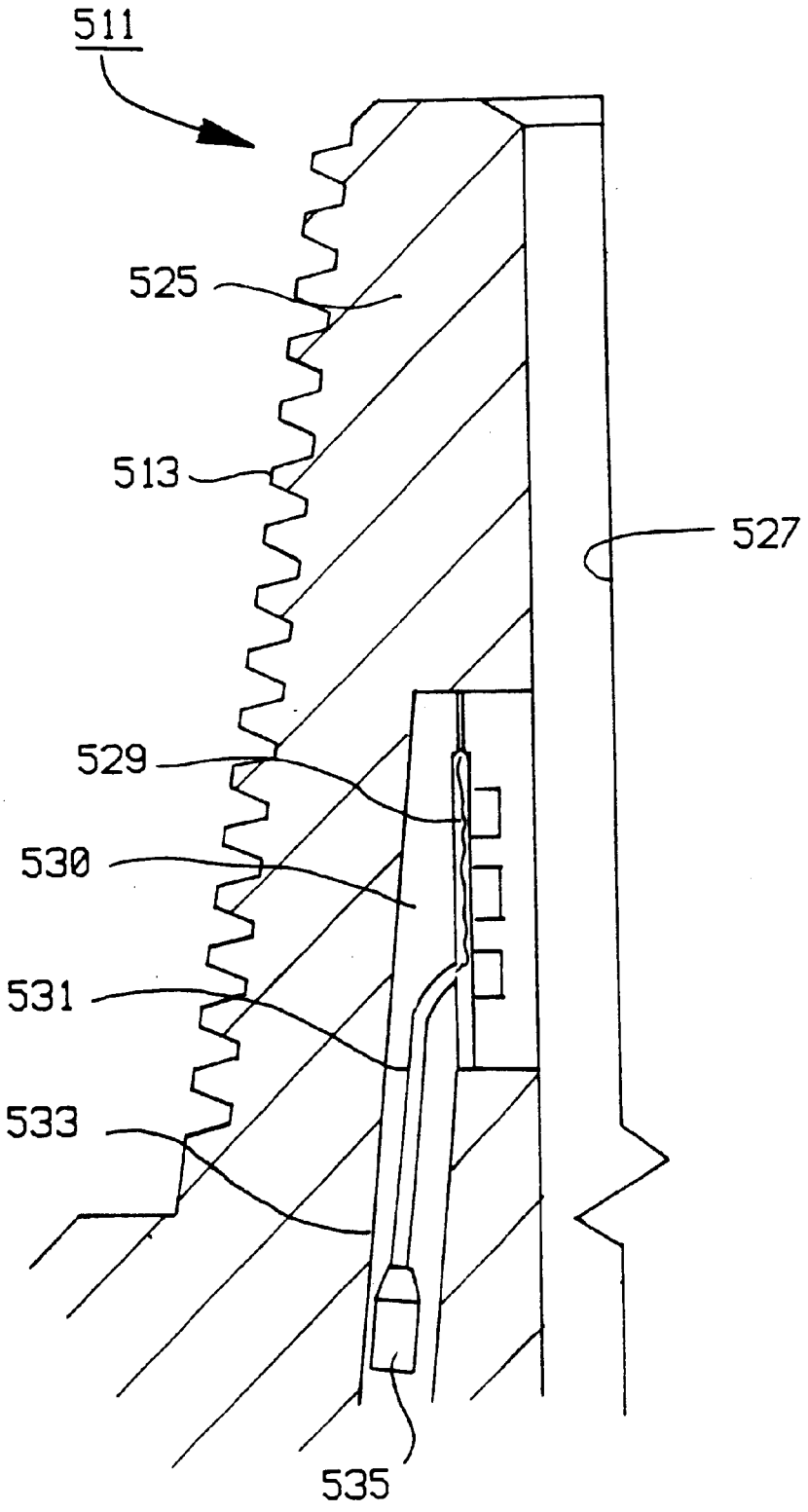
FIG. 11 is a fragmentary longitudinal section view of the fixed-cutter downhole drill bit of FIG. 10.

FIG. 11 is a fragmentary longitudinal section view of fixed-cutter downhole drill bit 511 of FIG. 10, with threads 513 and a portion of bit body 525 depicted. As is shown, central bore 527 passes centrally through fixed-cutter downhole drill bit 511. As is shown, monitoring system 529 is disposed in cavity 530. A conductor 531 extends downward through cavity 533 to accelerometers 535 which are provided to continuously measure the x-axis, y-axis, and/or z-axis components of acceleration of bit body 525. Accelerometers 535 provide a continuous measure of the acceleration, and monitoring system 529 continuously compares the acceleration to predefined acceleration thresholds which have been predetermined to indicate impending bit failure. For fixed-cutter downhole drill bits, whirl and stick-and-slip movement of the bit places extraordinary loads on the bit body and the PDC cutters, which may cause bit failure. The excessive loads cause compacts to become disengaged from the bit body, causing problems similar to those encountered when the rolling cones of a downhole drill bit are lost. Other problems associated with fixed cutter drill bits include bit "wobble" and bit "walking", which are undesirable operating conditions.

Fixed cutter drill bits differ from rotary cone rock bits in that rather complicated steering and drive subassemblies (such as a Moineau principle mud motor) are commonly closely associated with fixed cutter drill bits, and are utilized to provide for more precise and efficient drilling, and are especially useful in a directional drilling operation.

In such configurations, it may be advantageous to locate the memory and processing circuit components in a location which is proximate to the fixed cutter drill bit, but not actually in the drill bit itself. In these instances, a hardware communication system may be adequate for passing sensor data to a location within the drilling assembly for recordation in memory and optional processing operations.

Figure 12:
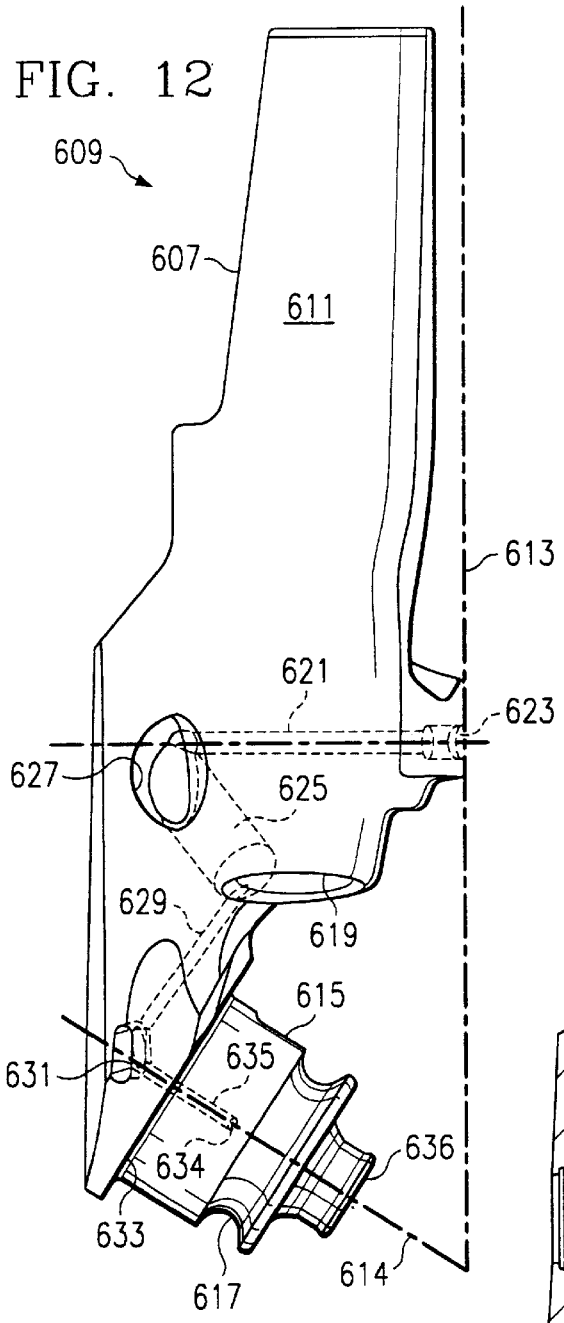
FIG. 12 is a partial longitudinal section view of a bit head constructed in accordance with the present invention.

11. OPTIMIZING TEMPERATURE SENSOR DISCRIMINATION: In the present invention, an improved drill bit is provided which optimizes temperature sensor discrimination. This feature will be described with reference to FIGS. 12 through 14. FIG. 12 depicts a longitudinal section view of bit head 611 of improved drill bit 609 shown relative to a centerline 613 of the improved drill bit 609. In a tri-cone rock bit, the bit body will be composed of three bit heads which are welded together. In order to enhance the clarity of this description, only a single bit head 611 is depicted in FIG. 12.

When the bit head are welded together, an external threaded coupling is formed at the upper portion 607 of the bit heads of improved drill bit 609. The manufacturing process utilized in the present invention to construct the improved drill bit is similar in some respects to the conventional manufacturing process, but is dissimilar in other respects to the conventional manufacturing process. In accordance with the present invention, the steps of the present invention utilized in forging bit head 611 are the conventional forging steps. However, the machining and assembly steps differ from the state-of-the-art as will be described herein.

As is shown in FIG. 12, bit head 611 includes at its lower end head bearing 615 with bearing race 617 formed therein. Together, head bearing 615 and bearing race 617 are adapted for carrying a rolling cone cutter, and allowing rotary motion during drilling operations of the rolling cone cutter relative to head bearing 615 as is conventional. Furthermore, bit head 611 is provided with a bit nozzle 619 which is adapted for receiving drilling fluid from the drilling string and jetting the drilling fluid onto the cutting structure to cool the bit and to clean the bit.

Figure 21:
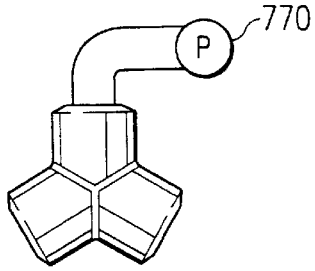
FIG. 21 is a pictorial representation of the operations performed for testing the seal integrity of the cavities of the improved bit of the present invention, and for potting the cavities.

In accordance with the preferred embodiment of the manufacturing process of the present invention, four holes are machined into bit head 611. These holes are not found in the prior art. These holes are depicted in phantom view in FIG. 12 and include a tri-tube wire 621, a service bay 625, a wire way 629, and a temperature sensor well 635. The tri-tube wire 621 is substantially orthogonal to centerline 613. The tri-tube wire 621 is slightly enlarged at opening 623 in order to accommodate permanent connection to a fluid-impermeable tube as will be discussed below. Tri-tube wire way 621 communicates with service bay 625 which is adapted for receiving and housing the electronic components and associated power supply in accordance with the present invention. A service bay port 627 is provided to allow access to service bay 625. In accordance with the present invention, a cap is provided to allow for selective access to service bay 625. The cap is not depicted in this view but is depicted in FIG. 21. Service bay 625 is communicatively coupled with wire way 629 which extends downward and outward, and which terminates approximately at a midpoint on the centerline 614 of the head bearing 615. Temperature sensor well 635 extends downward from wire way 629. The temperature sensor well is substantially aligned with centerline 614 of bearing head 615. Temperature sensor well 635 terminates in a position which is intermediate shirttail 633 and the outer edge 636 of head bearing 615. A temporary access port 631 is provided at the junction of wire way 629 and temperature sensor well 635. After assembly, temporary access port 631 is welded closed.

The location of temperature sensor well 635 was determined after empirical study of a variety of potential locations for the temperature sensor well. The empirical process of determining a position for a temperature sensor well which optimizes sensor discrimination of temperature changes which are indicative of possible bit failure will now be described in detail. The goal of the empirical study was to locate a temperature sensor well in a position within the bit head which provides the physical equivalent of a "low pass" filter between the sensor and a source of heat which may be indicative of failure. The "source" of heat is the bearing assembly which will generate excess heat if the seal and/or lubrication system is impaired during drilling operations.

During normal operations in a wellbore, the drill bit is exposed to a variety of transients which have some impact upon the temperature sensor. Changes in the temperature in the drill bit due to such transients are not indicative of likely bit failure. The three most significant transients which should be taken into account in the bit design are:

(1) temperature transients which are produced by the rapid acceleration and deceleration of the rock bit due to "bit bounce" which occurs during drilling operations;

(2) temperature transients which are associated with changes in the rate of rotation of the drill string which are also encountered during drilling operations; and (3) temperature transients which are associated with changes in the rate of flow of the drilling fluid during drilling operations.

The empirical study of the drill bit began (in Phase I) with an empirical study of the drilling parameter space in a laboratory environment. During this phase of testing, the impact on temperature sensor discrimination due to changes in weight on bit, the drilling rate, the fluid flow rate, and the rate of rotation were explored. The model that was developed of the drill bit during this phase of the empirical investigation was largely a static model. A drilling simulator cannot emulate the dynamic field conditions which are likely to be encountered by the drill bit.

In the next phase of the study (Phase II) a rock bit was instrumented with a recording sub. During this phase, the drilling parameter space (weight on bit, drilling rate, rate of rotation of the string, and rate of fluid flow) was explored in combination with the seal condition space over a range of seal conditions, including:

(1) conditions wherein no seal was provided between the rolling cone cutter and the head bearing;

(2) conditions wherein a notched seal was provided at the interface of the rolling cone cutter and the head bearing;

(3) conditions wherein a worn seal was provided between the rolling cone cutter and the head bearing; and (4) conditions wherein a new seal was provided between the interface of the rolling cone cutter and the head bearing.

Of course, seal condition number 1 represents an actual failure of the bit, while seal condition numbers 2 and 3 represent conditions of likely failure of the bit, and seal condition number 4 represents a properly functioning drill bit.

During the empirical study, an instrumented test bit was utilized in order to gather temperature sensor information which was then analyzed to determine the optimum location for a temperature sensor for the purpose of determining the bit condition from temperature sensor data alone. In other words, a location for a temperature sensor cavity was determined by determining the discrimination ability of particular temperature sensor locations, under the range of conditions representative of the drilling parameter space and the seal condition.

During testing a bit head was provided with temperature sensors in various test positions including:

(1) a shirttail cavity—the axially-oriented sensor well was drilled such that its centerline was roughly contained in the plane formed by the centerlines of the bit and the bearing with its tip approximately centered between the base of the seal gland and the shirttail O.D. surface;

(2) a pressure side cavity—the pressure side well was located similarly to the shirttail well with one exception; its tip was located just near the B4 hardfacing/base metal interface nearest the cone mouth;

(3) a centerline cavity—the center well was located similarly to the previous two with one exception; its tip was located on the bearing centerline approximately midway between the thrust face and the base of the bearing pin;

(4) a thrust face cavity—the thrust face well was located similarly to the previous three with one exception; the tip was located near the B4 hardfacing/base metal interface near thrust face on the pressure side.

The shirttail, by design, is not intended to contact the borehole wall during drilling operations, hence the temperature detected from this position tends to "track" the temperature of the drilling mud, and the position does not provide the best temperature sensor discrimination.

The empirical study determined that the pressure side cavity was not an optimum location due to the fact that it was cooled by the drilling mud flowing through the annulus, and thus was not a good location for discriminating likely bit failure from temperature data alone. In tests, the sensor located in the pressure side cavity observed little difference in measurement as the seal parameter space was varied; in particular, there was little discrimination between effective and removed seals. The thrust face cavity was determined to be too sensitive to transients such as axial acceleration and deceleration due to bit bounce, and thus would not provide good temperature sensor discrimination for detection of impending or likely bit failure. The shirttail cavity was empirically determined not to provide a good indication of likely bit failure as it was too sensitive to ambient wellbore temperature to provide a good indication of likely bit failure. The empirical study determined that the centerline cavity is the optimum sensor location for optimum temperature sensor discrimination of likely bit failure from temperature data alone.

Figure 13:
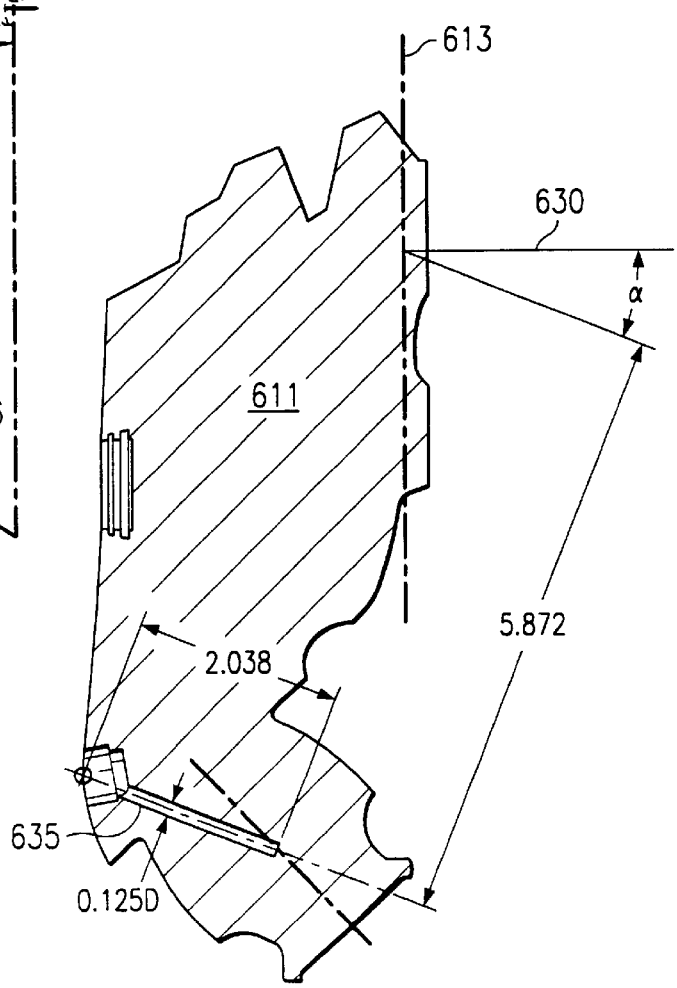
FIG. 13 is a partial longitudinal section view of a portion of the bit head which provides the relative locations and dimensions of the preferred temperature sensor cavity of the present invention.

FIG. 13 is a partial longitudinal section view of an unfinished (not machined) bit head 611 which graphically depicts the position of temperature sensor well 635 relative to centerline 613 and datum plane 630 which is perpendicular thereto. As is shown, temperature sensor well 635 is parallel to a line which is disposed at an angle $\alpha$ from datum plane 630 which is perpendicular to centerline 613. The angle $\alpha$ is 21° and 14 minutes from datum plane line 630. The dimensions of temperature sensor well (including its diameter and length) can be determined from the dimensions of FIG. 13. This layout represents the preferred embodiment of the present invention, and the preferred location for the temperature sensor well which has been empirically determined (as discussed above) to optimize temperature sensor discrimination of impending or likely bit failure under the various steady state and transient operating conditions that the bit is likely to encounter during actual drilling operations. It is also important to note that the sensor well position will vary with the bit size. The preferred embodiment is a 9½ inch drill bit.

In accordance with preferred embodiment of the present invention, the temperature sensor that is utilized to detect temperature within the improved drill bit is a resistance temperature device. In the preferred embodiment, a resistance temperature device is positioned in each of the three bit heads in the position which has been determined to provide optimal temperature sensor discrimination.

Figure 14:
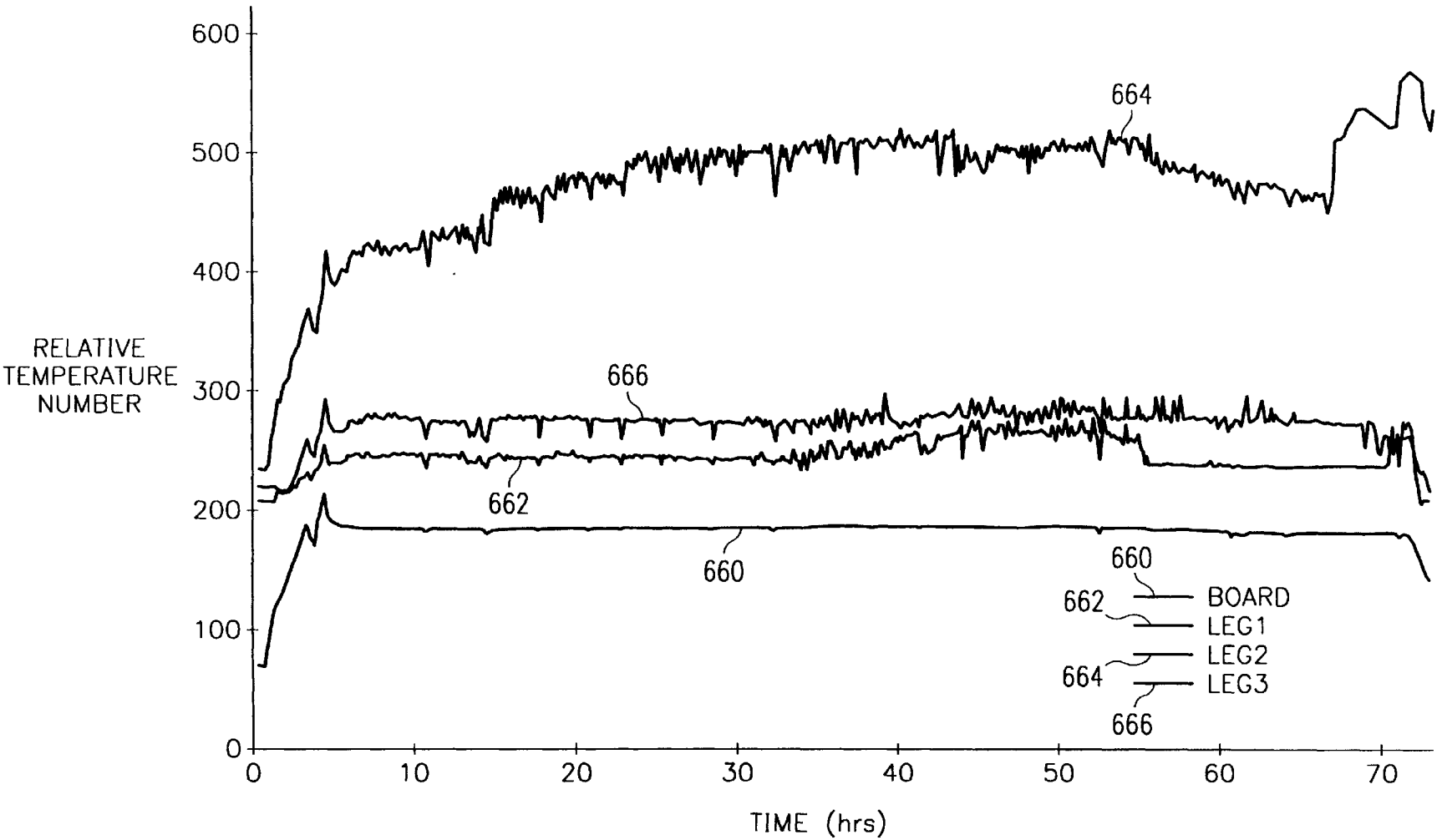
FIG. 14 is a graphical representation of relative temperature data from a tri-cone rock bit during test operations.

FIG. 14 is a graphical depiction of the measurements made while utilizing the thermistor temperature sensors for a three-leg rolling cutter rock bit. In this view, the x-axis is representative of time in units of hours, while the y-axis is representative of relative temperature in units of degrees Fahrenheit. As is shown, graph 660 represents the relative temperature in the service bay 635 (of FIG. 12), while graph 662 represents the relative temperature in head number one, graph 664 represents the relative temperature of head number two, and graph 666 represents the relative temperature of head three. As is shown in the view of FIG. 14, the relative temperature in bit head two is substantially elevated relative to the temperatures of the other bit heads, indicating a possible mechanical problem with the lubrication or bearing systems of bit head number two.

12. USE OF A TRI-TUBE ASSEMBLY FOR CONDUCTOR ROUTING WITHIN A DRILL BIT: In the preferred embodiment of the present invention, a novel tri-tube assembly is utilized to allow for the electrical connection of the various electrical components carried by the improved drill bit. This is depicted in simplified plan view in FIG. 15. This figure shows the various wire pathways within a tri-cone rock bit constructed in accordance with the present invention. As is shown, bit head 611 includes a temperature sensor well 635, which is connected to wire pathway 629, which is connected to service bay 625. Service bay 625 is connected to tri-tube assembly 667 through tri-tube wire way 621. The other bit heads are similarly constructed. Temperature sensor well 665 is connected to wire pathway 663, which is connected to service bay 661; service bay 661 is connected through tri-tube wire pathway 659 to the tri-tube assembly 667. Likewise, the last bit head includes temperature sensor well 657 which is connected to wire pathway 655, which is connected to service bay 653. Service bay 653 is connected to tri-tube wire pathway 651 which is connected to the tri-tube assembly.

Figure 15:
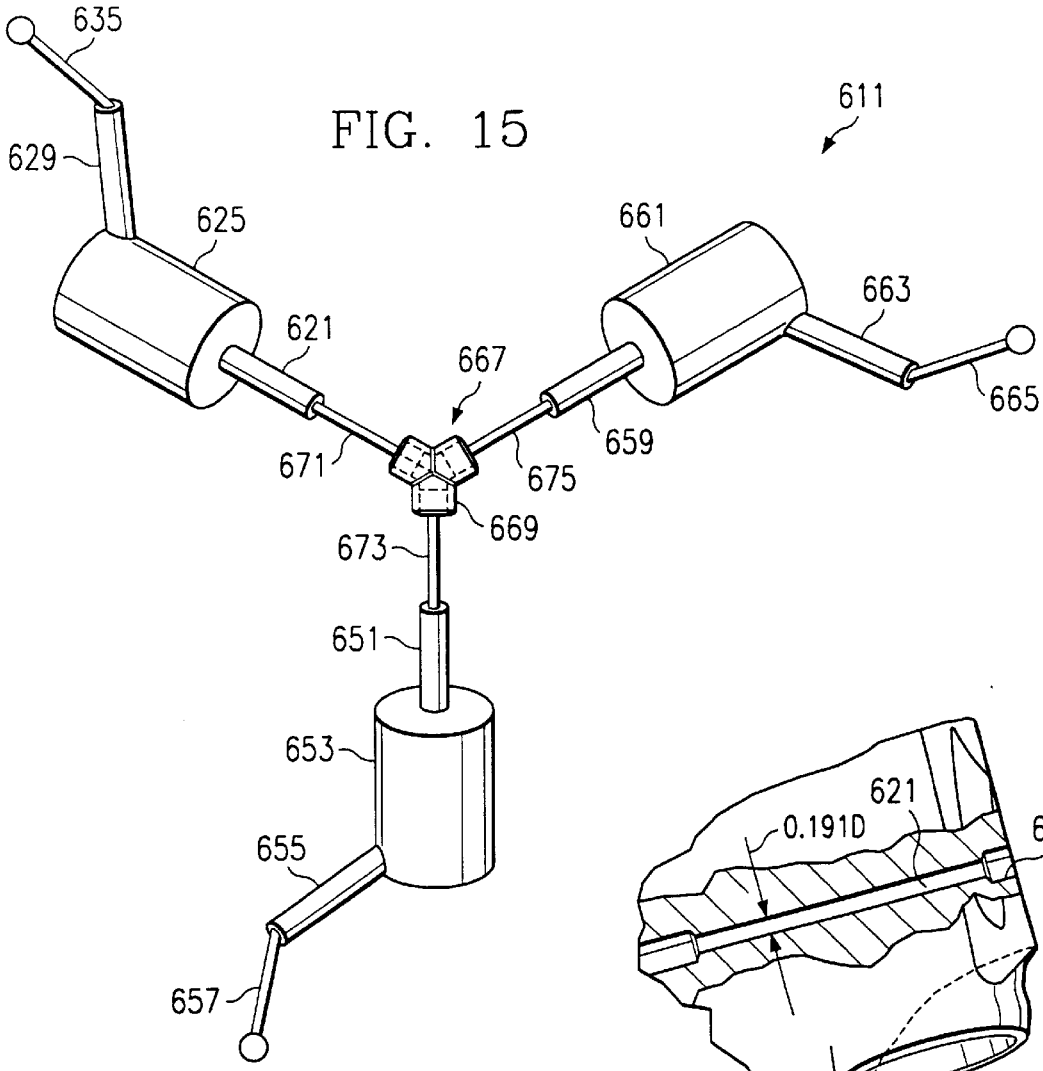
FIG. 15 is a simplified plan view of the conductor, service, and sensor cavities and associated tri-tube assembly utilized in accordance with one embodiment of the present invention to route conductors through the improved drill bit.

As is shown in the view of FIG. 15, tri-tube assembly includes a plurality of fluid-impermeable tubes which allow conductors to pass between the bit heads. In the view of FIG. 15, tri-tube assembly 667 includes fluid-impermeable tubes 671, 673, 675. These fluid-impermeable tubes 671, 673, 675 are connected together through tri-tube connector 669.

Figure 16:
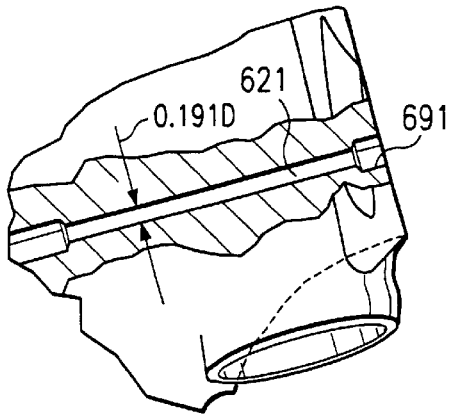
FIG. 16 is a fragmentary cross-section view of the tri-tube wire way in accordance with the preferred embodiment of the present invention.
Figure 17:
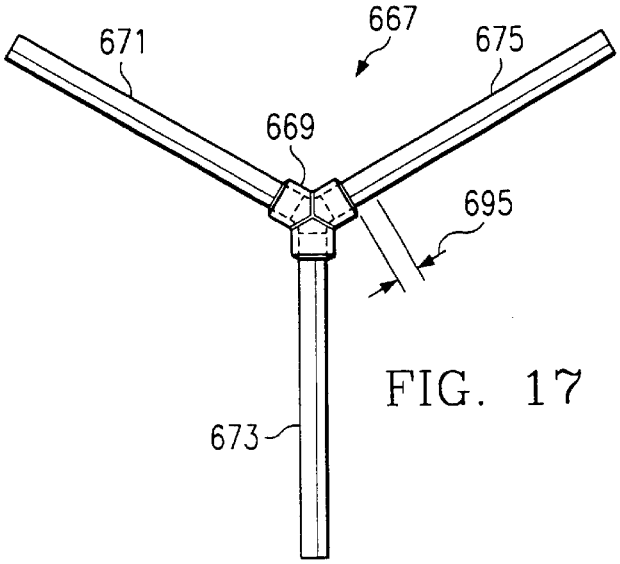
FIG. 17 is a top view of the tri-tube assembly in accordance with the preferred embodiment of the present invention.
Figure 18:
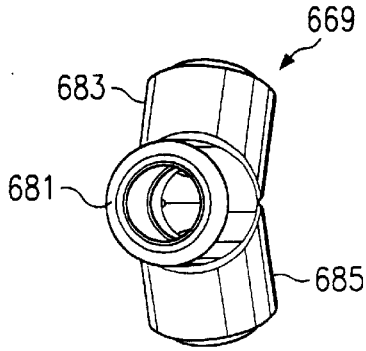
FIG. 18 is a perspective view of the connector of the tri-tube assembly in accordance with the preferred embodiment of the present invention.

In the preferred embodiment of the present invention, the fluid-permeable tubes 671, 673, 675 are butt-welded to the heads of the improved rock bit. Additionally, the fluid-impermeable tubes 671, 673, 675 are welded and sealed to tri-tube connectors 669. In this configuration, electrical conductors may be passed between the bit heads through the tri-tube assembly 667. The details of the preferred embodiment of the tri-tube assembly are depicted in FIGS. 16, 17, and 18. In the view of FIG. 16, the tri-tube wire way 621 is depicted in cross-section view. As is shown, it has a diameter of 0.191 inches. The tri-tube wire pathway 621 terminates at a beveled triad hole 691 which has a larger cross-sectional diameter. The fluid-impermeable tube is butt-welded in place within the beveled triad hole.

FIG. 17 is a pictorial representation of the tri-tube assembly 667. As is shown therein, the fluid-impermeable tubes 671, 673, 675 are connected to triad coupler 669. As is shown, the fluid-impermeable tubes are substantially angularly equidistant from adjoining fluid-impermeable tube members. In the configuration shown in FIG. 17, the fluid-impermeable tubes 671, 673, 675 are disposed at 120° angles from adjoining fluid-impermeable tubes.

FIG. 18 is a pictorial representation of coupler 669. As is shown, three mating surfaces are provided with orifices adapted in size and shape to accommodate the fluid-impermeable tubes 671, 673, 675. In accordance with the present invention, the fluid-impermeable tubes 671, 673, 675 may be welded in position relative to coupler 669.

Figure 19:
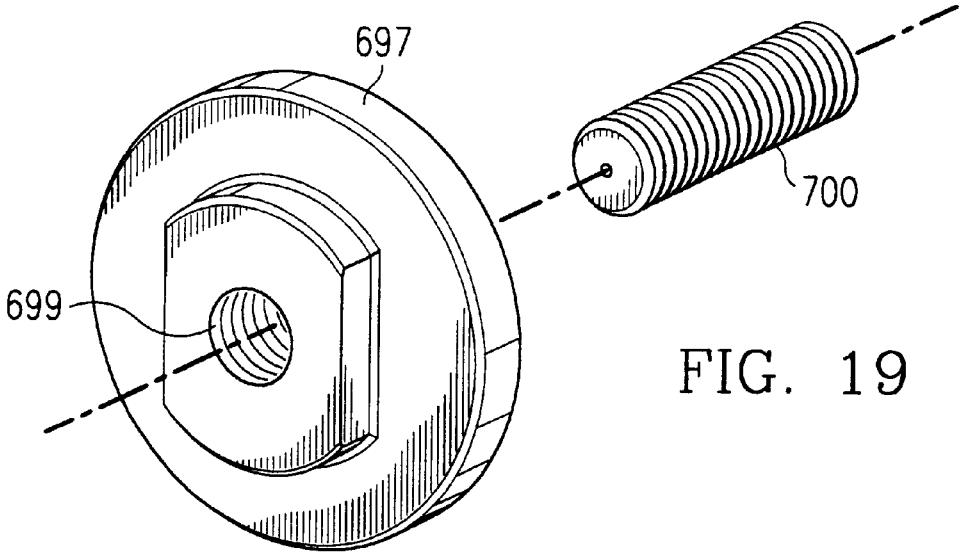
FIG. 19 is a pictorial representation of the service bay cap and associated pipe plug in accordance with the preferred embodiment of the present invention.

FIG. 19 is a pictorial representation of service bay cap 697. As is shown, service bay cap 697 is adapted in size and shape to cover the service bay openings (such as openings 627). As is shown, a threaded port 699 is provided within service bay cap 697. During assembly operations, a switch or electrical wire passes through threaded port 699 to allow an electrical component to be accessible from the exterior of the improved drill bit. A conductor or leads for a switch are routed through an externally-threaded pipe plug 700 which is utilized to fill threaded port 699, as will be discussed below.

Figure 20:
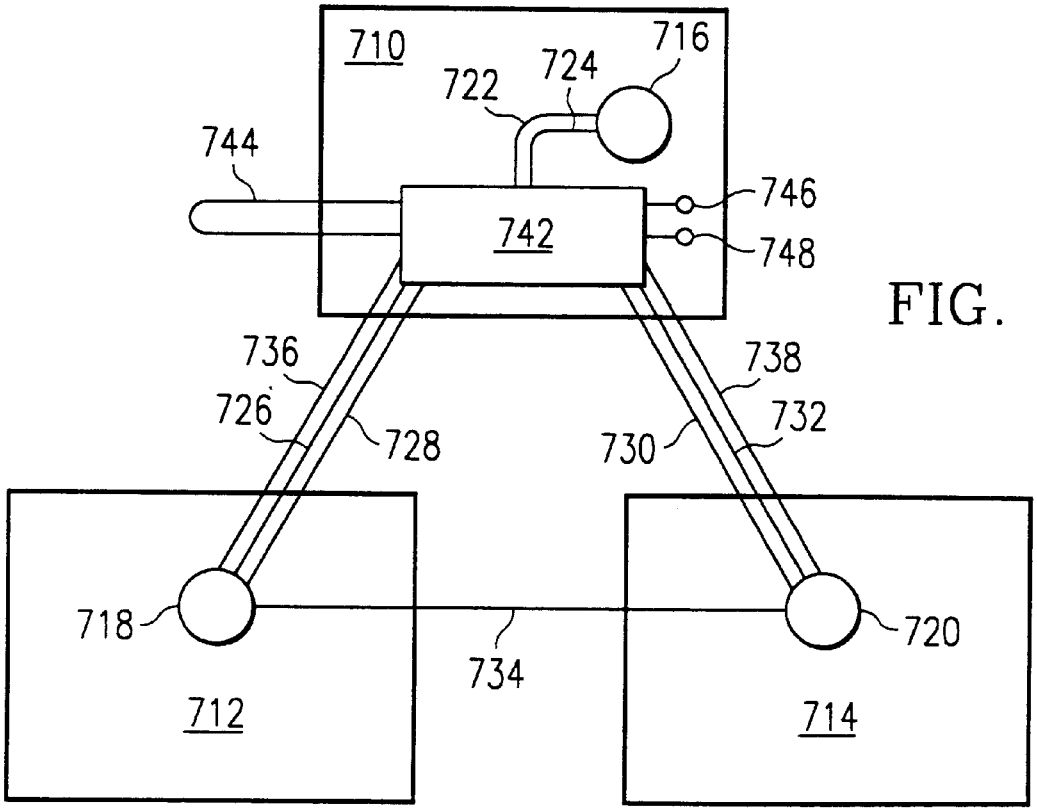
FIG. 20 is a pictorial and block diagram representation of the electrical conductors and electrical components utilized in accordance with the preferred embodiment of the present invention.

FIG. 20 is a block diagram and schematic depiction of the wiring of the preferred embodiment of the present invention. As is shown, bit legs 710, 712, 714 carry temperature sensors 716, 718, 720. An electronics module 742 is provided in bit leg 710. Three conductors are passed between bit leg 710 and bit leg 712. Conductors 726, 728 are provided for providing the output of temperature sensor 718 to electronic module 742. Conductor 736 is provided as a battery lead(+). A single conductor 734 is provided between bit leg 712 and bit leg 714: conductor 734 is provided as a battery lead (series) for temperature sensors 718, 720. Three conductors are provided between bit leg 710 and bit leg 714. Conductors 730, 732 provide sensor data to electronics module 742. Conductor 738 provides a battery lead (–) between sensors 716, 720. In accordance with the present invention, conductors 726, 728, 736, 734, 730, 732, and 738 are routed between bit legs 710,712, 714, through the tri-tube assembly discussed above. Leads 746, 748 are provided to allow testing of the electronics and retrieval of stored data.

In accordance with the present invention, the electrical components carried by electronics module 742 are maintained in a low power consumption mode of operation until the bit is lowered into the wellbore. A starting loop 744 is provided which is accessible from the exterior of the bit (and which is routed through the service bay cap, and in particular through the pipe plug 700 of service bay cap 697 of FIG. 19). Once the wire loop 744 is cut, the electronic components carried on electronics module 742 are switched between a low power consumption mode of operation to a monitoring mode of operation. This preserves the battery and allows for a relatively long shelf life for the improved rock bit of the present invention. As an alternative to the wire loop 744, any conventional electrical switch may be utilized to switch the electronic components carried by electronic module 742 from a low power consumption mode of operation to a monitoring mode of operation.

Figure 23:
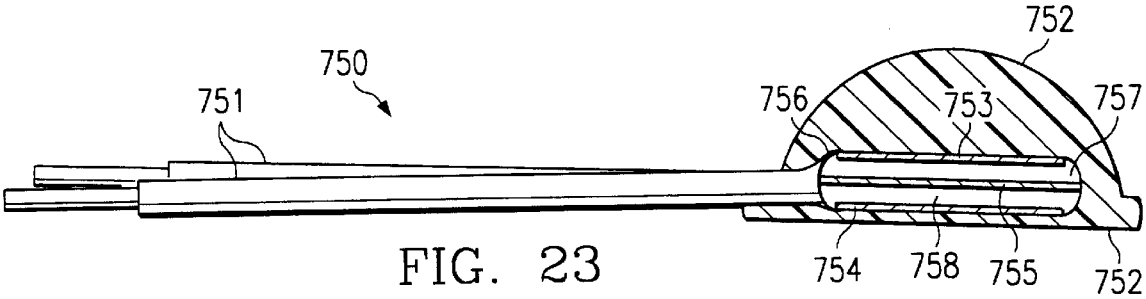
FIG. 23 is a longitudinal section view of a pressure-actuated switch which may be utilized in connection with the improved bit of the present invention to switch the bit between operating states.

For example, FIG. 23 is a cross-section depiction of the pressure-actuated switch 750 which may be utilized instead of the wire loop 744 of FIG. 20. As is shown, the pair of electrical leads 751 terminate at pressure switch housing 752 which capulates and protects the electrical components contained therein. As is shown, conductive layers 753, 754 are disposed on opposite sides of conductor 755. The leads 751 are electrically connected at coupling 756 to conductor 753, 754. Spaces 757, 758 are provided between conductors 755 and conductor 753, 754. Applying pressure to switch housing 752 will cause conductors 753, 754, 755 to come together and complete the circuit through leads 751.

Figure 24:
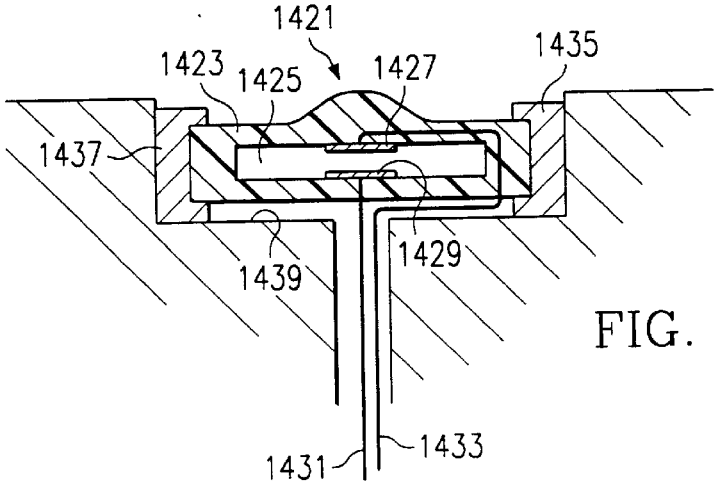
FIG. 24 is a section view of an alternative pressure-actuated switch.

FIG. 24 is a simplified cross-section view of an alternative switch which may be utilized in conjunction with an alternative embodiment of the present invention. As is shown, the switch 1421 is adapted to be secured by fasteners 1435, 1437 in cavity 1439 which is formed in the cap of the service bay. Switch 1421 includes a switch housing 1423 which surrounds a cavity 1425 which is maintained at atmospheric pressure. Within the housing 1423 are provided switch contacts 1427, 1429 which are coupled to electrical leads 1431, 1433. When the device is maintained at atmospheric pressure, the switch contacts 1427, 1429 are maintained out of contact from one another; however, when the device is lowered into a wellbore where the ambient pressure is elevated, the pressure deforms housing 1423, causing switch contacts 1427, 1429 to come into mating and electrical contact. Utilization of this pressure sensitive switch mechanism ensures that the electronic components of the present invention are not powered-up until the device is lowered into the wellbore and is exposed to a predetermined ambient pressure which is preferably far higher than pressures encountered at the surface locations of the oil and gas properties.

Figure 22:
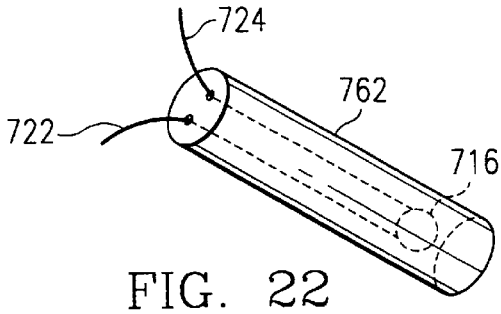
FIG. 22 is a pictorial representation of an encapsulated temperature sensor in accordance with the preferred embodiment of the present invention.

In accordance with the present invention, each of the temperature sensors in the bit legs is encased in a plastic material which allows for load and force transference in the rock bit through the plastic material, and also for the conduction of tests. This is depicted in simplified form in FIG. 22, wherein temperature sensor 716 (of bit leg one) is encapsulated in cylindrical plastic 762. The leads 722, 724, 740 which communicate with temperature sensor 716 are accessible from the upper end of capsule 762.

One important advantage of the present invention is that the temperature monitoring system is not in communication with any of the lubrication system components. Accordingly, the temperature monitoring system of the present invention can fail entirely, without having any adverse impact on the operation of the bit. In order to protect the electrical and electronic components of the temperature sensing system of the present invention from the adverse affects of the high temperatures, high pressures, and corrosive fluids of the wellbore group drilling operations, the cavities are sealed, evacuated, filled with a potting material, all of which serve to protect the electrical and electronic components from damage.

The sealing and potting steps are graphically depicted in FIG. 21. As is shown, a vacuum source 770 is connected to the cavities of bit leg one. The access ports for bit legs two and three are sealed, and the contents of the cavities in the bit are evacuated for pressure testing. The objective of the pressure testing is to hold 30 milliTor of vacuum for one hour. If the improved rock bit of the present invention can pass this pressure vacuum test, a source of potting material (preferably Easy Cast 580 potting material) is supplied first to bit leg three, then to bit leg two, as the vacuum source 770 is applied to bit leg one. The vacuum force will pull the potting material through the conductor paths and service bays of the rock bit of the present invention. Then, the service bays of the bit legs are sealed, ensuring that the temperature sensor cavities, wire pathways, and service bays of the improved bit of the present invention are maintained at atmospheric pressure during drilling operations.

Figure 25:
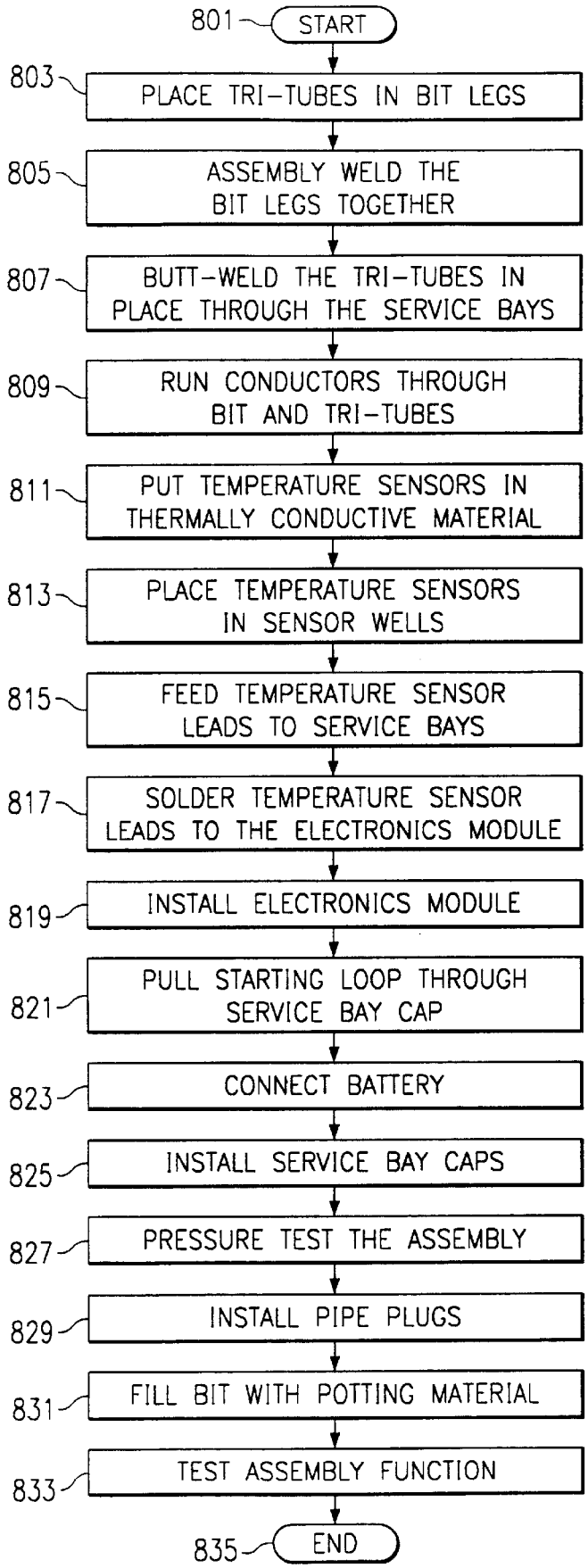
FIG. 25 is a flow chart representation of the manufacturing process utilized for the preferred embodiment of the improved bit of the present invention.

13. PREFERRED MANUFACTURING PROCEDURES: FIG. 25 is a flow chart representation of the preferred manufacturing procedure of the present invention. The process commences at block 801, and continues at block 803, wherein the tri-tubes are placed in position relative to the bit leg forgings. Next, in accordance with block 805, the bit leg forgings are welded together. Then, in accordance with block 807, the tri-tubes are butt-welded in place relative to the bit leg assembly through the service bays. Then, in accordance with block 809, the conductors are routed through the bit and tri-tube assembly, as has been described in detail above. Then, in accordance with block 811, the temperature sensors are potted in a thermally conductive material. Next, in accordance with block 813, the temperature sensors are placed in the temperature sensor wells of the rock bit. Then, in accordance with block 815, the temperature sensor leads are fed to the service bays. In accordance with block 817, the temperature sensor leads are soldered to the electronics module. Then in accordance with block 819, the electronics module is installed in the rock bit. Then in accordance with block 821, the "starting loop" (loop 744 of FIG. 20) is pulled through a service bay cap. Next, in accordance with block 823 the battery is connected to the electronics module. In accordance with step 825, the service bay caps are installed. Then in accordance with step 827, the assembly is pressure tested (as discussed above in connection with FIG. 21). Then in accordance with step 829, the pipe plugs are installed in the service bay caps. Next, in accordance with step 831 the bit is filled with potting material (as discussed in connection with FIG. 21). Then the function of the assembly is tested in accordance with step 833, and the process ends at step 835.

In the field, the improved rock bit of the present invention is coupled to a drillstring. Before the bit is lowered into the wellbore, the starting loop is cut, which switches the electronics module from a low power consumption mode of operation to a monitoring mode of operation. The bit is lowered into the wellbore, and the formation is disintegrated to extend the wellbore, as is conventional. During the drilling operations, the electronic modules samples the temperature data and records the temperature data. The data may be stored for retrieval at the surface after the bit is pulled, or it may be utilized in accordance with the monitoring system and/or communication system of the present invention to detect likely bit failure and provide a signal which warns the operator of likely bit failure.

Figure 26:
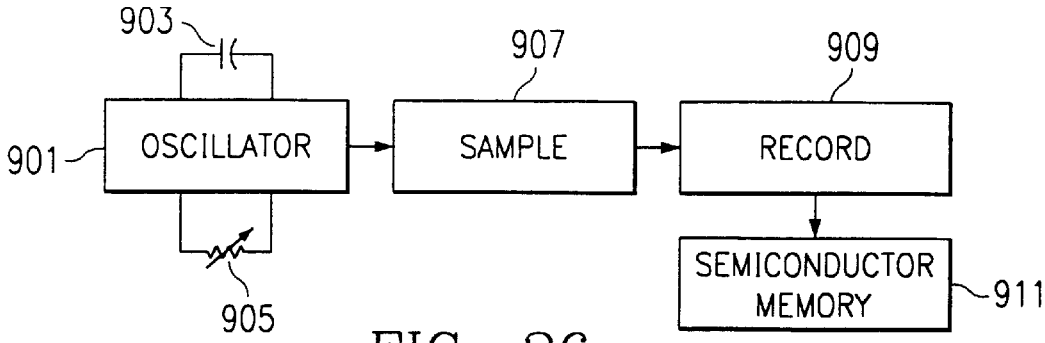
FIGS. 26 and 27 are circuit, block diagram and graphical presentations of the signal processing utilized in accordance with the preferred resistance temperature sensing system of the present invention.

14. OVERVIEW OF THE ELECTRONICS MODULE: A brief overview of the components and operation of the electronics module will be provided with reference to FIGS. 26 and 27. In accordance with the present invention, and as is shown in FIG. 26, the electronics module of the present invention utilizes an oscillator 901 which has its frequency of oscillation determined by a capacitor 903 and a resistor 905. In accordance with the present invention, resistor 905 comprises the temperature sensor which is located in each bit leg, and which varies its resistance with changes in temperature. Accordingly, the frequency of oscillator 901 will vary with the changes in temperature in the bit leg. The output of oscillator 901 is provided to a sampling circuit 907 and recording circuit 909 which determine and record a value which corresponds to the oscillation frequency of oscillator 901, which in turn corresponds to the temperature in the bit leg. Recording circuit 909 operates to record these values in semiconductor memory 911.

Figure 27:
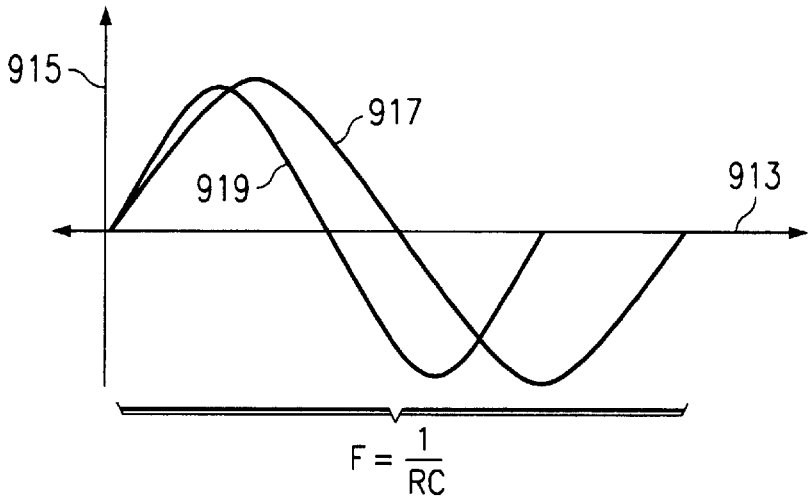

FIG. 27 is a graphical representation of the relationship between oscillator 901, capacitor 903 and resistor 905. In this graph, the x-axis is representative of time, and the y-axis is representative of amplitude of the output of oscillator 901. As is shown, the frequency of oscillation is inversely proportional to the product of the capacitance value for capacitor 903 and the resistance value for resistor 905. As the value for resistor 905 (corresponding to the thermocouple temperature sensor) changes with temperature, the oscillation frequency of oscillator 901 will change. In FIG. 27, curve 917 represents the output of oscillator 901 for one resistance value, while curve 919 represents the output of oscillator 901 for a different resistance value. Sampling circuit 907 and recording circuit 909 can sample the frequency, period, or zero-crossing of the output of oscillator 901 in order to determine a value which can be mapped to temperature changes in a particular bit leg. In accordance with the present invention, since three different temperature sensors are utilized, a multiplexing circuit must be utilized to multiplex the sensor data and allow it to be sampled and recorded in accordance with the present invention.

In accordance with the preferred embodiment of the present invention, the monitoring, sampling and recording operations are performed by a single application specific integrated circuit (ASIC) which has been specially manufactured for use in wellbore operations in accordance with a cooperative research and development agreement (also known as a "CRADA") between Applicant and Oak Ridge National Laboratory in Oak Ridge, Tennessee. The details relating to the construction, operation and overall performance of this application specific integrated circuit are described and depicted in detail in the enclosed paper by M. N. Ericson, D. E. Holcombe, C. L. Britton, S. S. Frank, R. E. Lind, T. E. McKnight, M. C. Smith and G. W. Turner, all of the Oak Ridge National Laboratory, which is entitled *An ASIC-Based Temperature Logging Instrument Using Resistive Element Temperature Coefficient Timing*. A copy of a draft of this paper is attached hereto and incorporated by reference as if fully set forth herein. The following is a description of the basic operation of the ASIC, with reference to FIGS. 30A through 30F, and quoting extensively from that paper.

Figure 29A:
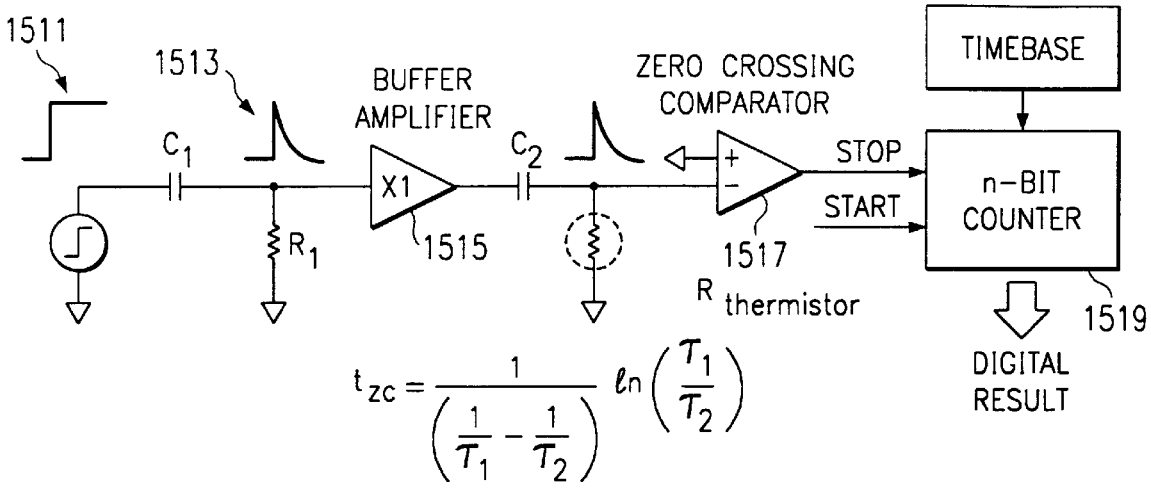
FIGS. 29A through 29F are block diagram representations of the Application Specific Integrated Circuit utilized in the present invention.
Figure 29D:
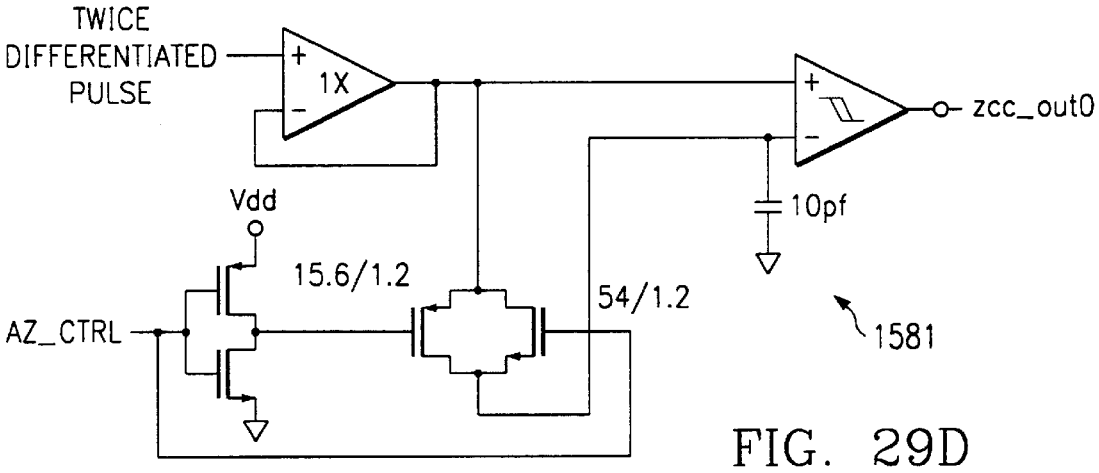

A block diagram of the temperature-to-time converter topology is shown in FIG. 29A. A step pulse 1511 is generated that is differentiated using $R_1$ and $C_1$ resulting in pulse 1513 which is applied to amplifier 1515. The n-bit counter 1519 is started from a reset state when the pulse is output. The differentiated pulse is buffered and passed through another differentiator formed by $C_2$ and $R_{sensor}$. This double differentiation causes a bipolar pulse with a zero-crossing time described by the equation shown in FIG. 29A, wherein $\tau_1$ and $\tau_2$ are the time constants associated with $R_1C_1$ and $R_{sensor}C_2$, respectively. $R_{sensor}$ is a resistive sensor with a known temperature coefficient. A zero-crossing comparator 1517 detects the zero-crossing and outputs a stop signal to the counter 1519. The final value of the counter is the digital representation of the temperature. By proper selection of the timebase frequency, the zero-crossing point is independent of signal amplitude thus eliminating the need for a high accuracy voltage pulse source or temperature stable power supply voltages. Additionally, any gain stages used in the circuit are not required to have a precise gain function over temperature.

As demonstrated in the equation of FIG. 29A, some logarithmic compression is inherent in this measurement method making it appropriate for wide-range measurements covering several decades of resistance change. The resistance element type selection will play a dominant role in both the measurement range and resolution profile.

Figure 29B:
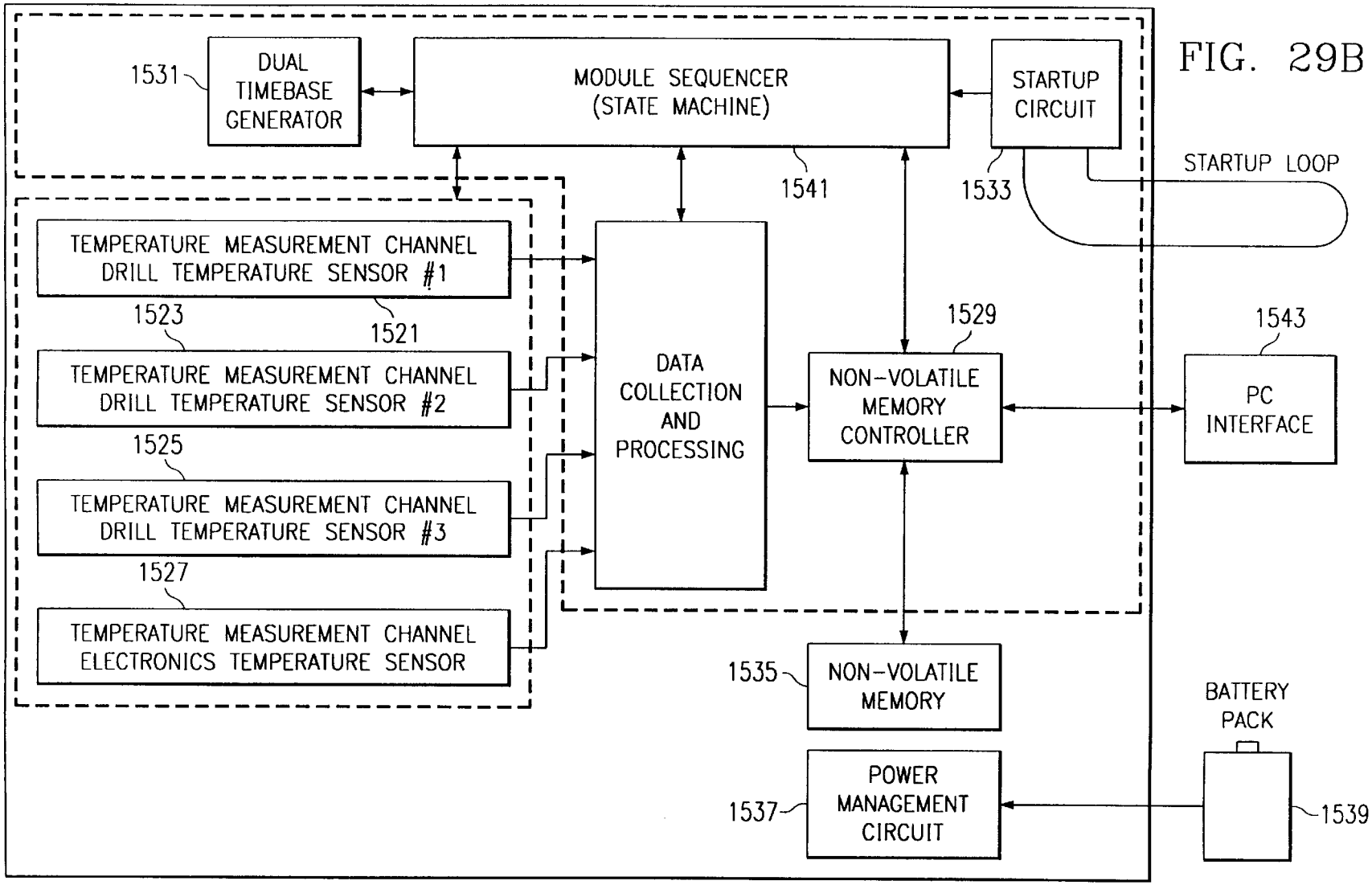

The circuit described in the previous section is integrated into a measurement system in accordance with the present invention. FIG. 29B outlines a block diagram of the system. This unit consists of four front-end measurement channels 1521, 1523, 1525, 1527, a digital controller 1529, two timebase circuits 1531, a startup circuit 1533, a nonvolatile memory 1535, and power management circuits 1537, 1539. The front end electronics were integrated onto a single chip consisting of four measurement channels: three for remote location temperature logging, and one for the electronics unit temperature logging. The control for the system was integrated onto another ASIC (HC_DC). The circuit was designed to allow for a significant shelf life, both before and after use. Incorporation of an "off" mode allows the unit to be installed and connected to a battery while drawing less than 10 $\mu$A. Data collection is initiated by breaking the startup loop (cutting the wire in this case). The unit operates for 150 hours, taking samples every 7.5 minutes, generating a 512 sample average for each channel, and storing the average in a non-volatile memory 1529. A sampling operation (generating a 512 sample average for each channel) requires approximately 20 seconds. In the time between taking samples (~410 seconds), the unit is placed in a reduced power mode where the front end electronics 1521, 1523, 1525, 1527 are biased off, and the module sequencer 1541 only counts the low frequency clock pulses. Two oscillator circuits are used. A high frequency oscillator provides a 1 MHz clock for counting the zero-crossing time. A low frequency oscillator continuously running at 16 kHz provides the time base for the system controller. After 150 hours of operation, the unit goes back into sleep mode. Data is then retrieved at a later time from the unit using the PC interface 1543. Using non-volatile memory 1529 allows years to retrieve the data and eliminates the need to maintain unit power after data storage is completed.

Figure 29C:
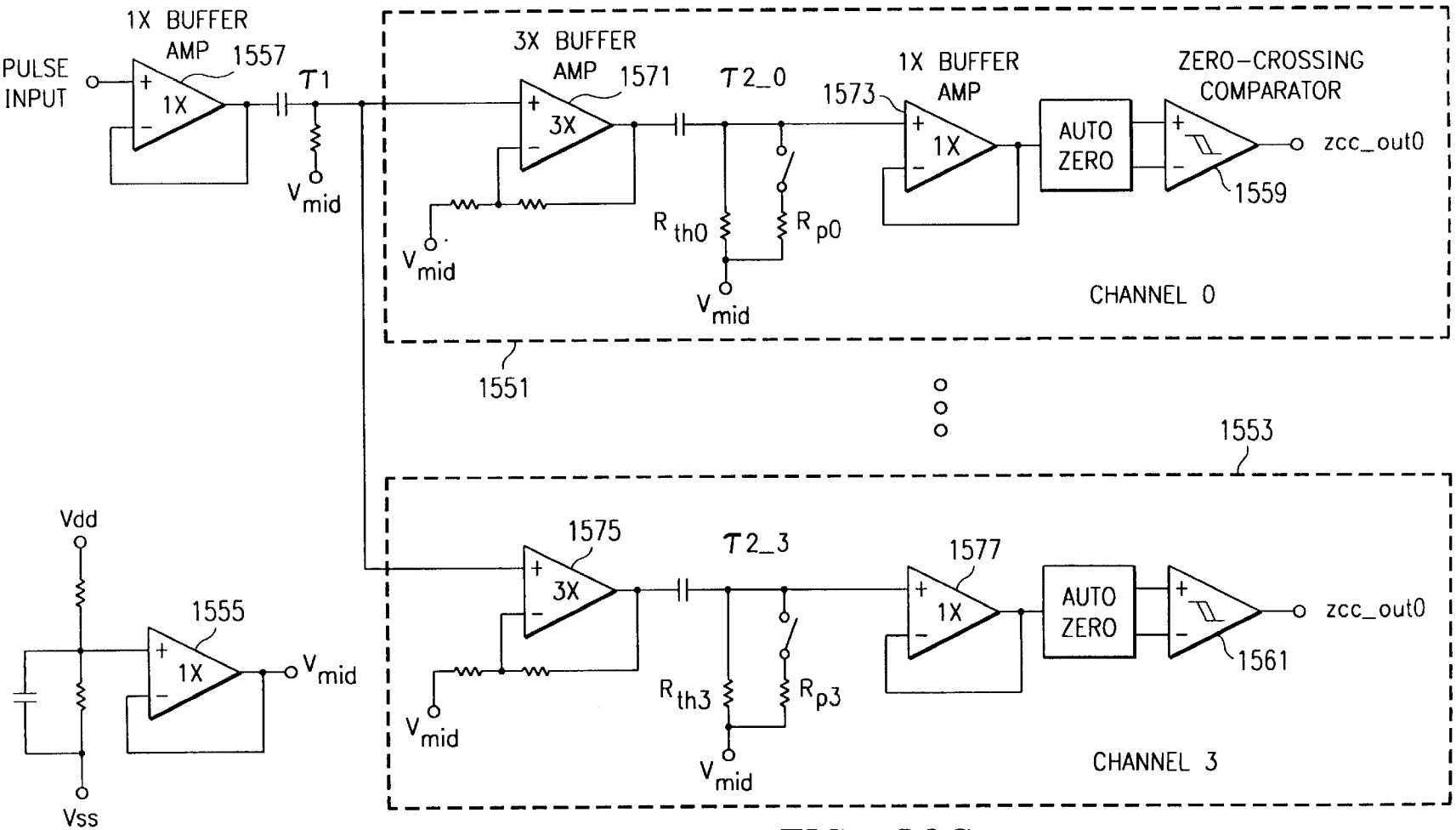

The front end electronics consists of four identical zero-crossing circuits 1551, 1553 (to simplify the description, only two are shown) and a Vmid generator 1555, as shown in FIG. 29C. The output of the first differentiator 1557 is distributed to all four channels. This signal is then buffered/amplified and passed through another differentiator that produces the zero crossing. A zero crossing comparator 1559, 1561 with ~8 mV of hysteresis produces a digital output when the signal crosses through Vmid. Vmid is generated as the approximate midpoint between Vdd and Vss using a simple resistance divider. Its value does not have to be accurately generated and may drift with time and temperature since each entire channel uses it as a reference. Buffer amplifiers 1571, 1573, 1575, 1577 are used around each time constant to prevent interaction.

The front end electronics were implemented as an ASIC and functioned properly on first silicon. A second fabrication run was submitted that incorporated two enhancements to improve the measurement accuracy at long time constants and at elevated temperatures. With large time constraints the zero crossing signal can have a small slope making the zero crossing exhibit excessive walk due to the hysteresis of the zero-crossing comparator. Additionally, high impedance sensors result in a very shallow crossing increasing susceptibility to induced noise. Gain was added (3×) to increase both the slope and the depth of the zero-crossing signal. At elevated temperatures, leakage currents (dominated by pad protection leakage) and temperature dependent opamp offsets add further error by adding a dc offset to the zero-crossing signal. The autozero circuit 1581 shown in FIG.

29D was also added to the original front end ASIC design to decrease the effect of these measurement error sources. Consisting of a simple switch and capacitor, the output voltage of the buffer amplifier (which contains the offset errors associated with both the buffer amplifier offset and the leakage current into the temperature dependent resistive element) is stored on the capacitor after the channel is biased "on" but before the start pulse is issued. Microseconds before the start is issued the switch is opened and the zero-crossing comparator references the zero-crossing signal to the autozeroed value which effectively eliminates the offset errors associated with the previous stage. The ac coupling presented by each of the differentiators eliminates the dc offsets from the input stages $\tau 1$, provided the offset errors are not large enough to cause signal limiting.

Low power operation is accomplished by providing an individual bias control for each of the front end channels. This allows the system controller to power down the entire front end while in sleep mode, and power each channel separately in data collection mode, thus keeping power consumption at a minimum. Since the channels are biased "off" between measurements, leakage currents can cause significant voltages to be generated at the sensor node. This can be a problem when the sensor resistance is large and can cause measurement delays when the channel is biased "on" since time must be allowed for the node to discharge. Incorporation of a low value resistor that can be switched in when the channels are biased "off" (see $R_{p0}$ and $R_{p3}$ in Figure) eliminated this difficulty.

All passive elements associated with $\tau 1$ and $\tau 2$ were placed external to the ASIC due to the poor tolerance control and high temperature coefficient of resistor options available, and the poor tolerance control and limited value range of double poly capacitors in standard CMOS processes. COG capacitors were used for both $\tau 1$ and $\tau 2$ and a 1% thick film (100 ppm/°C.) resistor was employed for $\tau 1$.

Figure 29E:
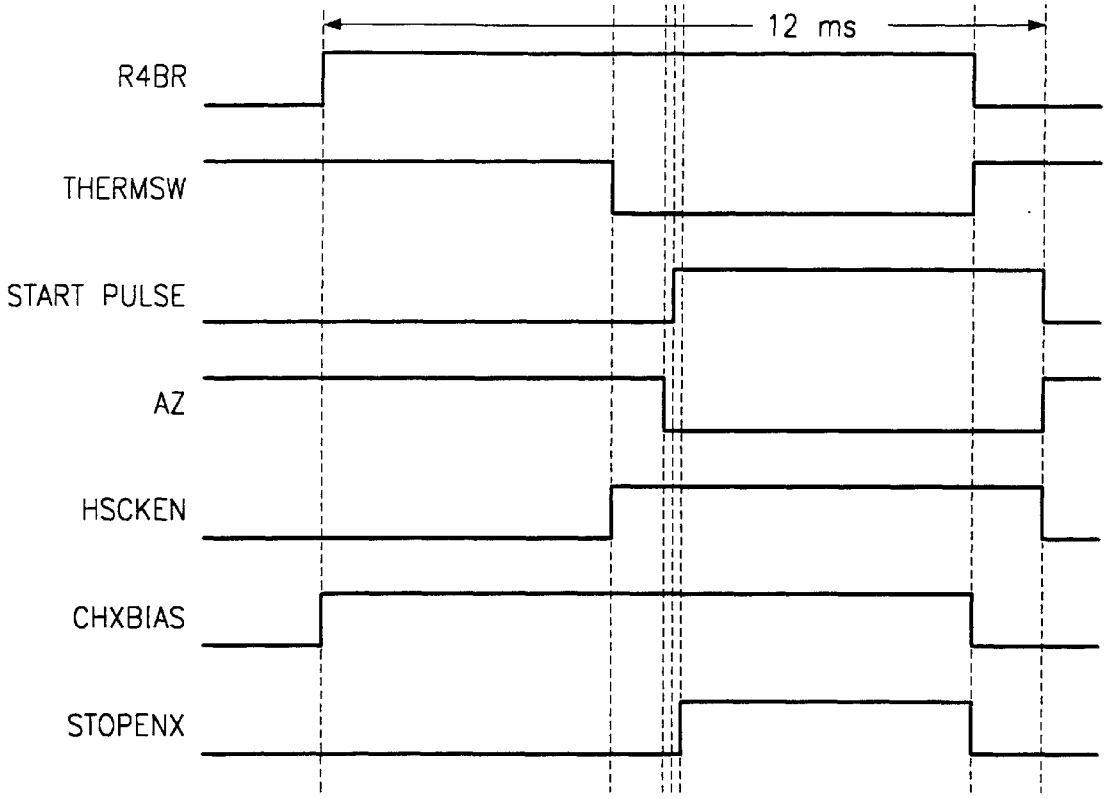

The module sequencer 1541 (of FIG. 29B) is the system control state machine and is responsible for a number of functions including: determining when to perform measurements, enabling the bias and pulsing each front end channels separately, enabling the high frequency clock, controlling the data collection and processing, and sequencing the non-volatile memory controller. FIG. 29E shows the basic state machine control associated with a single channel conversion. R4BR and CHXBIAS are issued to properly reset the amplifiers and turn on the bias to the front end. THERMSW is then taken low which switches out the resistors in parallel with the thermistors. The high speed clock is then started using HSCKEN, the autozero function disabled (AZ) and the START PULSE is issued. STOPENX is delayed slightly from the issue of the start pulse to prevent false firing of the zero-crossing discriminators during the issuing of the start pulse. After time has been allowed for the zero-crossing to occur, R4BR and THERMSW are put back into the initialization state, the autozero is enabled, and the oscillator disabled. This function is performed for each of the four channels, and then the cycle performed 256 times. As the sampling takes place the average is generated and when complete the module sequencer controls the writing of the packet NVRAM. Counters are used to determine when sampling needs to be initiated, how many samples have been applied towards an average value, and how many average sample packets have been stored in memory. When the total number average samples have been collected and stored, the unit disables the low frequency oscillator and goes into a power down mode. At this point, there is no need for power and the battery supply can be removed without impact on the stored data.

Figure 29F:
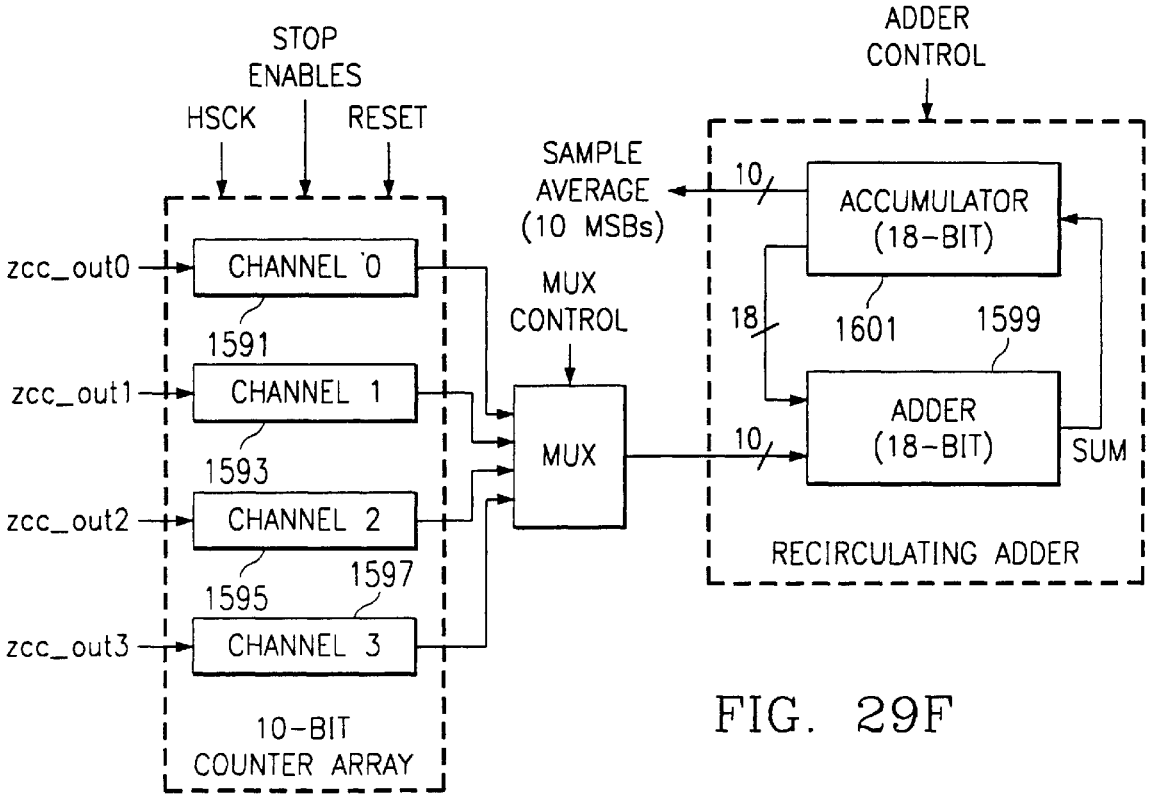

The data collection module consists of four 10-bit counters 1591, 1593, 1595, 1597, a shared digital adder 1599, and the necessary latches (accumulator) 1601 to store the data for pipelined counting and averaging, as is shown in FIG. 29F. The average is determined by taking the 10 most significant bits of the 256 sample sum. Each counter has an individual stop enable to prevent erroneous stop pulses during the start pulse leading edge. If a zero-crossing signal is not detected, the counters overflows to an all-1's state.

15. OPTIMIZING LUBRICATION SYSTEM MONITORING: It is another objective of the present invention to provide a lubrication monitoring system which optimizes the detection of degradation of the lubrication system, far in advance of lubrication system failure, which is relatively simple in its operation, but highly reliable in use. The objective of such a system is to provide a reliable indication of the rate of decline of the duty factor (also known as "service life") of the improved rock bit of the present invention. In order to determine the optimum lubrication monitoring system, a variety of monitoring systems were empirically examined to determine their relative sensor discrimination ability. Three particular potential lubrication condition monitoring systems were examined including:

(1) the ingress of drilling fluids into the lubrication monitoring system;

(2) the detection of the presence of wear debris from the bearing in the lubrication system; and (3) the effects of working shear on the lubricant in the lubrication system.

Another important objective of a lubrication monitoring system is to have a system which operates, to the maximum extent possible, similarly to the optimized temperature sensing system described above.

Figure 28:
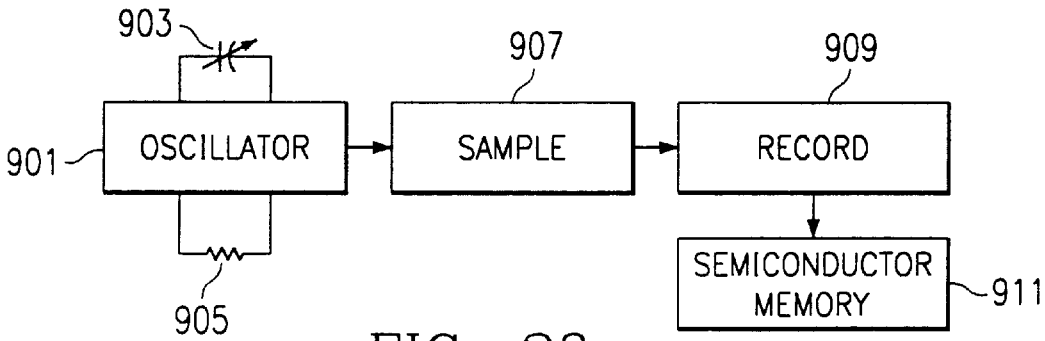
FIG. 28 is a circuit and block diagram representation of the preferred lubrication monitoring system of the present invention.

FIG. 28 is a block diagram and circuit drawing representation of this concept. As is shown, in oscillator 901 has a frequency of oscillation which is determined by the capacitance value of a variable capacitor 903 and a known resistance value for resistor 905. In other words, it was one objective of the optimized lubrication monitoring system of the present invention to provide a monitoring system which can determine the decline in service life of the lubrication system by monitoring the capacitance of an electrical component embedded in the lubricant. In accordance with this model, changes in the dielectric constant of the lubricant will result in changes in the overall capacitance of variable capacitor 903, which will result in changes in the frequency of the output of oscillator 901. The output of oscillator 901 is sampled by sampling circuit 907, and recorded into semiconductor memory 911 by recording circuit 909.

Early in the modeling process, it was determined that a system that depended upon detection of the ingress of drilling fluid into the lubrication system, or the presence of wear debris in the bearing in the lubrication system did not, and would not, provide a failure indication early enough to be of value. Accordingly, the modeling effort continued by examining the optimum discrimination ability of monitoring the effects of working shear on the lubricant and the lubrication system. The modeling process continued by examination of the following potential indicators of degradation of the lubrication system due to the effects of working shear on the lubricant:

(1) the presence or absence of organic compounds in the lubricant, as determined from infrared spectrometry;

(2) the presence or absence of metallic components, as determined from the emission spectra from the lubricant;

(3) the water content in the lubricant as determined from Fisher analysis; and (4) the total acid numbers for the lubricant.

It was determined that, if the grease monitoring capacitors were sized to yield values of about 100E-12 F (with standard grease between the plates), then the temperature-measuring circuit described above could be feasibly adapted for monitoring the operating condition of the lubrication system.

A series of experiments was performed in which CA7000 grease capacitance was determined as a function of drilling fluid contamination (0.1 and 0.2 volume fraction oil-based and water-based fluids), frequency (1 kHz–2 mHz) and temperature (68 F –300 F). Several conclusions as follows were drawn from the tests:

(1) when CA7000 was contaminated with 0.1 volume fraction of oil-based fluid, capacitance values increased by about 5% (relative to pure CA7000). Increases of about 100% were recorded when 0.2 volume fraction of water-based fluid was added. Generally, capacitance was inversely related to frequency; low frequencies are preferred for maximum discrimination; and (2) in the tests, repeatability and reproducibility variations were less than about 1.5%; therefore, the variations were small enough to suggest that grease capacitance measurements may be a feasible way of judging grease contamination levels in excess of 0.1 volume fraction of either oil or and water-based fluid.

Figure 30A:
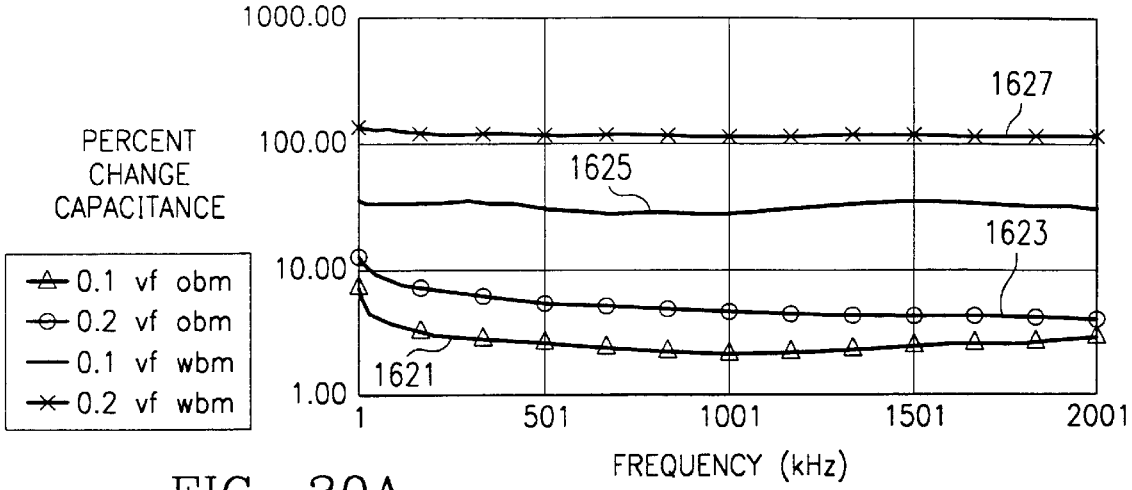
FIGS. 30A, 30B and 30C are graphical and pictorial representations of the examination of optimum lubrication system monitoring in accordance with the present invention.

FIG. 30A is a graphical representation of capacitance change versus frequency for a CA7000 grease contaminated with oil-based muds and water-based muds, with the X-axis representative of frequency in kilohertz, and with the Y-axis representative of percentage of change of capacitance. Curve 1621 represents the data for contamination of the grease with 0.1 volume fraction of an oil-based drilling mud. Curve 1625 represents the data for contamination of the grease with a 0.2 volume fraction of oil-based mud. Curve 1625 represents the data for contamination of the grease with a 0.1 volume fraction of water-based mud. Curve 1627 represents the data for contamination of the grease with a 0.1 volume fraction oil-based mud. All the measurements shown in the graph of FIG. 30A are measurements which are relative to uncontaminated grease. The data shows (1) that for the frequency range tested, discrimination is maximum at one kilohertz; (2) that about five percent discrimination (5% of the measured capacitance of pure CA7000) is required to detect the presence of 0.1 volume fraction of oil-based mud; and (3) that fifty percent discrimination is required to detect 0.1 volume fraction of water-based mud. The effect of water based mud contamination on grease is certainly more pronounced than is the effect of contamination by oil-based mud.

Figure 30B:
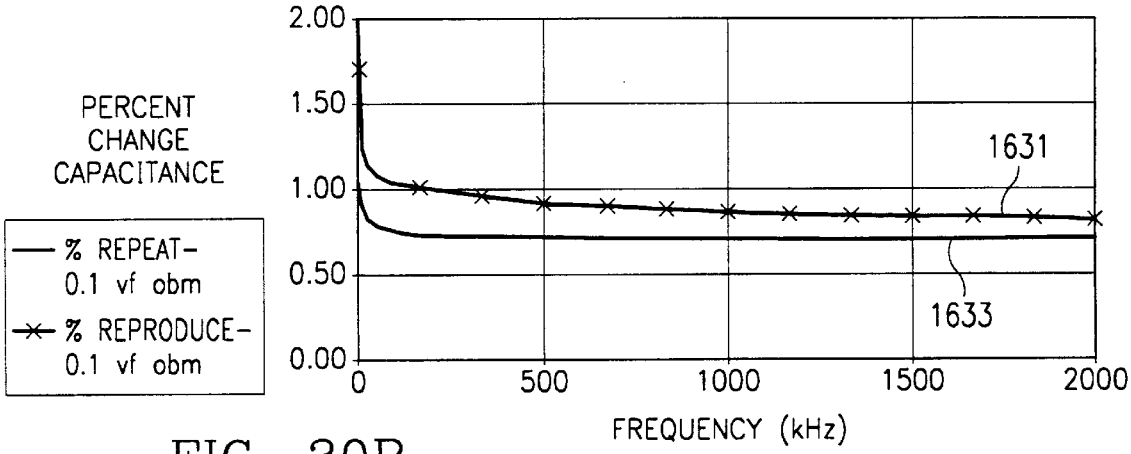

FIG. 30B is a graphical representation of frequency versus percentage change in capacitance, with the X-axis representative of frequency, and with the Y-axis representative of percentage of change in capacitance. Curves 1631, 1633 are representative of the data for the repeatability and reproducibility of the capacitance measurements for 0.1 percent volume fraction contamination of the grease by oil-based mud. The data is shown at a temperature of 50° Centigrade. The data suggests that capacitance measurements can be repeated and reproduced within about 1.5 percent variation. Therefore, since the repeatability/reproducibility ranges are less than the minimum discrimination, it seems feasible to detect 0.1 volume fraction of contamination of the grease by oil-based drilling mud.

Figure 30C:
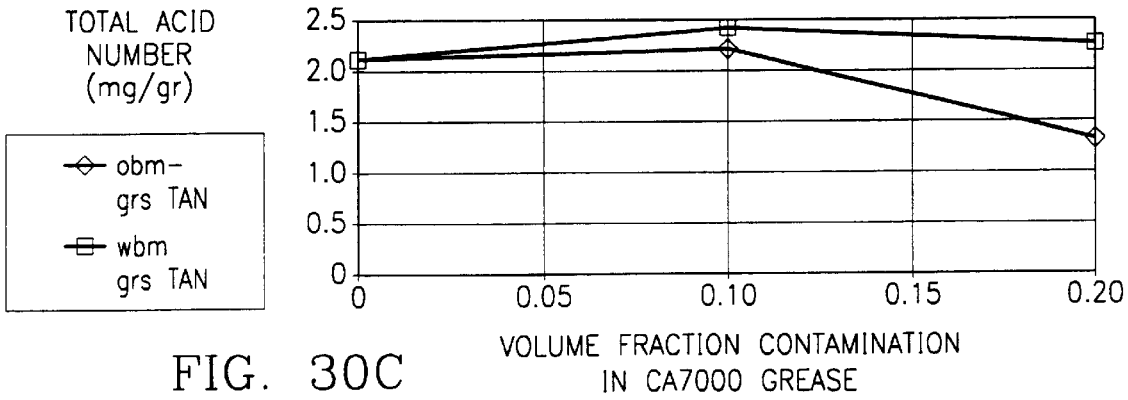

FIG. 30C is a graphical representation of the contamination versus total acid number for both oil-based muds and water-based muds. In this graph, the X-axis is representative of volume fraction of contamination in CA7000 grease, while the Y-axis is representative of total acid number in units of milligram per gram. The results of this test indicate that total acid number will likely provide an indication of contamination of the grease.

Figure 31:
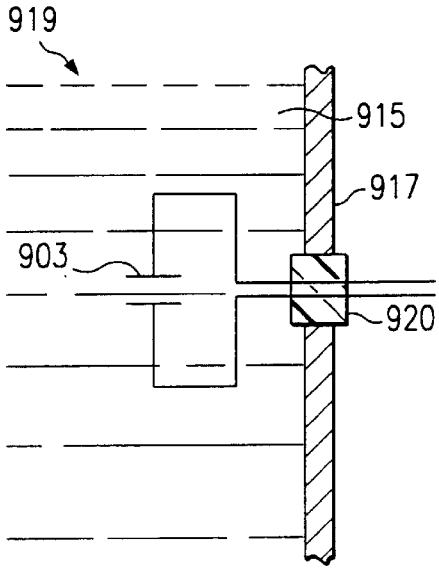
FIG. 31 is a fragmentary arid simplified longitudinal section view of the placement of the lubrication monitoring system in accordance with the present invention.

FIG. 31 is a simplified pictorial representation of the placement of a capacitive sensor 903 within the lubricant 915 of lubrication system reservoir 919. Lubricant 915 gets between the plates of capacitor 903 and affects the capacitance of capacitor 903 as the total acid number of the lubricant changes due to ingress and working shear during drilling operations. As is shown, a conventional pressure bulk head 920 is utilized at the lubrication system reservoir wall 917.

16. ERODIBLE BALL WARNING SYSTEM: The preferred embodiment of the improved drill bit of the present invention further includes a relatively simple mechanical communication system which provides a simple signal which can be detected at a surface location and which can provide a warning of likely or imminent failure of the drill bit during drilling operations. In broad overview, this communication system includes at least one erodible, dissolvable, or deformable ball (hereinafter referred to as an "erodible ball") which is secured in position relative to the improved rock bit of the present invention through an electrically-actuated fastener system. Preferably, the erodible ball is maintained in a fixed position relative to a flow path through the rock bit which is utilized to direct drilling fluid from the central bore of the drillstring to a bit nozzle on the bit. As is conventional, the bit nozzle is utilized to impinge drilling fluid onto the bottom of the borehole and the cutting structure to remove cuttings, and to cool the bit.

Figure 32A:
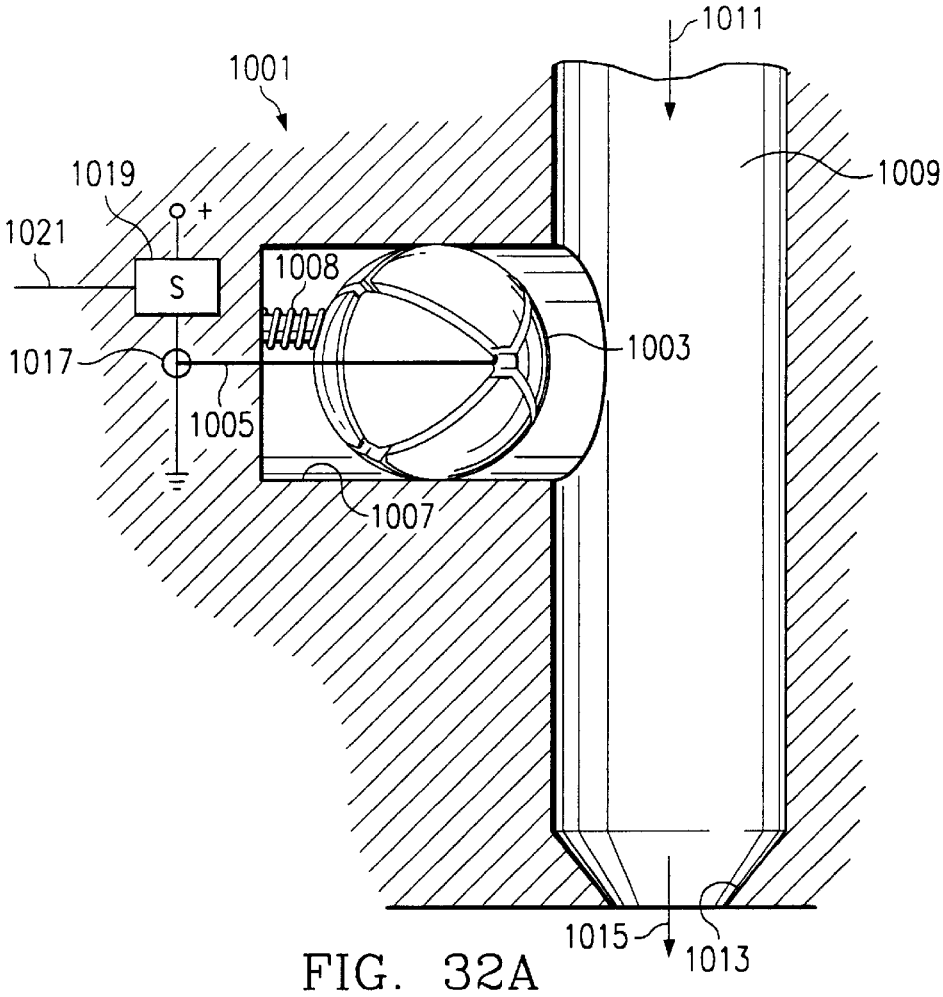
FIGS. 32A, 32B, 32C, 32D, and 32E are simplified pictorial representations of a simple mechanical system for communication to a remote surface location utilizing an erodible ball.

FIG. 32A is a simplified and block diagram representation of the erodible ball monitoring system of the present invention. As is shown, an erodible ball communication system 1001 is provided adjacent fluid flow path 1009 which supplies drilling fluid 1011 to bit nozzle 1013 and produces a high pressure fluid jet 1015 which serves to clean and cool the drill bit during drilling operations. As is shown, erodible ball communication system 1001 includes an erodible ball 1003 which is secured within a cavity 1007 located adjacent to flow path 1009. The erodible ball 1003 is fixed in its position within cavity 1007 by electrically-actuable fastener system 1005, but erodible ball 1003 is also mechanically biased by biasing member 1008 which can include a spring or other mechanical device so that upon release of erodible ball 1003 by electrically-actuable fastener system 1005, mechanical bias 1008 causes erodible ball 1003 to be passed into flow path 1009 and pushed by drilling fluid 1011 into contact with bit nozzle 1013. Erodible ball 1003 is adapted in size to lodge in position within bit nozzle 1013 until the ball is either eroded, dissolved, or deformed by pressure and or fluid impinging on the ball.

The electrically actuable fastener system 1005 is adapted to secure erodible ball 1003 in position until a command signal is received from a subsurface controller carried by the drillstring. In simplified overview, the electrically-actuable fastener system includes an input 1021 and electrically-actuated switch 1019, such as a transistor, which can be electrically actuated by a command signal to allow an electrical current to pass through a frangible or fusible member 1017 which is within the current path, and which is part of the mechanical system which holds erodible ball 1003 in fixed position.

In accordance with one preferred embodiment of the present invention, the electrically frangible or fusible connector 1017 may comprise a Kevlar string which may be disintegrated by the application of current thereto. Alternatively, the electrically-frangible or fusible connector may comprise a fusible mechanical link which fixes a cord in position relative to the drill bit.

In the preferred embodiment of the present invention, the erodible ball 1003 is adapted with a plurality of circumferential grooves and a plurality of holes extending therethrough which allow the drilling fluid 1011 to pass over and/or through the erodible ball 1003 to cause it dissolve or disintegrate over a minimum time interval.

Figure 32B:
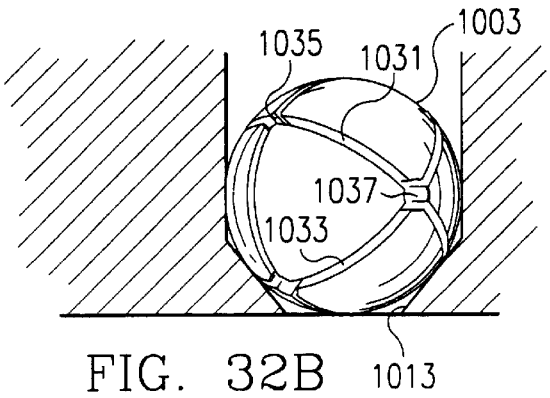

FIG. 32B is a pictorial representation of erodible ball 1003 lodged in position relative to bit nozzle 1013. As is shown, circumferential grooves 1031, 1033 are provided on the exterior surface of erodible ball 1003. In the preferred embodiment of the present invention, the circumferential grooves 1031, 1033 intersect one another at predetermined positions; as is shown in FIG. 32B, the preferred intersection is an orthogonal intersection. In alternative embodiments, the circumferential grooves may be provided in different arrangements or positions relative to one another. Additionally, ports are provided which extend through erodible ball 1003. In the view of FIG. 32B, ports 1035 and 1037 are shown as extending entirely through erodible ball 1003 and intersecting one another at a midpoint within erodible ball 1003. In the preferred embodiment of the present invention, three mutually orthogonal ports are provided through erodible ball 1003. In alternative designs, a lesser or greater number of ports may be provided within erodible ball 1003 to obtain the erosion time needed for the particular application.

Figure 32C:
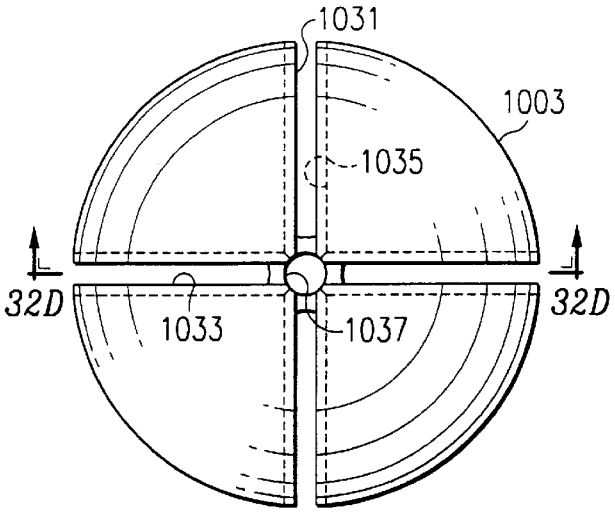
Figure 32D:
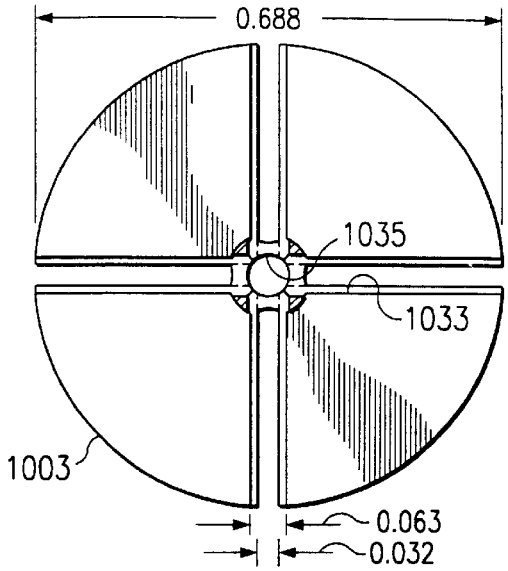

FIGS. 32C and 32D provide detailed views of the preferred embodiment of the erodible ball 1003 of the present invention. As is shown in FIG. 32C, circumferential grooves 1031 and 1033 are rather deep grooves. Preferably, each of the circumferential grooves has a diameter of 0.32 inches. In the preferred embodiment, the erodible ball 1003 has a diameter of 0.688 inches. Additionally, the ports 1035, 1037 have a diameter of 0.063 inches.

As is shown in FIGS. 32C and 32D, the erodible ball 1003 has three-fold symmetry. This symmetry is provided to ensure that drilling fluid will flow through and over the ball irrespective of the position that the ball lodges with respect to the bit nozzle. The spherical shape for the erodible ball 1003 was selected because its effectiveness is independent of lodging orientation. The preferred embodiment of the erodible ball 1003 utilizes both the circumferential grooves and the ports which extend through the erodible ball 1003 as fluid flow paths. As the drilling fluid passes over and through the erodible ball 1003, erosion occurs from the outside-in as well as the inside-out. In the preferred embodiment of the present invention, the erodible ball 1003 is formed from a bronze material, and has the relative dimensions as shown in FIG. 32D. This particular size, material composition and configuration ensures a "residence time" of the erodible ball within the bit nozzle of 300 seconds to 1200 seconds. The temporary occlusion of at least one bit nozzle in the improved drill bit generates a pressure change which is detectable at the surface on most drilling installations as a pressure increase in the central bore and/or pressure decrease in the annulus.

Figure 32E:
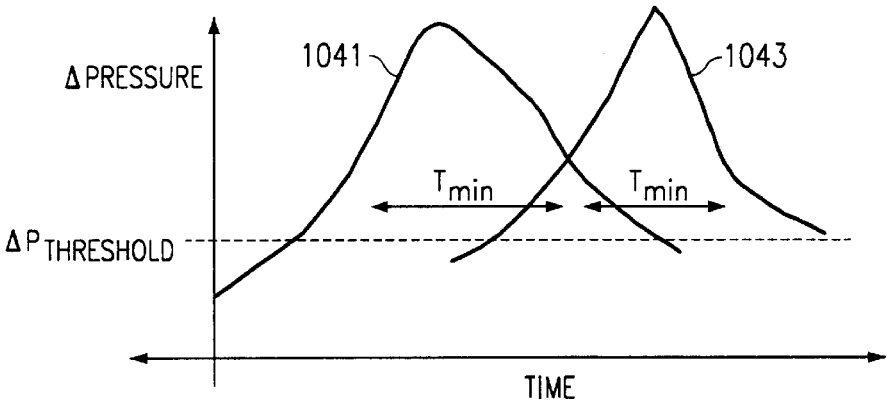

FIG. 32E is a graphical representation of a pressure differential which can be detected at the surface of the drilling installation utilizing conventional pressure sensors. As is shown, the x-axis is representative of time, and the y-axis is representative of the pressure differential sensed by the surface pressure sensors. As is shown, two consecutive pressure surges 1041, 1043 are provided, each having a minimum residence time duration of at least 300 seconds. If the release of the erodible balls is properly timed, together, the consecutively deployed erodible balls will provide a minimum interval of pressure change of 600 seconds, which can be easily detected at the surface, and which can be differentiated from other transient pressure conditions which are due to drilling or wellbore conditions.

As is shown in FIG. 32E, all that is required is that the change in pressure be above a pressure threshold, and that each pressure surge 1041, 1043 have a minimum duration.

In accordance with the present invention, the preferred fastener system comprises either a frangible material, such as a Kevlar string, or a fusible metal link which serves to secure in position a latch member, such as a fastener or cord. When a fusible member is utilized, the improved drill bit of the present invention can conserve power by utilizing a combination of (1) electrical current, and (2) temperature increase in the drill bit due to the likely bit failure, as a result of degradation of the journal bearing or associated lubrication system, to trigger release of the erodible ball.

For example, a fusible link may require a certain amount of electrical energy to change the state of the link from a solid metal to a liquid or semi-liquid state. A certain amount of electrical energy that would otherwise be required to change the state of the fusible link can be provided by an expected increase in temperature in the component being monitored. For example, a certain number of degrees increase in temperature can be attributed to the condition being monitored, such as a degradation in the journal bearing which causes an increase in local temperature in that particular bit leg. The remaining energy can be provided by supplying an electrical current to the fusible link to complete the fusing operation.

Figure 33:
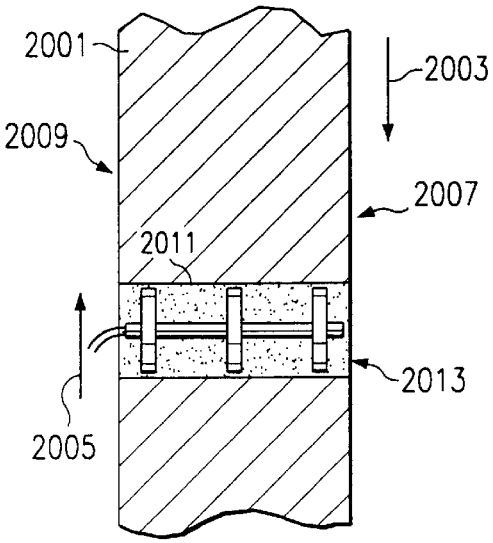
FIGS. 33 and 34 are simplified pictorial representations of an alternative communication system which utilizes an electrically-actuable flow blocking device.
Figure 34:
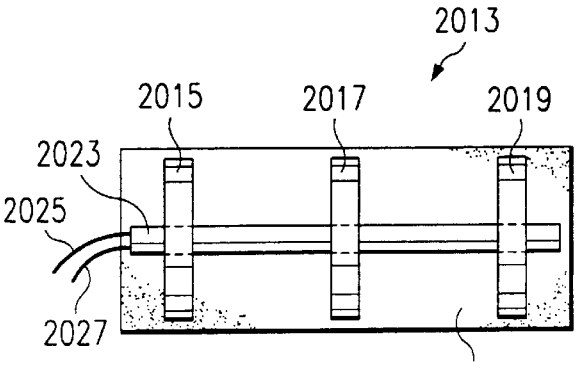

17. PERSISTENT PRESSURE CHANGE COMMUNICATION SYSTEM: FIGS. 33 and 34 are views of an alternative communication system which utilizes an electrically-controllable valve to control or block fluid flow between the central bore of the drillstring and the annulus. FIG. 33 is a simplified view of the operation of the persistent pressure change communication system of the present invention. As is shown, bit body 2001 separates central flow path 2003 from return flowpath 2005. Central flowpath 2003 is a flowpath defined within an interior space within bit body 2001. Typically, central flowpath 2003 supplies drilling-fluid to at least one bit nozzle flowpath carried within bit body 2001 for jetting drilling fluid into the wellbore for cooling the drill bit and for removing cuttings from the bottom of the wellbore. Return flowpath 2005 is disposed within annular region 2009 which is defined between the bit body 2001 and the borehole wall (which is not shown in this view). A signal flowpath 2011 is formed within bit body 2001 which can be utilized to selectively allow communication of fluid between central flowpath 2003 and return flowpath 2005. As is well known, there is a pressure differential between the central flowpath 2003 and the return flowpath 2005 during drilling operations. The present invention takes advantage of this pressure differential by selectively allowing communication of fluid through signal flowpath 2011 when it is desirable to generate a persistent pressure change which may be detected at the surface of the wellbore. Selectively-actuable flow control device 2013 is disposed within signal flowpath 2011 and provided for controlling the flow of fluid through signal flowpath until a predetermined operating condition is detected by the monitoring and control system. Preferably the selectively-actuable flow control device 2013 is an electrically-actuable device which may be disintegrated, dissolved, or "exploded" when signaling is desired. The preferred embodiment of the selectively-actuable flow control device 2013 is provided in simplified and block diagram view of FIG. 33. As is shown, selectively-actuable flow control device includes a plurality of structural members 2015, 2017, 2019 which are held together in a matrix of material 2021 which is in a solid state until thermally activated or electrically activated to change phase to either a liquid state, gaseous state, or which can be fractured or fragmented by the application of electrical current to leads 2025, 2027 to heating element 2023. In operation, the matrix 2021 binds the material together forming a substantially fluid-impermeable plug which blocks the signal flowpath 2011 until an electrical current is supplied to leads 2025, 2027 to fracture, fragment, or change the phase of the matrix 2021, which will allow fluid to pass between the interior region of the bit and the annular region.

Figure 36:
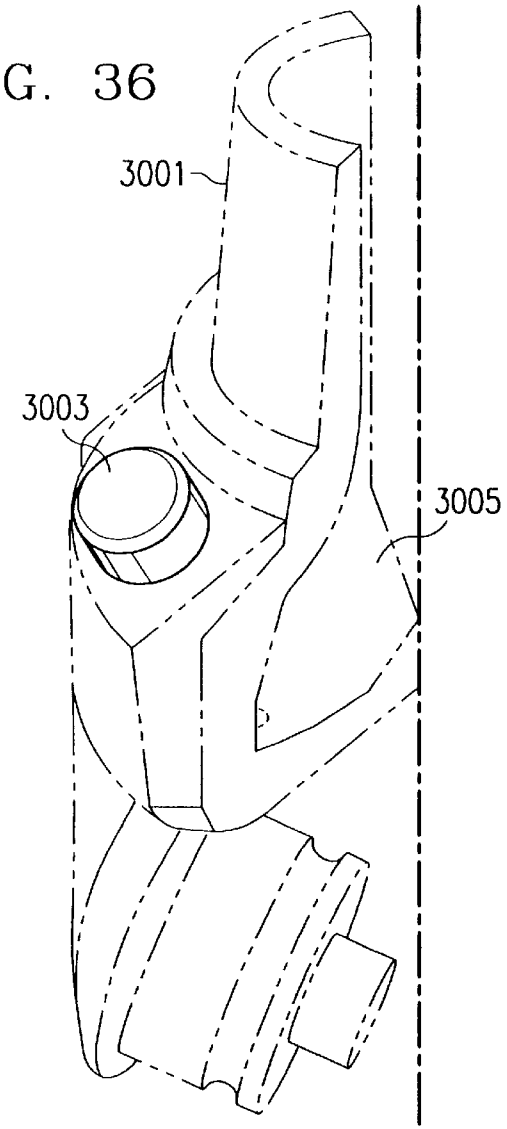

FIG. 36 is a pictorial representation of the selectively-actuable flow control device 3002 which may be utilized to develop a persistent pressure change to communicate signals in a wellbore. As is shown, the selectively-actuable device 3002 is located on an upper portion of bit body 3001 and is utilized to selectively allow communication of fluid between an interior region 3005 of bit body 3001 and an annular region surrounding the bit body.

Figure 37:
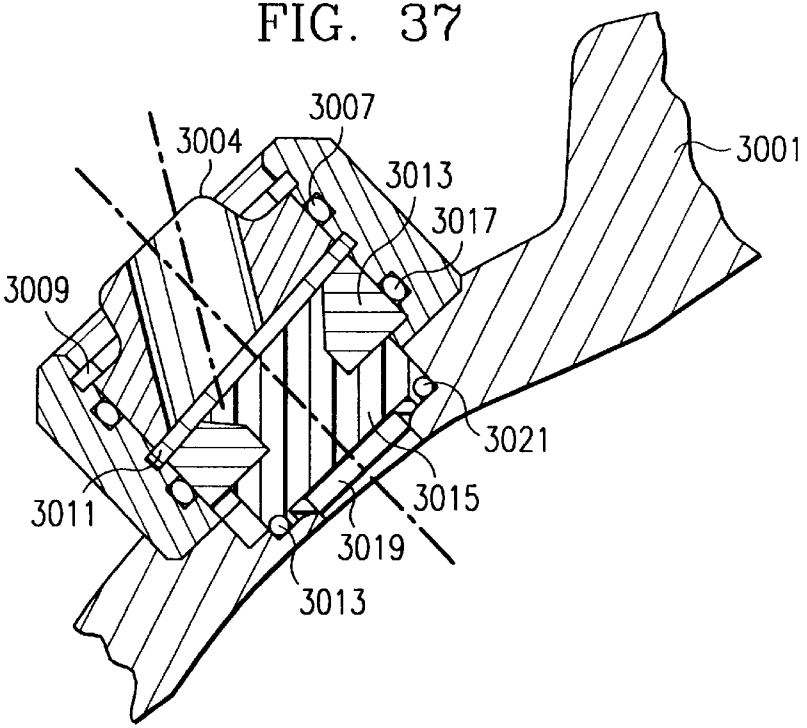
FIGS. 36 and 37 are pictorial and cross-section views of the system of communicating utilizing a persistent pressure change.

FIG. 37 is a cross-section view of the preferred components which make use this selectively-actuable device 3002. As is shown, a nozzle retaining blank 3003 is adapted for securing in position a diverter nozzle 3004 which is held in place by snap rings 3009, 3011. The interface between the nozzle retaining blank 3003 and the diverter nozzle is sealed utilizing o-ring seal 3007. A ruptured disc 3015 is carried between the diverter nozzle 3004 and the bit body 3001. As is shown, the rupture disc 3015 is secured in place within rupture disc retaining bushing 3013. Rupture disc retaining bush 3013 is secured in position relative to nozzle retaining blank 3003 and sealed utilizing o-ring 3017. A spacer ring 3019 secures the lower portion of rupture disc 3015. O-ring seal 3021 is included at the interface of the rupture disc 3015, the bit body 3001, and the spacer ring 3019.

18. ADAPTIVE CONTROL DURING DRILLING OPERATIONS: The present invention may also be utilized to provide adaptive control of a drilling tool during drilling operations. The purpose of the adaptive control is to select one or more operating set points for the tool, to monitor sensor data including at least one sensor which determines the current condition of at least one controllable actuator member carried in the drilling tool or in the bottomhole assembly near the drilling tool which can be adjusted in response to command signals from a controller. This is depicted in broad overview in FIG. 35A. As is shown, a controller 2100 is provided and carried in or near the drilling apparatus. A plurality of sensors 2101, 2103, and 2105 are also provided for providing at least one electrical signal to controller 2100 which relates to any or all of the following: 2103, and 2105 are also provided for providing at least one electrical signal to controller 2100 which relates to any or all of the following:

(1) a drilling environment condition;

(2) a drill bit operating condition;

(3) a drilling operation condition; and (4) a formation condition.

Figure 35A:
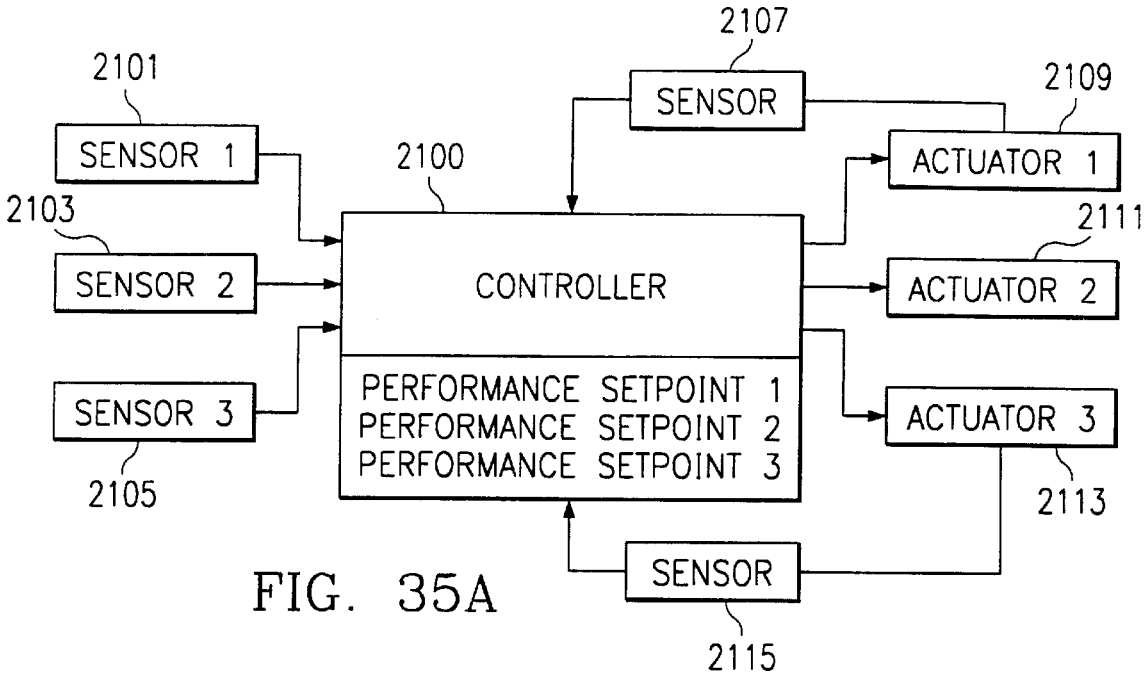
FIGS. 35A through 35I are block diagram and simplified pictorial representations of adaptive control of a drilling apparatus in accordance with the present invention.

As is shown in FIG. 35A, controller 2100 is preferably programmed with at least one operation set point. Furthermore, controller 2100 can provide control signals to at least one controllable actuator member such as actuator 2109 and 2113, or open-loop controllable actuator 2111.

The controllable actuator member is carried on or near the bit body or the bottomhole assembly and is provided for adjusting at least one of the following in response to receipt of at least one control signal from controller 2100:

(1) a drill bit operating condition; and (2) a drilling operation condition.

One or more sensors (such as sensors 2107, 2115) are provided which provide feedback to controller 2100 of the current operating state of a particular one of the at least one controllable actuator members 2109, 2111, 2113. An example of the feedback provided by sensor 2017, 2115 is the physical position of a particular actuator member relative to the bit body. In this adaptive control system, the controller 2100 executes program instructions which are provided for receiving sensor data from sensors 2101, 2103, and 2105, and providing control signals to actuators 2109, 2111, 2113, while taking into account the feedback information provided by sensors 2107, 2115. In the preferred embodiment of the present invention, controller 2100 reaches particular conclusions concerning the drilling environment conditions, the drill bit operating conditions, and the drilling operation conditions. Controller 2100 then acts upon those conclusions by adjusting one or more of actuators 2019, 2111, 2113. In operation, the system can achieve and maintain some standard of performance under changing environmental conditions as well as changing system reliability conditions such as component degradation. For example, controller 2100 may be programmed to attempt to obtain a predetermined and desirable level of rate-of-penetration. Ordinarily, this operation is performed at the surface utilizing the relatively meager amounts of data which are provided during conventional drilling operations. In accordance with the present invention, the controller is located within the drilling apparatus or near the drilling apparatus, senses the relevant data, and acts upon conclusions that it reaches without requiring any interaction with the surface location or the human operator located at the surface location. Another exemplary preprogrammed objective may be the avoidance of risky drilling conditions if it is determined that the drilling apparatus has suffered significant wear and may be likely to fail. Under such circumstances, controller 2100 may be preprogrammed to adjust the rate of penetration to slightly decrease the rate of penetration in exchange for greater safety in operation and the avoidance of the risks associated with operating a tool which is worn or somewhat damaged.

Figure 35B:
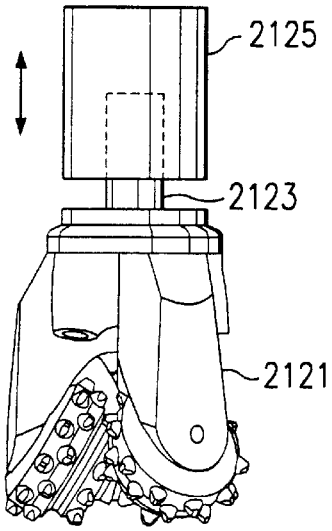

FIGS. 35B through 35I are simplified pictorial representations of a variety of types of controllable actuator members which may be utilized in accordance with the present invention. FIG. 35B is a pictorial representation of a rolling cone cutter 2121 which is mechanically coupled through member 2123 to an electrically-actuable electro-mechanical actuator 2125 which may be utilized to adjust the position of the rolling cone cutters relative to the bit body 2121.

Figure 35C:
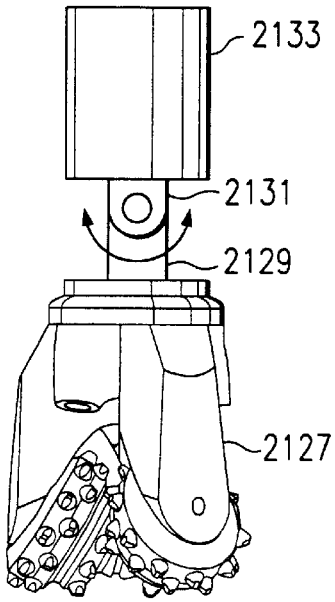

FIG. 35C is a simplified pictorial representation of rolling cutter 2129 which is mechanically coupled through linkage 2129 and pivot point 2131 to electromechanical actuator 2133 which is provided to adjust the relative angle of rolling cone cutters relative to the bit body 2127.

Figure 35D:
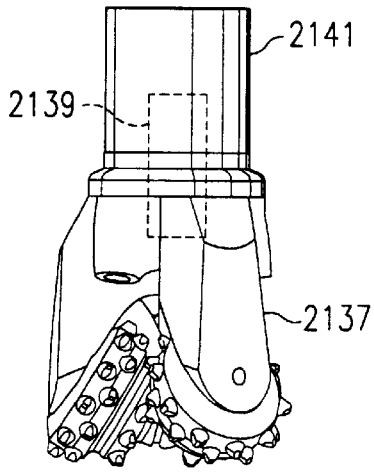

FIG. 35D is a simplified pictorial representation of rolling cone cutters relative to the bit body 2137 which is mechanically coupled through bearing assembly 2139 to an electrically actuable electro-mechanical rotation control system which adjusts the rate of rotation of the rolling cone cutters by increasing or decreasing the rate slightly by adjusting the bearing assembly electrically or mechanically. For example, magnetized components and electromagnetic circuits can be utilized to "clutch" the cone. Alternatively, the magnetorestrictive principle may be applied to physically alter the components in response to a generated magnetic field.

Figure 35E:
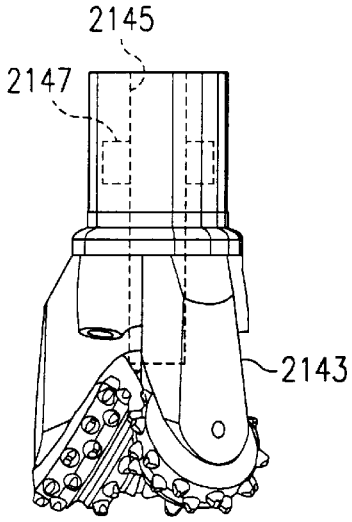

FIG. 35E is a simplified pictorial representation of a bit nozzle. As is shown, a nozzle flowpath 2145 is provided through bit body 2143. An electromechanical actuator 2147 may be provided in the nozzle flowpath to adjust the amount of fluid allowed to pass through the nozzle. Alternatively, the electromechical device 2147 may be provided to adjust the angular orientation of the output of the nozzle to redirect the jetting and cooling drilling fluid.

Figure 35F:
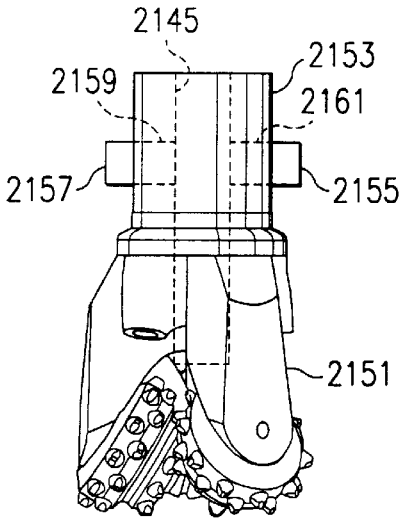

FIG. 35F is a simplified representation of a drill bit 2151 connected to a drillstring 2153. Pads 2155, 2157 may be provided in the bottomhole assembly and mechanically coupled to an electrically-actuable controller member 2159, 2161 which may be utilized to adjust the inward and outward position of pads 2155, 2157.

Figure 35G:
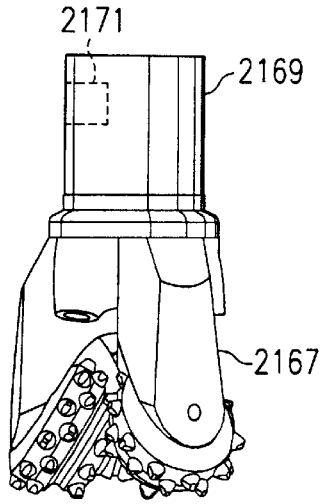

FIG. 35G is a simplified pictorial representation of a drill bit 2167 connected to a drilling motor 2169. A controller 2171 may be provided for selectively actuating drilling motor 2169. In accordance with the present invention, the adaptive control system may be utilized to adjust the speed of the drilling motor which in turn adjusts the speed of drilling and affects the rate of penetration.

Figure 35H:
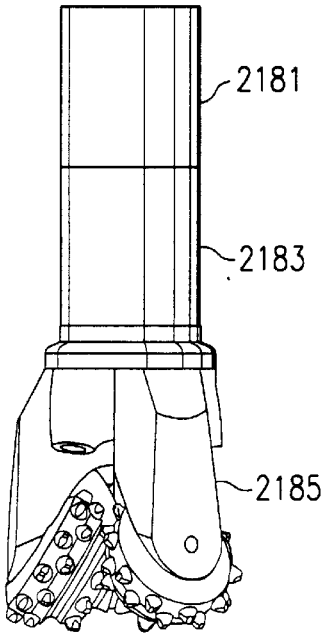

FIG. 35H is a simplified pictorial representation of a drill bit 2185 connected to a steering subassembly 2183 and a drilling motor 2181. In accordance with the present invention, the adaptive control system may be utilized to control steering assembly 2183 to adjust the orientation of the drill bit relative to the borehole, which is particularly useful in directional drilling.

Figure 35I:
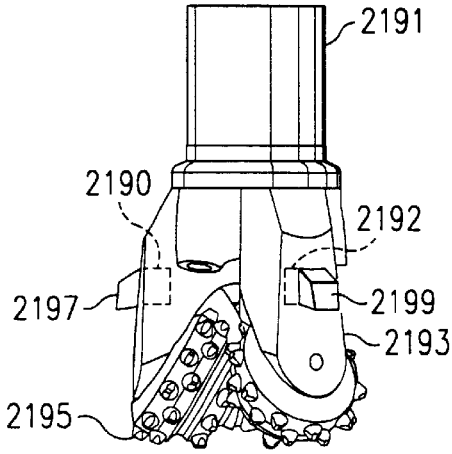

FIG. 35I is a simplified pictorial representation of drill bit 2193 with a plurality of fixed or rolling cone cutting structures such as cutting structure 2195 carried thereon. Drill bit 2193 is connected to bottomhole assembly 2191. Gage trimmers 2197, 2199 are provided in upper portion of drill bit 2193. Gage trimmers are connected to electromechanical members 2190, 2192 which may be utilized to adjust the inward and outward position of gage trimmers 2197, 2199. The gage trimmers may be pushed outward in order to expand the gage of the borehole. Conversely, the gage trimmers may be pulled inward relative to the bit body in order to reduce the gage of the borehole.

While the invention has been shown in only one of its forms, it is not thus limited but is susceptible to various changes and modifications without departing from the spirit thereof.

What is claimed is:

1. An improved drill bit for use in drilling operations in a wellbore, comprising:

a bit body including a plurality of bit legs, each supporting a rolling cone cutter;

a coupling member formed at an upper portion of said bit body;

at least one temperature sensor for monitoring at least one temperature condition of said improved drill bit during drilling operations; and at least one journal bearing assembly carried by at least one of said plurality of bit legs;

at least one temperature sensor cavity formed in at least one of said plurality of bit legs, and adapted for receiving, carrying, and locating said at least one temperature sensor in a particular position relative to said bit body which is empirically determined to optimize temperature sensor discrimination;

wherein the position of said temperature sensor cavity relative to said at least one of said plurality of bit legs allows, during drilling operations, said at least one temperature sensor to measure primarily heat generated by said at least one journal bearing, but not other wellbore heat sources.

2. An improved drill bit for use in drilling operations, according to claim 1:

wherein said at least one temperature sensor comprises at least one temperature sensor for each of said plurality of bit legs; and wherein said at least one temperature sensor cavity comprises at least one temperature sensor cavity formed in each of said plurality of bit legs which is adapted for receiving, carrying, and locating a particular temperature sensor in a particular position relative to a particular bit leg, and which is empirically determined to optimize temperature sensor discrimination for that particular bit leg.

3. An improved drill bit for use in drilling operating, according to claim 1:

wherein said at least one temperature sensor cavity comprises at least one temperature sensor cavity formed in a particular one of said plurality of bit legs which is adapted for receiving, carrying, and locating said at least one temperature sensor in a particular position relative to said particular one of said plurality of bit legs, and which is empirically determined to optimize temperature sensor discrimination.

4. An improved drill bit for use in drilling operations, according to claim 3:

wherein each of said plurality of bit legs include a bearing head for engagement with a rolling cone cutter; and wherein said particular position comprises a medial position within said bearing head.

5. An improved drill bit, according to claim 4:

wherein said bearing head is substantially cylindrically symmetrical along a centerline; and wherein said particular position comprises a medial position within said bearing head proximate said centerline.

6. An improved drill bit according to claim 5:

wherein said bearing head extends between a lower extent of said bit leg and a thrust face; and wherein said particular position comprises a medial position within said bearing head about said centerline between said lower extent of said bit body and said thrust face.

7. An improved drill bit, for use in drilling operations in a wellbore comprising:

a bit body including a plurality of bit legs, each supporting a rolling cone cutter;

a coupling member formed at an upper portion of said bit body;

at least one temperature sensor for monitoring at least one temperature condition of said improved drill bit during drilling operations;

at least one temperature sensor cavity formed in said bit body and adapted for receiving, carrying, and locating said at least one temperature sensor in a particular position relative to said bit body which is empirically determined to optimize temperature sensor discrimination;

wherein said improved drill bit includes a lubrication system for providing lubrication for each of said rolling cone cutters; and wherein said at least one temperature sensor is not in communication with said lubrication system.

8. An improved drill bit according to claim 7, further comprising:

pressure isolator members to maintain at least said at least one temperature sensor cavity in pressure isolation from said wellbore.

9. An improved drill bit for use in drilling operations in a wellbore comprising:

a bit body including a plurality of bit legs, each supporting a rolling cone cutter;

a coupling member formed at an upper portion of said bit body;

at least one temperature sensor for monitoring at least one temperature condition of said improved drill bit during drilling operations;

at least one temperature sensor cavity formed in said bit body and adapted for receiving, carrying, and locating said at least one temperature sensor in a particular position relative to said bit body which is empirically determined to optimize temperature sensor discrimination;

a service bay formed in said bit body to allow access to at least said at least one temperature sensor cavity.

10. A method of performing drilling operations in a wellbore, comprising:

providing a bit body including a plurality of bit legs, each supporting a rolling cone cutter;

providing a coupling member formed at an upper portion of said bit body;

providing at least one temperature sensor for monitoring at least one temperature condition of said bit body during drilling operations;

empirically determining a particular position for said at least one temperature sensor well which optimizes temperature sensor discrimination;

forming at least one temperature sensor well in said bit body at said particular position relative to said bit body which is empirically determined to optimize temperature sensor discrimination;

locating said at least one temperature sensor in said at least one temperature sensor well;

utilizing said improved drill bit during drilling operations in said wellbore; and utilizing said at least one temperature sensor to sense at least one temperature during drilling operations.

11. A method of performing drilling operations in a wellbore, according to claim 10:

wherein said step of providing at least one temperature sensor comprises providing at least one temperature sensor for each of said plurality of bit legs; and wherein said step of forming at least one temperature sensor well comprises forming at least one temperature sensor cavity formed in each of said plurality of bit legs which is adapted for receiving, carrying, and locating a particular temperature sensor in a particular position relative to a particular bit leg, and which is empirically determined to optimize temperature sensor discrimination for that particular bit leg.

12. A method of performing drilling operations in a wellbore, according to claim 10:

wherein said step of forming at least one temperature sensor well comprises forming at least one temperature sensor cavity formed in a particular one of said plurality of bit legs adapted for receiving, carrying, and locating said at least one temperature sensor in a particular position relative to said particular one of said plurality of bit legs which is empirically determined to optimize temperature sensor discrimination.

13. A method of performing drilling operations in a wellbore, according to claim 12:

wherein each of said plurality of bit legs include a bearing head for engagement with a rolling cone cutter; and wherein said particular position comprises a medial position within said bearing head.

14. A method of performing drilling operations in a wellbore, according to claim 13:

wherein said bearing head is substantially cylindrically symmetrical along a centerline; and wherein said particular position comprises a medial position within said bearing head proximate said centerline.

15. A method of performing drilling operations in a wellbore, according to claim 14:

wherein said bearing head extends between a lower extent of said bit leg and a thrust face; and wherein said particular position comprises a medial position within said bearing head about said centerline between said lower extent of said bit body and said thrust face.

16. A method of performing drilling operations in a wellbore, according to claim 10, further comprises:

wherein said improved drill bit includes a lubrication system for providing lubrication for each of said rolling cone cutters;

wherein said at least one temperature sensor is not in communication with said lubrication system.

17. A method of performing drilling operations in a wellbore, according to claim 10, further comprising:

providing at least one service bay formed in said bit body to allow access to said at least said temperature sensor cavity.

18. A method of providing drilling operations, according to claim 10, further comprising:

providing pressure isolator members to maintain at least said at least one temperature sensor cavity in pressure isolation from said wellbore.

19. A method of performing drilling operations in a wellbore, comprising:

providing a bit body including a cutting structure;

providing a coupling member formed at an upper portion of said bit body; providing at least one temperature sensor for monitoring at least one temperature condition of said bit body during drilling operations;

empirically determining a particular position for said at least one temperature sensor well which optimizes temperature sensor discrimination;

forming at least one temperature sensor well in said bit body at said particular position relative to said bit body which is empirically determined to optimize temperature sensor discrimination;

locating said at least one temperature sensor in said at least one temperature sensor well;

utilizing said improved drill bit during drilling operations in said wellbore; and utilizing said at least one temperature sensor for monitoring at least one temperature condition during drilling operations.

20. An improved drill bit for use in drilling operations in a wellbore, comprising:

a bit body including a plurality of bit legs, each supporting a rolling cone cutter;

at least one lubrication system, including lubrication pathways formed in said bit body, and utilized to lubricate each rolling cone cutter;

a coupling member formed at an upper portion of said bit body;

at least one operating condition sensor for monitoring at least one operating condition of said improved drill bit during drilling operations and producing an electrical output signal corresponding thereto;

a plurality of electrical conductors for coupling electrically-activated components carried by said improved drill bit including said at least one operating condition sensor;

a plurality of wire pathways formed in said bit body independent of said at least one lubrication system, wherein said plurality of wire pathways are not in communication with said lubrication pathways; and a plurality of interconnecting fluid-impermeable tube segments coupled to said bit body and communicatively aligned with said plurality of wire pathways to route and protect said plurality of electrical conductors.

21. An improved drill bit according to claim 20, further comprising:

wherein said at least one operating condition sensor comprises at least one operating condition sensor for each of said plurality of bit legs; and wherein said at least one fluid-permeable tube segment comprises a plurality of fluid-impermeable tube segments coupled to said bit body and communicatively aligned with said plurality of wire pathways to route and protect said plurality of electrical conductors, including a fluid-impermeable tube segment extending from a wire pathway formed in each of said plurality of bit legs to a segment connector.

22. An improved drill bit according to claim 20, further comprising:

wherein said at least one operating condition sensor comprises at least one temperature sensor for each of said plurality of bit legs;

wherein said at least one fluid-impermeable tube segment comprises a plurality of fluid-impermeable tube segments coupled to said bit body and communicatively aligned with said plurality of wire pathways to route and protect said plurality of electrical conductors, including:

(a) a plurality of fluid-impermeable tube segments, each communicating with a wire pathway formed in each of said plurality of bit legs at a first end portion; and (b) a segment connector adapted for coupling to a second end portion of said plurality of fluid-impermeable tube segments.

23. An improved drill bit according to claim 22:

wherein said a plurality of fluid-impermeable tube segments are positioned substantially transverse to a centerline of said improved drill bit.

24. An improved drill bit according to claim 22:

wherein said segment connector is substantially centrally located relative to said a plurality of fluid-impermeable tube segments.

25. An improved drill bit according to claim 22:

wherein each of said plurality of fluid-impermeable tube segments are angularly substantially equidistant from adjoining tube segments.

26. An improved drill bit comprising:

a bit body including a plurality of bit legs, each supporting a rolling cone cutter;

a coupling member formed at an upper portion of said bit body;

at least one temperature sensor for monitoring at least one temperature condition of said improved drill bit during drilling operations;

means for locating said at least one temperature sensor in a particular position relative to said bit body which is empirically determined to optimize temperature sensor discrimination;

wherein said bearing head extends between a lower extent of said bit leg and a thrust face; and wherein said particular position comprises a medial position within said bearing head about said centerline between said lower extent of said bit body and said thrust face.

27. An improved drill bit, comprising:

a bit body including a plurality of bit legs, each supporting a rolling cone cutter;

a coupling member formed at an upper portion of said bit body;

at least one temperature sensor for monitoring at least one temperature condition of said improved drill bit during drilling operations;

means for locating said at least one temperature sensor in a particular position relative to said bit body which is empirically determined to optimize temperature sensor discrimination;

wherein said improved drill bit includes a lubrication system for providing lubrication for each of said rolling cone cutters; and wherein said at least one temperature sensor is not in communication with said lubrication system.

28. An improved drill bit, comprising:

a bit body including a plurality of bit legs, each supporting a rolling cone cutter;

a coupling member formed at an upper portion of said bit body;

at least one temperature sensor for monitoring at least one temperature condition of said improved drill bit during drilling operations;

means for locating said at least one temperature sensor in a particular position relative to said bit body which is empirically determined to optimize temperature sensor discrimination; and pressure isolator members to maintain at least said at least one temperature means for locating in pressure isolation from said wellbore.

29. A method of performing drilling operations in a wellbore, comprising:

providing a bit body including a plurality of bit legs, each supporting a rolling cone cutter;

providing a coupling member formed at an upper portion of said bit body;

providing at least one temperature sensor for monitoring at least one temperature condition of said bit body during drilling operations;

empirically determining a particular position for said at least one temperature sensor well which optimizes temperature sensor discrimination;

locating said at least one temperature sensor in said particular position;

utilizing said improved drill bit during drilling operations in said wellbore; and utilizing said at least one temperature sensor to sense at least one temperature during drilling operations.

30. A method of performing drilling operations in a wellbore, according to claim 29:

wherein said step of providing at least one temperature sensor comprises providing at least one temperature sensor for each of said plurality of bit legs.

31. A method of performing drilling operations in a wellbore, according to claim 30:

wherein each of said plurality of bit legs include a bearing head for engagement with a rolling cone cutter; and wherein said particular position comprises a medial position within said bearing head.

32. A method of performing drilling operations in a wellbore, according to claim 31:

wherein said bearing head is substantially cylindrically symmetrical along a centerline; and wherein said particular position comprises a medial position within said bearing head proximate said centerline.

33. A method of performing drilling operations in a wellbore, according to claim 32:

wherein said bearing head extends between a lower extent of said bit leg and a thrust face; and wherein said particular position comprises a medial position within said bearing head about said centerline between said lower extent of said bit body and said thrust face.

34. A method of performing drilling operations in a wellbore, according to claim 29, further comprises:

wherein said improved drill bit includes a lubrication system for providing lubrication for each of said rolling cone cutters;

wherein said at least one temperature sensor is not in communication with said lubrication system.

35. A method of performing drilling operations in a wellbore, according to claim 29, further comprising:

providing at least one service bay formed in said bit body to allow access to said at least said temperature sensor cavity.

36. An improved drill bit for use in drilling operations in a wellbore, comprising:

a bit body including a plurality of bit legs, each supporting a rolling cone cutter;

a lubrication subassembly, including lubrication pathways;

a coupling member formed at an upper portion of said bit body;

at least one operating condition sensor for monitoring at least one operating condition of said improved drill bit during drilling operations and producing an electrical output signal corresponding thereto;

a plurality of electrical conductors for coupling electrically-activated components carried by said improved drill bit including said at least one operating condition sensor;

a plurality of wire pathways formed in said bit body which are not communication with said lubrication pathways; and a conduit system aligned with said plurality of wire pathways and extending throughout said wire pathways to route and protect said plurality of electrical conductors.

37. An improved drill bit according to claim 36, further comprising:

wherein said at least one operating condition sensor comprises at least one operating condition sensor for each of said plurality of bit legs.

38. An improved drill bit according to claim 36, further comprising:

wherein said at least one operating condition sensor comprises at least one temperature sensor for each of said plurality of bit legs.

39. A method of performing drilling operations in a wellbore, comprising:

providing a bit body including a plurality of bit legs, each supporting a rolling cone cutter;

providing at least one lubrication subsystem, including at least one lubrication pathway;

providing a coupling member formed at an upper portion of said bit body;

providing an at least one operating condition sensor for monitoring at least one operating condition of said bit during drilling operations;

providing a plurality of electrical conductors for coupling electrically-activated components carried by said drill bit including said at least one operating conditions;

providing a plurality of wire pathways formed in said bit body;

maintaining said plurality of wire pathways out of communication with said lubrication pathways; and providing at least one fluid-impermeable wire covering aligned with said plurality of wire pathways to route and protect said plurality of electrical conductors:

locating said at least one temperature sensor in said at least one temperature sensor well;

locating said at least one temperature sensor in said at least one temperature sensor well;

utilizing said improved drill bit during drilling operations in said wellbore;

utilizing said at least one operating condition sensor to sense at least one temperature during drilling operations.

40. A method of performing drilling operations in a wellbore, according to claim 39:

wherein said step of providing at least one operating condition sensor comprises providing at least one operating condition sensor for each of said plurality of bit legs; and wherein said step of providing at least one fluid-impermeable wire covering comprises providing a wire covering coupled to said bit body and communicatively aligned with said plurality of wire pathways to route and protect said plurality of electrical conductors.

* * * * *